US012663208B2

(12) United States Patent
Bradley

(10) Patent No.: US 12,663,208 B2
(45) Date of Patent: Jun. 23, 2026

(54) COOLER FOR HOLDING BEVERAGE CONTAINERS

(71) Applicant: Danby Products Limited, Guelph (CA)

(72) Inventor: Oliver Bradley, Guelph (CA)

(73) Assignee: DANBY PRODUCTS LIMITED, Guelph (CA)

( * ) Notice: Subject to any disclaimer, the term of this patent is extended or adjusted under 35 U.S.C. 154(b) by 86 days.

(21) Appl. No.: 18/602,135

(22) Filed: Mar. 12, 2024

(65) Prior Publication Data

US 2024/0210105 A1 Jun. 27, 2024

Related U.S. Application Data

(63) Continuation-in-part of application No. 18/378,282, filed on Oct. 10, 2023.

(60) Provisional application No. 63/452,002, filed on Mar. 14, 2023, provisional application No. 63/415,529, filed on Oct. 12, 2022.

(51) Int. Cl.

| | |
|---|---|
| ***F25D 31/00*** | (2006.01) |
| ***F25D 23/02*** | (2006.01) |
| ***F25D 23/06*** | (2006.01) |
| ***F25D 25/02*** | (2006.01) |

(52) U.S. Cl.
CPC ..... *F25D 31/007* (2013.01); *F25D 23/028* (2013.01); *F25D 25/024* (2013.01); *F25D 23/063* (2013.01); *F25D 2325/021* (2013.01)

(58) Field of Classification Search
CPC ..... F25D 25/024; F25D 2325/021
See application file for complete search history.

(56) References Cited

U.S. PATENT DOCUMENTS

| | | | | |
|---|---|---|---|---|
| 3,870,155 | A | 3/1975 | Galloway | |
| 2005/0211648 | A1 | 9/2005 | Haller et al. | |
| 2021/0137288 | A1* | 5/2021 | Fagundes | A47B 96/025 |

* cited by examiner

*Primary Examiner* — Ana M Vazquez
(74) *Attorney, Agent, or Firm* — Ralph E. Jocke; WALKER & JOCKE

(57) ABSTRACT

An exemplary beverage cooler (100) includes an interior area (104) which has a plurality of beverage container supporting shelves (116). The exemplary shelves each include a front portion (122) and a back portion (124). The front portion includes a plurality of bottle engaging recesses (136) and the back portion includes a plurality of bottle engaging recesses (154). The bottle engaging recesses are configured for holding bottles (138, 162). A plurality of bottle neck props (168) are selectively movable between raised and lowered positions. Each bottle neck prop is configured for engaging a neck of a respective bottle 138 such that the bottle is held tilted at an acute angle to horizontal.

28 Claims, 36 Drawing Sheets

Bottle prop cannot rotate down

Slide bottle prop across

Prop can now rotate down

COOLER FOR HOLDING BEVERAGE CONTAINERS

TECHNICAL FIELD

Exemplary arrangements relate to devices that hold beverage containers at selected cool temperatures. Specifically, exemplary arrangements relate to a wine cooler apparatus with configurable shelf arrangements that enable supporting bottles or similar beverage containers in selected orientations.

BACKGROUND

It is often desirable to maintain certain beverages at selected temperatures. An example of a type of beverage that is desirable to maintain at a selected temperature is wine. However it may be desirable to maintain other types of beverages at selected temperatures.

The organized storage of beverages within a cooler apparatus may be accomplished using different types of shelves. However, a shelf configuration that may be suitable for holding one size or type of a beverage container, may not be suitable for holding other sizes and types of beverage containers.

Beverage holding coolers and the shelves that are used therein for supporting beverage containers may benefit from improvements.

SUMMARY

Exemplary arrangements provide an apparatus including a cooler configured for holding beverage containers. The exemplary apparatus includes an enclosure which bounds an interior area. The enclosure includes an opening to the interior area from outside the enclosure. A door that is movably mounted to the enclosure is movable between a closed door position in which the door prevents access from outside the enclosure to the interior area, and an open position in which the interior area is accessible from outside the enclosure. The exemplary door includes a transparent front panel that enables viewing of the beverage containers housed within the interior area.

The exemplary cooler apparatus includes a plurality of vertically spaced parallel, horizontally extending shelves. The exemplary shelves include at least one configurable shelf. The at least one configurable shelf includes a front portion and a back portion. The exemplary front portion is rotatably movable relative to the back portion.

In the exemplary arrangement the front portion is configured to be releasably fixed in a plurality of positions relative to the back portion. These positions include a flat shelf position in which the front portion is in co-planar relation with the back portion. Another of the positions is a tilted position in which the front portion extends at an acute angle relative to the back portion, and in which an inward end of the front portion that is immediately adjacent to the back portion extends vertically above the back portion. The exemplary shelf further enables a front portion be placed in a retracted position. In the retracted position the front portion is disposed rearward and is in at least one of overlying or underlying relation with at least a portion of the back portion.

Exemplary arrangements further include immediately vertically adjacent configurable shelves. Such arrangements enable the front portion of the lower shelf to be in a tilted position such that beverage containers such as bottles may be positioned in a tilted configuration in engagement with the front portion. In such an arrangement the front portion of the configurable shelf immediately above the shelf supporting bottles in the tilted configuration, is positioned in the retracted position. This enables the necks of the bottles on the lower shelf to extend upward to a vertical level of at least that of the shelf above. Because the front portion of the shelf above is in the retracted position, the upper shelf of the pair does not interfere with the upwardly tilted bottles supported on the front portion of the lower shelf. Numerous different shelf arrangements and configurations may be provided for supporting beverage containers in a desired manner.

Exemplary arrangements may include horizontally extending shelf support plates that have an elongated horizontally extending slot. The slots are configured to receive at least one resilient insert therein. The exemplary insert includes a plurality of horizontally spaced projections that extend outward from and vertically above the slot when the insert is positioned within the slot. The spaced projections serve to engage and hold beverage containers in a desired spaced relation. In some arrangements exemplary the inserts may include different spaced arrangements of projections on the opposed horizontal edges thereof. This enables a single insert to be utilized for holding different sizes and configurations of beverage containers based on how the insert is oriented when positioned in the slot.

Other exemplary arrangements include a cooler that houses a plurality of vertically spaced beverage container supporting shelves that each include a respective front portion and back portion. In the exemplary arrangement the shelves are movably mounted in operatively supported connection with the enclosure of the cooler so each can be selectively extended out of the opening to the enclosure when the door is in the door open position. The front portion of each exemplary shelf is manually removable. Each exemplary front portion includes a plurality of horizontally spaced first bottle engaging recesses. Each bottle engaging recess is configured to engage a cylindrical side wall of a respective bottle that has the bottle axis extending parallel to the movement direction.

Each back portion includes a plurality of horizontally spaced second bottle engaging recesses. Each second bottle engaging recess is configured to engage a cylindrical side wall of a further respective bottle that has the further bottle axis extending horizontal and parallel to the movement direction. In the exemplary arrangement each first bottle engaging recess is horizontally offset so as to be intermediate of an immediately adjacent pair of second bottle engaging recesses.

Each exemplary shelf further includes at least one bottle neck prop that is movably mounted in operative engagement with the back portion. Each bottle neck prop is movable between a prop lowered position and the prop raised position. In the prop lowered position the respective prop is configured to engage a neck of a bottle that has a cylindrical side wall of the bottle engaged in a first bottle engaging recess and which has a bottle axis that extends generally horizontal. In the prop raised position the prop is configured to engage the neck of the bottle such that the axis of the bottle extends further upward with increased proximity to the back portion and at an acute angle to the horizontal.

The front portion of a shelf may be removed so that a bottle which has a neck supported by a bottle neck prop in the raised position on a shelf immediately below, may extend upward to at least a level of the back portion of the upper shelf. As a result the shelf with the bottle neck prop in the raised position holding the bottle extending upward, may be moved in and out of the enclosure without interfering with the shelf immediately above.

Numerous other useful aspects of the exemplary arrangements are described in the following Detailed Description.

DETAILED DESCRIPTION

Figure 1:
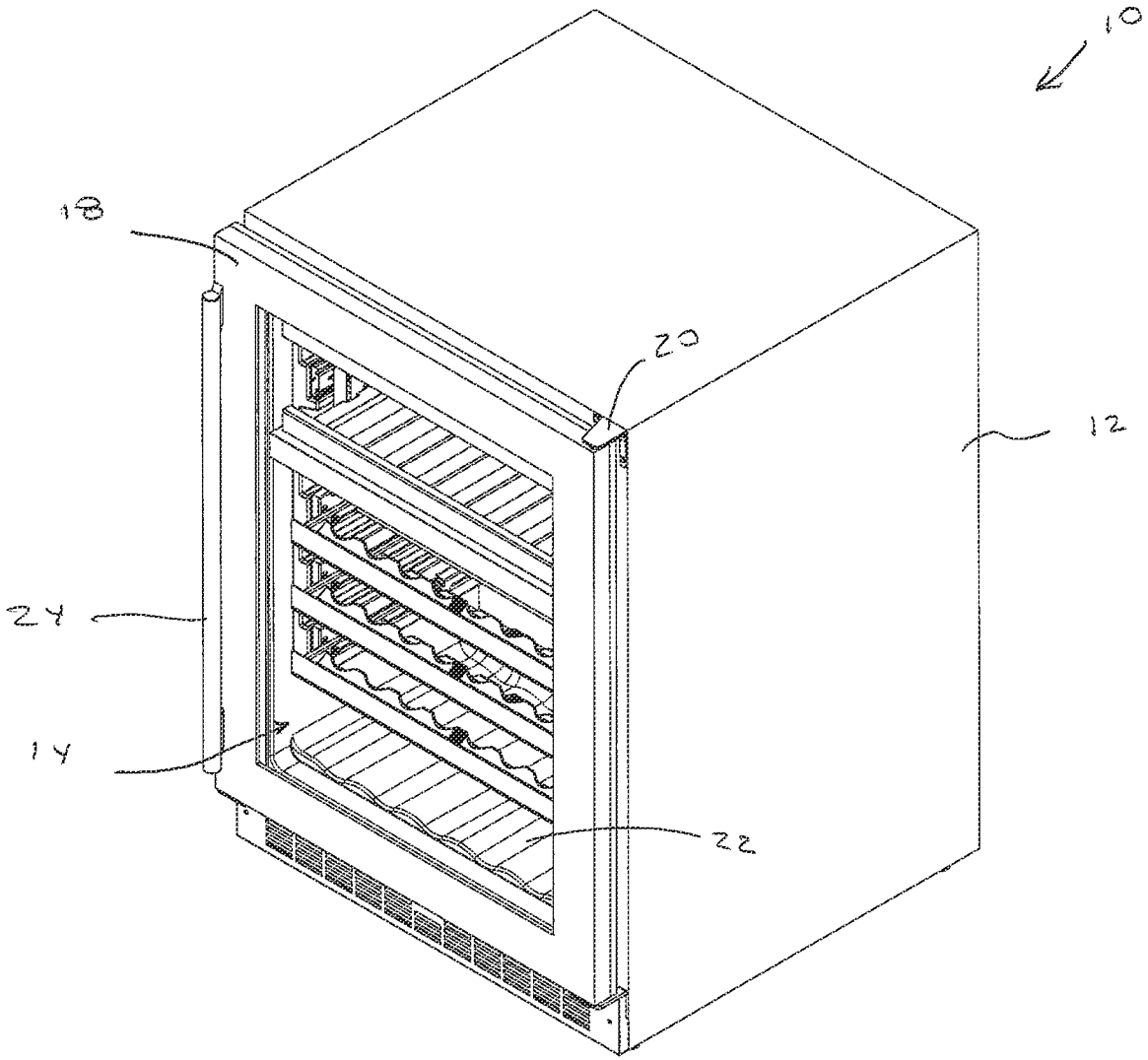
FIG. 1 is a perspective view of an exemplary beverage cooler apparatus shown with the door in the door closed position.

Referring now to the drawings and particularly to FIG. 1 there is shown therein an exemplary arrangement of a beverage cooler apparatus generally indicated 10. The exemplary beverage cooler apparatus is configured for holding beverage containers therein at a set desired temperature. The exemplary cooler includes an enclosure 12. The enclosure 12 bounds an insulated interior area 14. The enclosure includes an opening 16 that enables accessing the interior area 14 from outside the enclosure.

Figure 2:
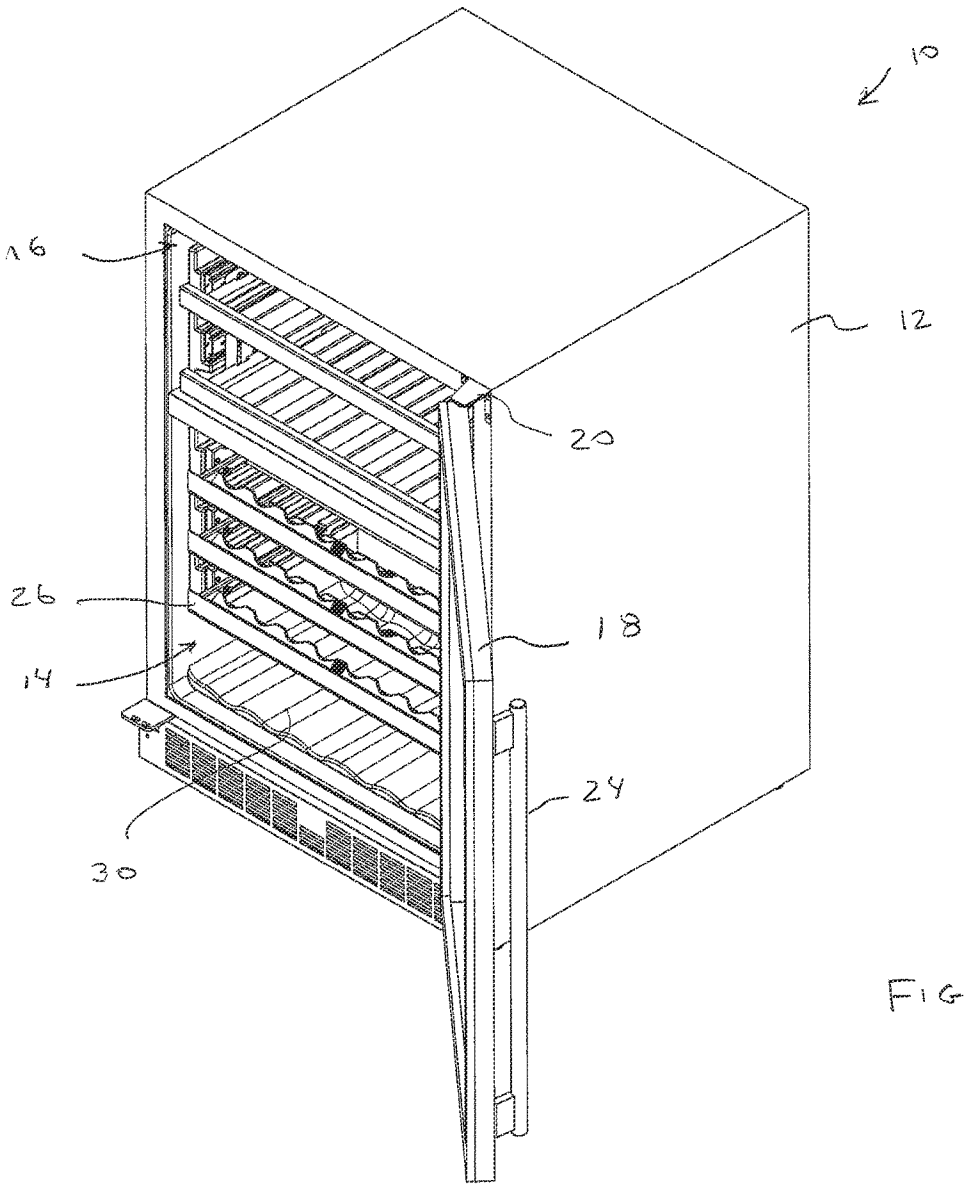
FIG. 2 is a perspective view of the beverage cooler apparatus of FIG. 1 with the door in a door open position.

A door 18 is movably mounted in operative connection with the enclosure through a pair of vertically disposed hinges 20. The exemplary door includes a transparent panel 22 which enables viewing the interior area 14 through the door. The door 18 further includes an external handle 24. The door is movable relative to the enclosure between positions including a door closed position as shown in FIG. 1. In the door closed position the door prevents access to the interior area from outside the enclosure. The door is movable from the door closed position to the door open position as shown in FIG. 2. In the door open position the interior area 14 is accessible from outside of the enclosure. Of course it should be understood that this configuration for the cooler is exemplary and other types of configurations may be utilized.

The exemplary cooler further includes components that facilitate maintaining the interior area at a set desired temperature. In exemplary arrangements this includes a refrigerant compressor, evaporator and condenser that provide for heat transfer from the interior area 14 to outside the interior area through use of a suitable refrigerant material. Exemplary arrangements further include circuitry that is configured to control the refrigeration components, including a temperature sensor and a thermostat which are operative to maintain the interior area at a desired temperature. Further exemplary arrangements may include lights or other components within the interior area. It should be understood that these cooler components are exemplary and other arrangements may include different or other components.

Figure 3:
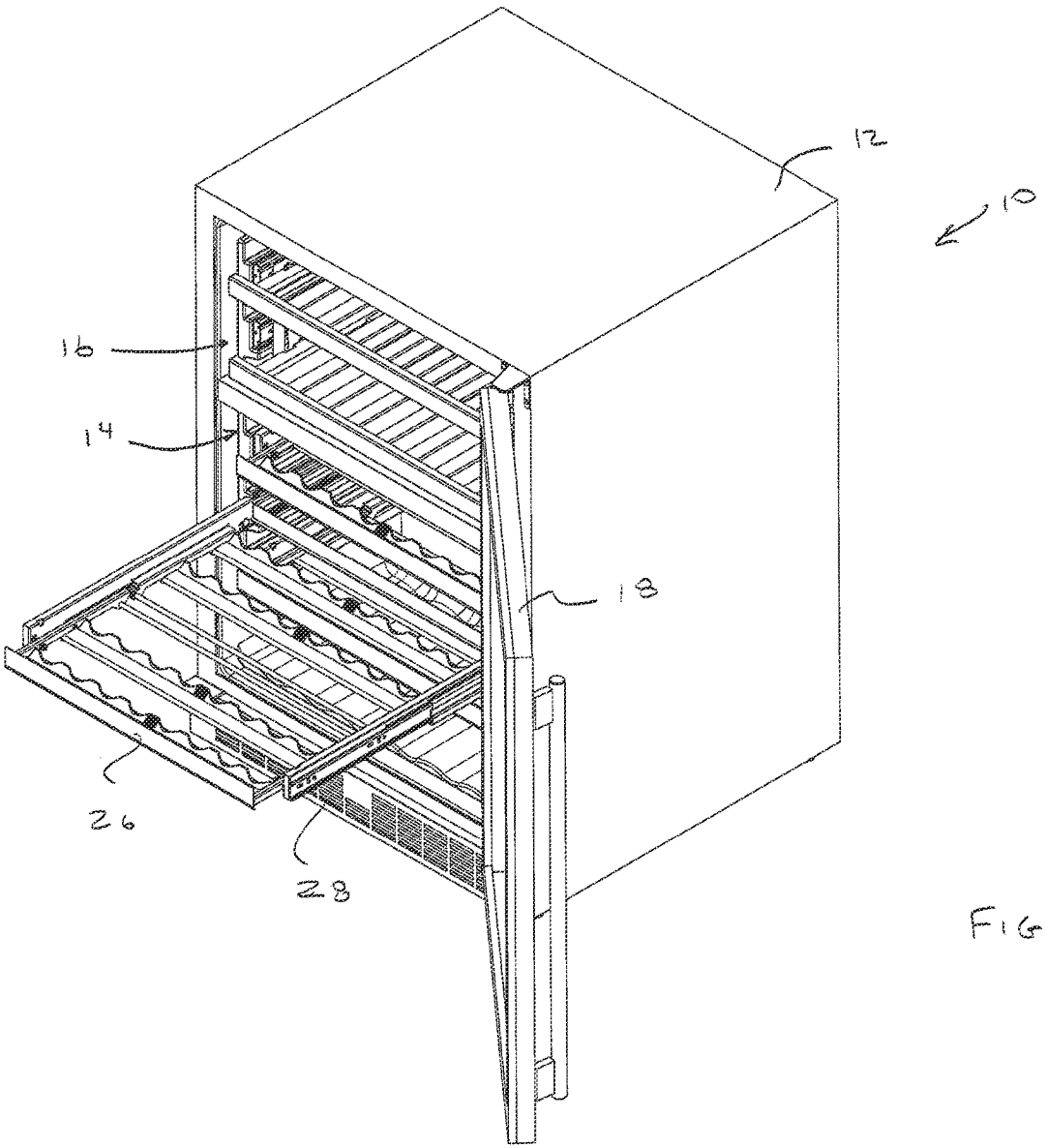
FIG. 3 is a view similar to FIG. 2 but with a shelf shown extending outward from the interior area of the cooler.

In the exemplary arrangement the cooler includes a plurality of vertically spaced, parallel horizontally extending shelves 26. In exemplary arrangements the vertically spaced shelves include at least one configurable shelf that is movable between multiple positions and configurations in a manner like that later discussed. Each of the plurality of configurable shelves of the exemplary arrangement is supported on a pair of horizontally opposed slides 28. In exemplary arrangements with the door in the door open position the configurable shelves are movably extendable outwardly from the interior area 14 through the opening 16. In the exemplary arrangement shown each of the configurable shelves is movable in supported connection with the slides 28 such that when the slides are in a slide retracted position as shown in FIG. 2 the shelves are disposed fully within the interior area. In the slide extended position such as is shown in FIG. 3, the exemplary slide and shelf extend outwardly from the enclosure. Of course it should be understood that this configuration is exemplary and in other arrangements other configurations and approaches may be used.

The exemplary cooler configuration also includes at least one fixed shelf 30. In the exemplary arrangement the fixed shelf 30 is not extendable outward through the opening 16 in supported connection with retractable slides. Of course it should be understood that this configuration having both movable shelves and fixed shelves is exemplary and in other arrangements other approaches may be used.

Figure 7:
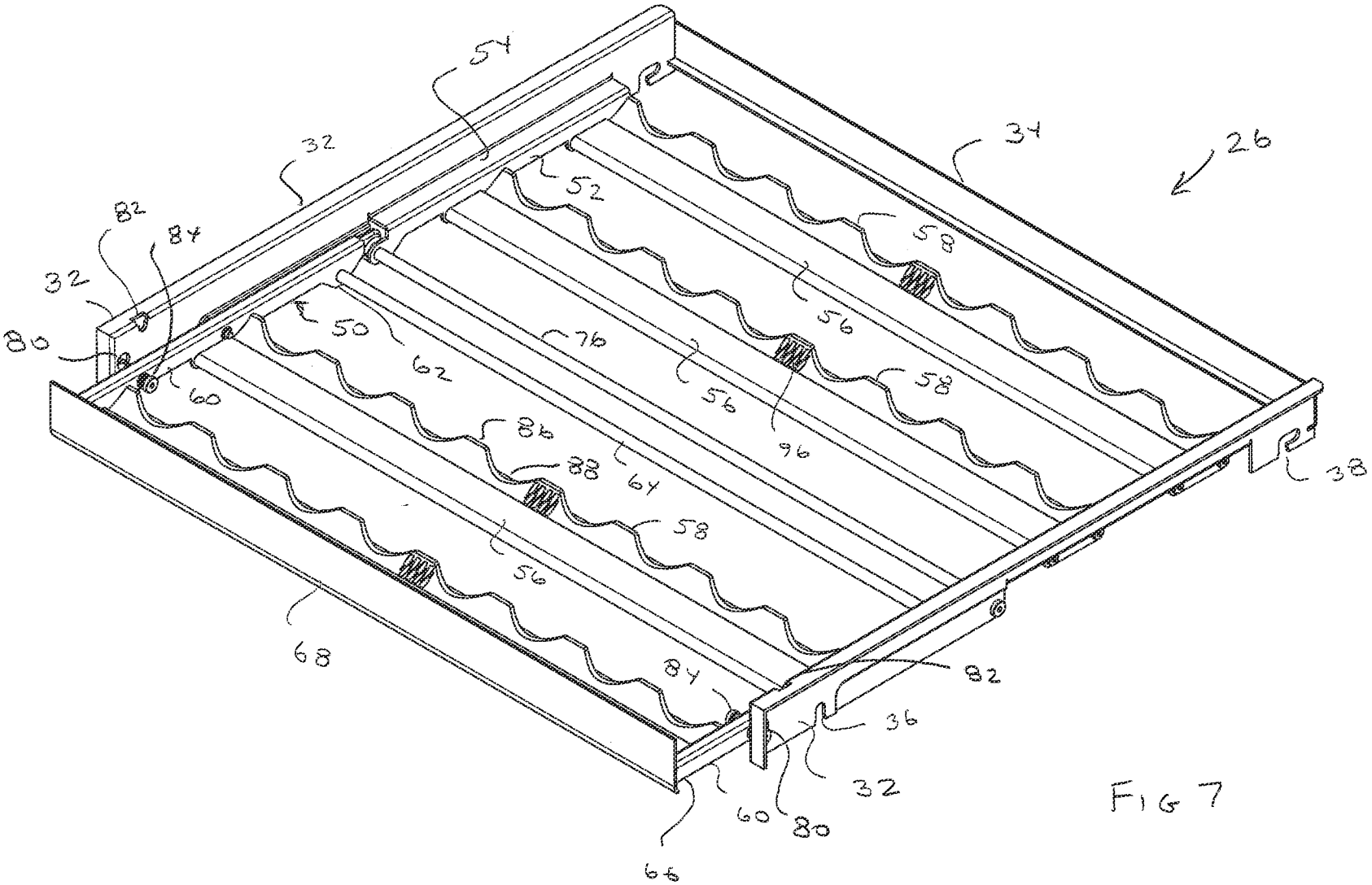
FIG. 7 is a front top right perspective view of an exemplary configurable shelf shown with the front portion in a flat shelf position.
Figure 8:
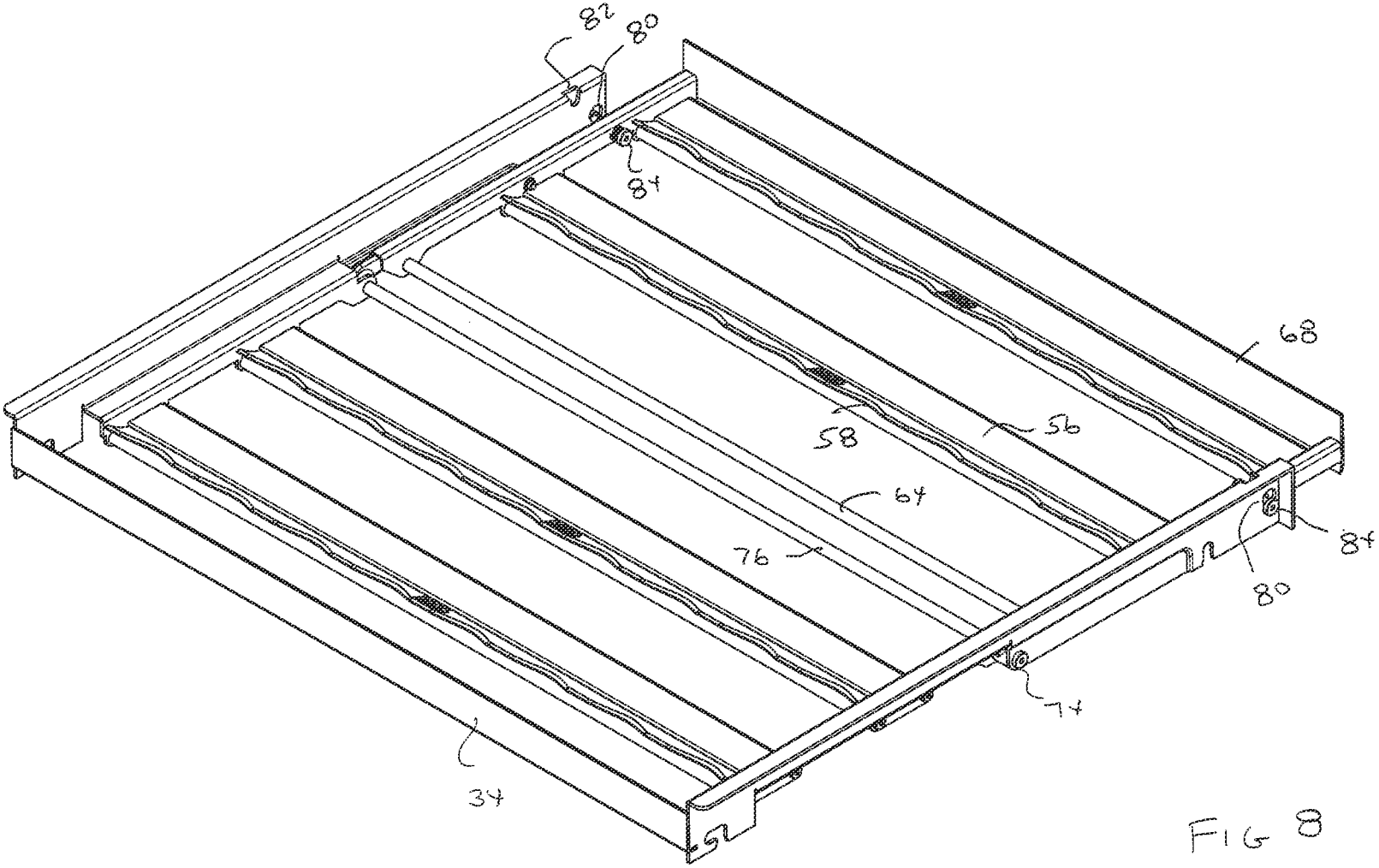
FIG. 8 is a top back left perspective view of the shelf as shown in FIG. 7.
Figure 9:
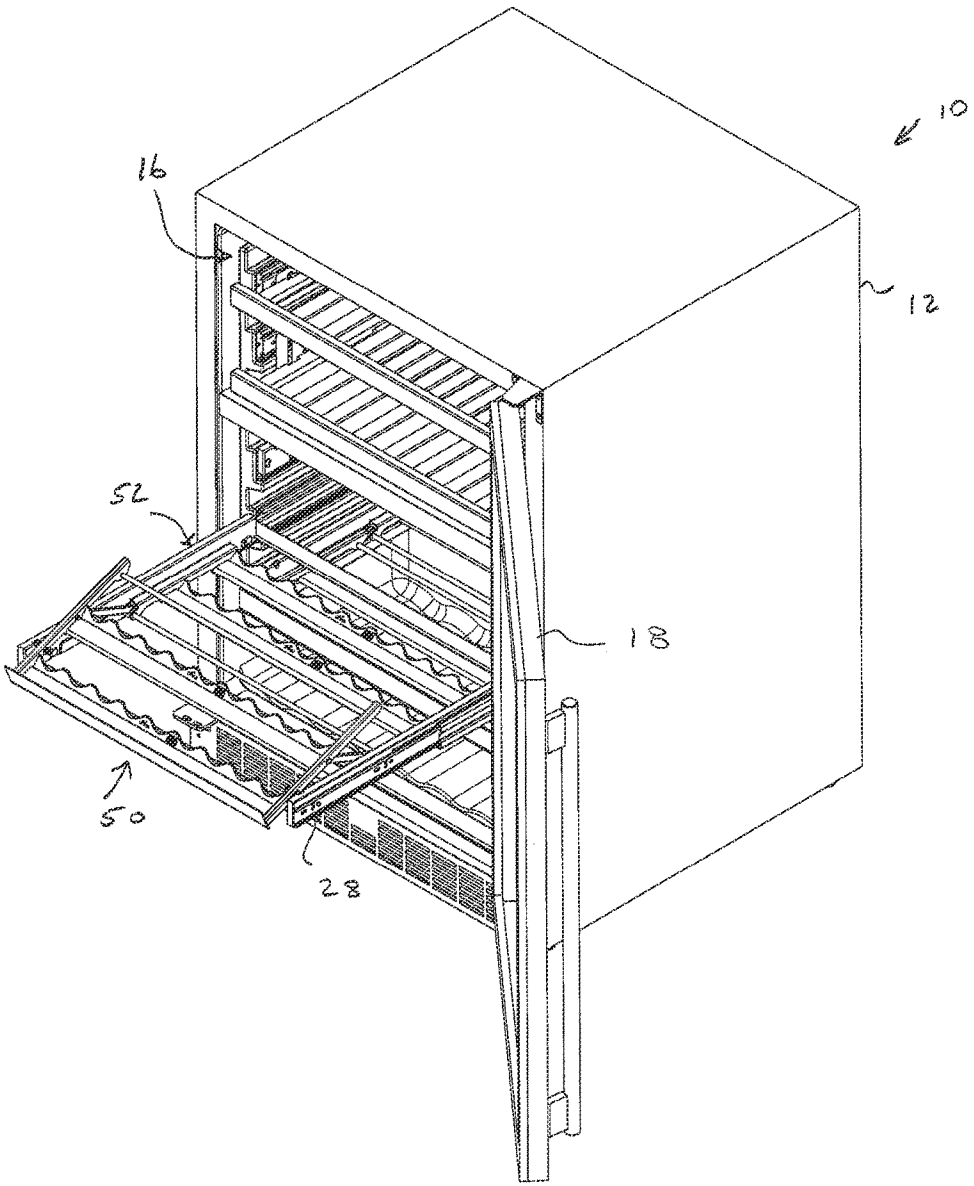
FIG. 9 is a top front right perspective view of the exemplary cooler shown with the configurable shelf extended and having the front portion thereof in a tilted position.

As shown in FIGS. 7 and 8 each configurable shelf 26 of the exemplary arrangement in the operative position includes a pair of horizontally disposed side walls 32. A back shelf wall 34 in the operative position extends horizontally between the side walls 32 and is in operatively fixed connection therewith. In the exemplary arrangement each side wall includes slots therein that enable releasable engagement with a respective side wall. As a result a shelf can be held in fixed engagement with an adjacent slide. For example in the exemplary arrangement each side wall includes a front slot 36 and a back slot 38. In the exemplary arrangement and in an operative position of the shelf, the front slot 36 extends vertically from a lower edge of the side wall. In the exemplary arrangement the back slot 38 extends vertically from an edge of the side wall and then horizontally from the vertically extending back slot portion.

Figure 4:
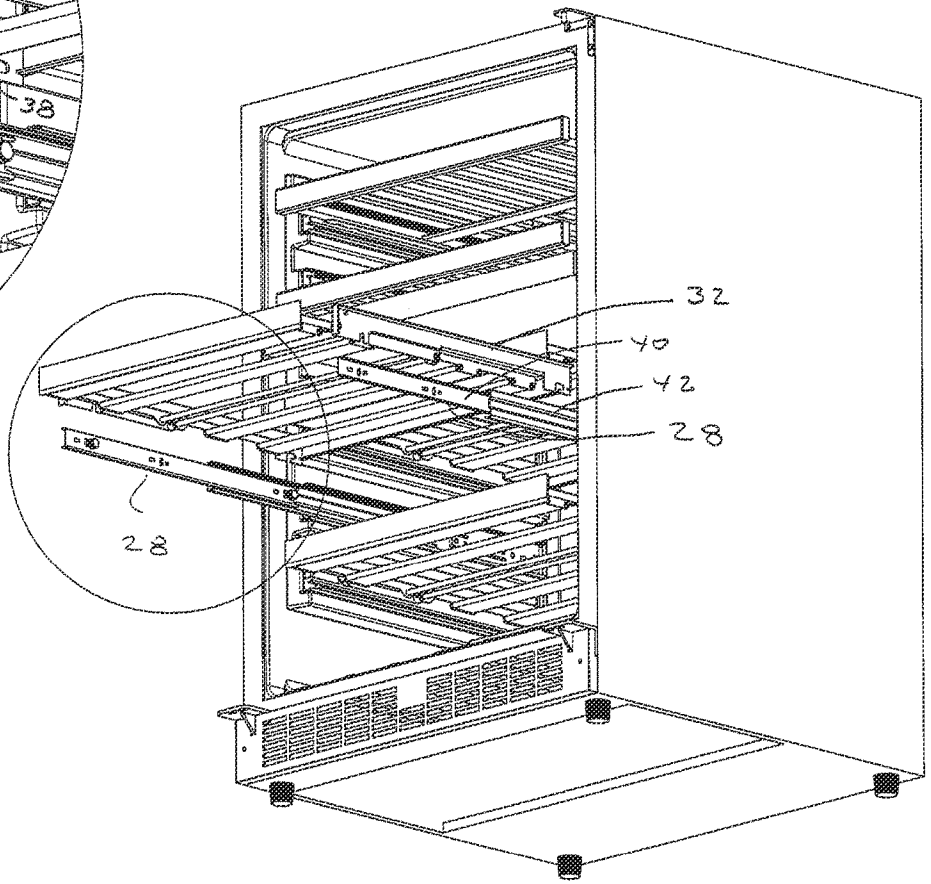
FIG. 4 is a bottom front right perspective exploded view of the cooler shown in FIG. 3 showing the exemplary shelf and extendable slides.
Figure 5:
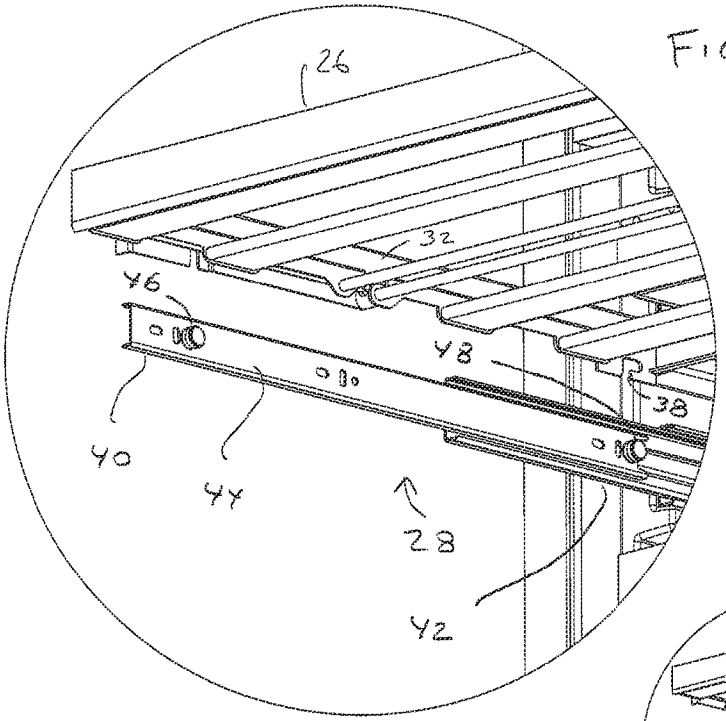
FIG. 5 is an enlarged view of a slide and an exemplary configurable shelf.

As shown in FIGS. 4 and 5, each of the slides 28 includes a front slide portion 40 that is movably extendable outward from a back slide portion 42. In the exemplary arrangement an inward facing surface 44 of each slide includes a pair of disposed releasable fasteners. The exemplary fasteners include a forward slide fastener 46 and a back slide fastener 48. As can be appreciated from FIGS. 4 and 5, in the exemplary arrangement the fasteners extend in threaded engagement through openings in the front slide portion 40. The exemplary fasteners each include a threaded cylindrical stud portion and an enlarged head.

To engage an immediately adjacent side wall of a shelf 26 with a slide, the back slide fastener 48 and the forward slide fastener 46 are loosened. With the back slide fastener 38 loosened the cylindrical stud portion of the fastener is enabled to extend in the vertical portion of the back slot 38 of the side wall 32. When the cylindrical stud portion of the fastener reaches the furthest extent of vertical travel in the slot 38, the exemplary shelf is then moved forwardly relative to the front slide portion so that the cylindrical stud portion of the fastener extends in the horizontally extending portion of the slot 38. With the cylindrical stud portion of the fastener 38 engaged at the furthest horizontal position of the back slot 38 away from the vertically extending portion of the slot, the cylindrical stud portion of the forward slide fastener is enabled to be engaged in the front slot 36. The forward slide fastener and back slide fastener are then tightened to hold the immediately adjacent side wall 32 in engagement with the front slide portion 40. Due to the configuration of the exemplary arrangement a user is enabled to engage a configurable shelf with each of a pair of horizontally disposed slides 28. As can be appreciated this exemplary mounting arrangement enables readily engaging and disengaging the exemplary shelves 26 from the slides 28. Of course it should be understood that this arrangement is exemplary and in other arrangements other approaches may be used.

An exemplary configurable shelf 26 is shown in greater detail in FIGS. 6 through 15. In the exemplary arrangement the configurable shelf includes a front portion 50 and a back portion 52. In the exemplary arrangement the front portion 50 is rotationally movably positionable relative to the back portion between the side walls 32. The exemplary back portion 52 is in operatively fixed connection with each of the side walls 32. The exemplary back portion includes an inward projection piece 54. Each inward projection piece is generally L-shaped in transverse cross-section and bounds an elongated cross-sectional recess on a lower side of the shelf. As later discussed the elongated cross-sectional recess is configured for accepting portions of a link which is connected to the front portion therein. In exemplary arrangements shelf support plates 56 extend horizontally between the side walls and the inward projection pieces 54. As later discussed each of the exemplary shelf support plates include horizontally elongated slots which are configured to releasably receive inserts 58 therein.

The exemplary front portion 50 includes a pair of horizontally disposed front side links 60. In the exemplary arrangement each front side link in transverse cross section includes an internal elongated cross-sectional recess therein. The elongated recess in each front side link 60 is configured to receive a portion of a back side link therein as later discussed. The exemplary front side links are rotationally movable intermediate of the side walls 32 into various positions as later discussed. Each of the exemplary front side links include a back front side link end 62. A front rod 64 extends horizontally between the respective back front side link ends 62.

In the exemplary arrangement each front side link includes a forward front side link end 66. The front side links are connected by a front wall 68 at the forward front side link ends. A pair of shelf support plates 56 extend horizontally between the front side links 60. The exemplary shelf support plates 56 include elongated slots for releasably receiving inserts 58 in a manner like that later discussed.

Figure 10:
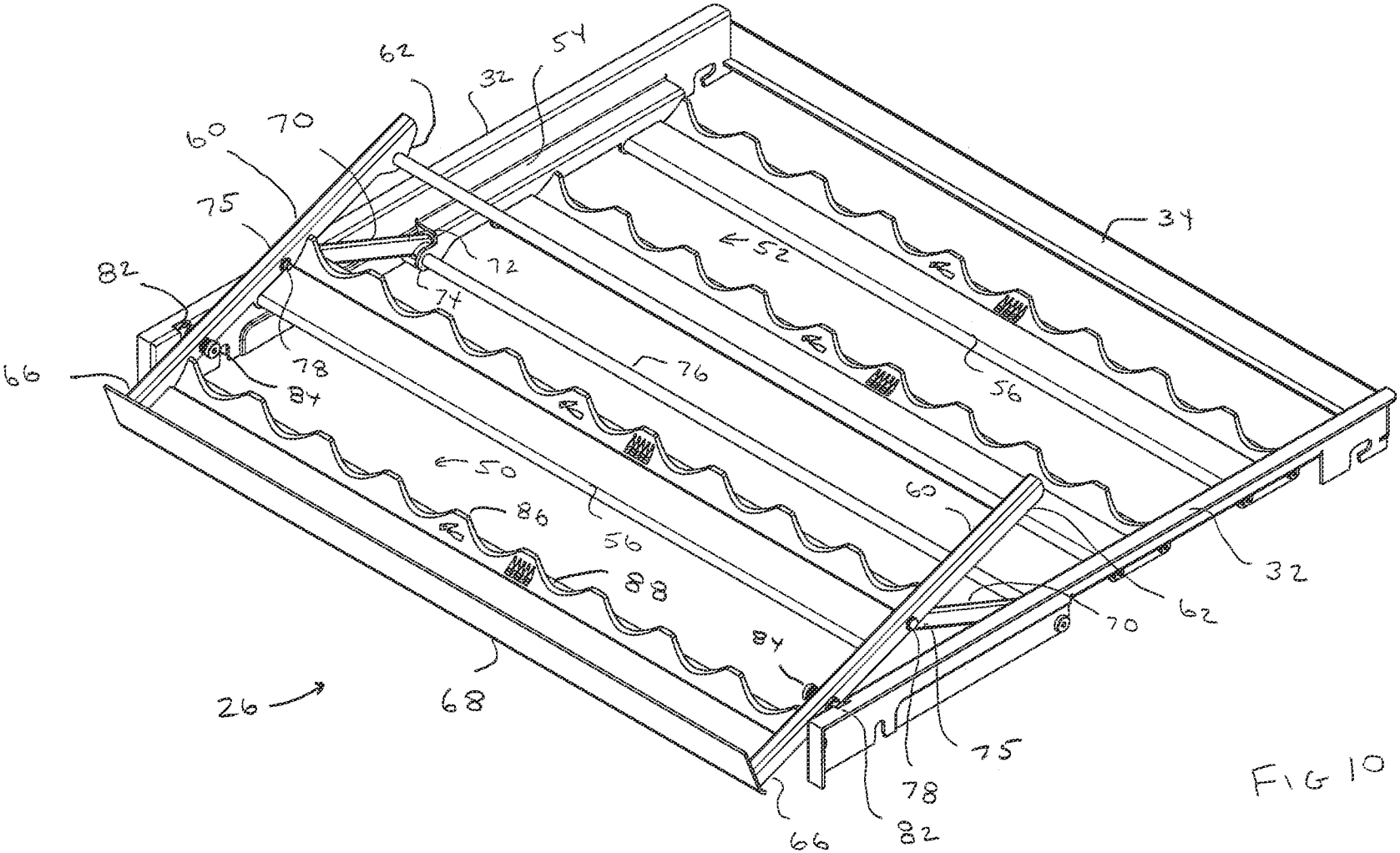
FIG. 10 is a top front right perspective view of a configurable shelf with the front portion in a tilted position.
Figure 11:
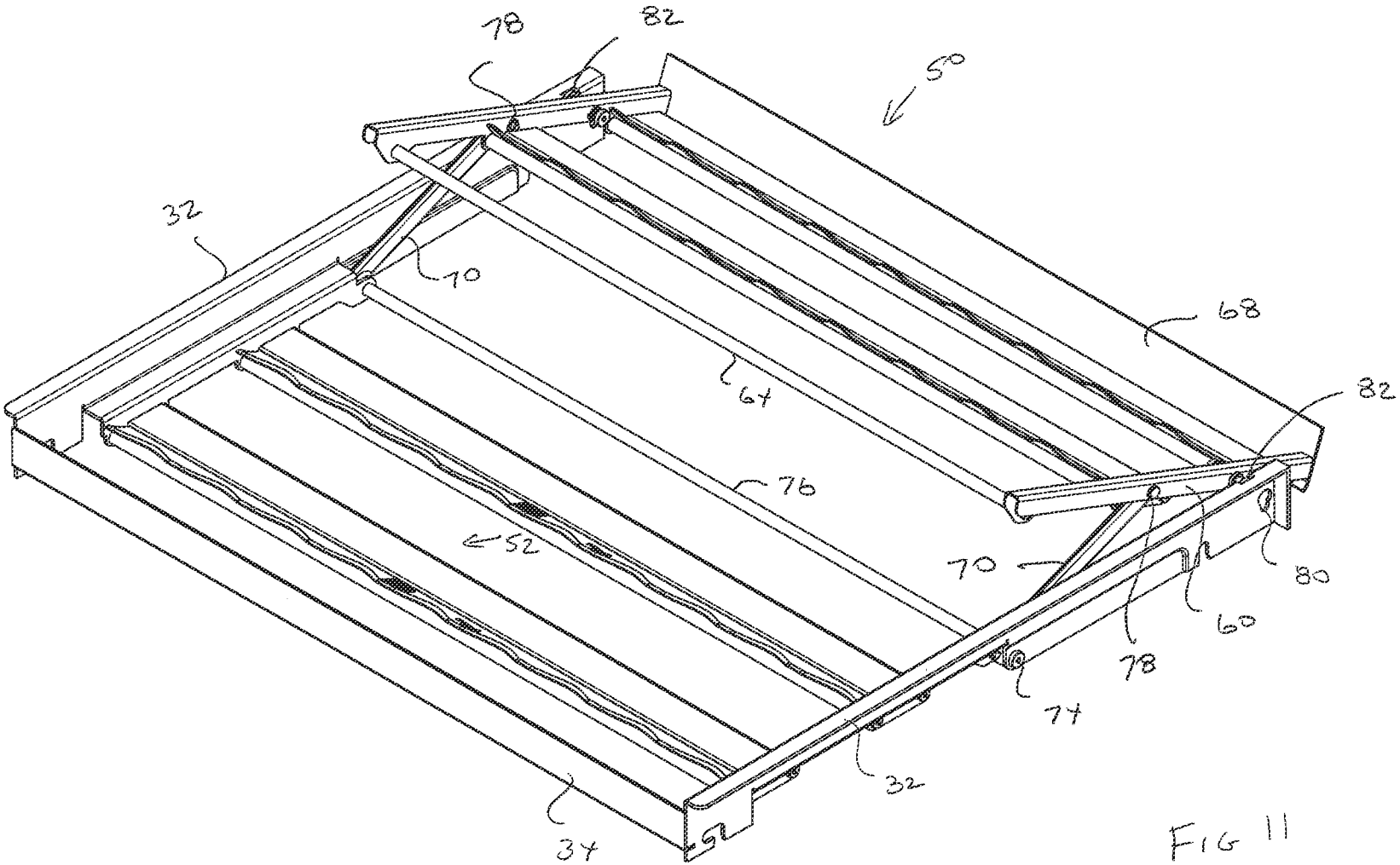
FIG. 11 is a back front left perspective view of the shelf shown in FIG. 10 with the front portion in a tilted position.

As is better shown in the tilted position of the shelf front portion in FIGS. 10 and 11, a pair of horizontally disposed back side links 70 are rotationally movably mounted in operative connection with the side walls 32. Each back side link 70 includes a first back side link end 72 and a second back side link end 75. The first back side link end 72 is rotationally movably mounted in operative connection with the respective side wall about a rear pivot 74. In the exemplary arrangement a portion of the first back side link end 72 extends in the elongated cross sectional recess of inward projection piece 54. A back rod 76 extends between the inward projection pieces 54 along the axis of the rear pivot 54. In exemplary arrangements the back rod 76 may serve as the support of the rear pivot 74 about which the back side links 70 rotate. Of course this approach is exemplary and in other arrangements other approaches may be used.

In the exemplary arrangement the second back side link end 72 is pivotally engaged with the front side link 60. The second back side link end 75 is engaged with the front side link at a front side link pivot 78. In exemplary arrangements the second back side link end extends in the elongated cross-sectional recess of the front side link and pivots therein. The exemplary front side link pivot is positioned in generally centered intermediate relation between the forward front side link end 66 and the back front side link end 62. As can be appreciated this exemplary configuration enables the respective front side links to be vertically and rotationally movable along the direction that is parallel to the immediately adjacent side wall 32. Of course it should be understood that this configuration is exemplary, and in other arrangements other approaches may be used.

In the exemplary arrangement each side wall 32 includes a first aperture 80. In the exemplary arrangement each of the first apertures 80 are horizontally aligned. Each exemplary side wall 32 further includes a second aperture 82. In the exemplary arrangement each of the second apertures are also horizontally aligned. In the exemplary arrangement the first apertures 80 are positioned on a respective side wall 32 forward of and below the second apertures 82.

Each exemplary front side link 60 includes a respective horizontally outward extending projection 84. The exemplary outward extending projections are disposed outwardly away from the front side link pivot 78 and toward the respective forward front side link end of the respective front side link 60. In the exemplary arrangement the outward extending projections 84 each comprise a releasable fastener that extends through a respective aperture in the front side link. Of course it should be understood that this configuration of the projections 84 is exemplary. In other arrangements the horizontally extending projections may include pins, studs or other structures that may be permanently part of the respective front side link or releasably engageable with the respective front side link as is the case in the exemplary arrangement.

In the exemplary arrangement the first aperture 80 has a keyhole configuration with an enlarged central portion and a more narrow downward extending slot portion. In exemplary arrangements the horizontally extending projection is attached to a cylindrical stud portion which terminates outwardly in an enlarged head. In the exemplary configuration the head and stud portion are configured to pass through the enlarged circular portion of the aperture, while the stud portion is configured to pass through the smaller vertically extending portion of the aperture 80. The exemplary horizontally extending projection includes a fastener that enables releasably engaging the front side link and the side wall 32 in fixed engagement when the stud portion extends in the vertically extending portion of the aperture 80. In the exemplary arrangement the second aperture 82 includes a slot in an upper face of the respective side wall 32 as shown. The second aperture includes an enlarged portion that enables the head to pass therethrough and a vertically extending slot portion that can be similarly engaged with the stud portion of the projection therein. In the exemplary arrangement this enables the horizontally extending projection to be selectively held in releasably fixed engagement with the second aperture 82.

Figure 17:
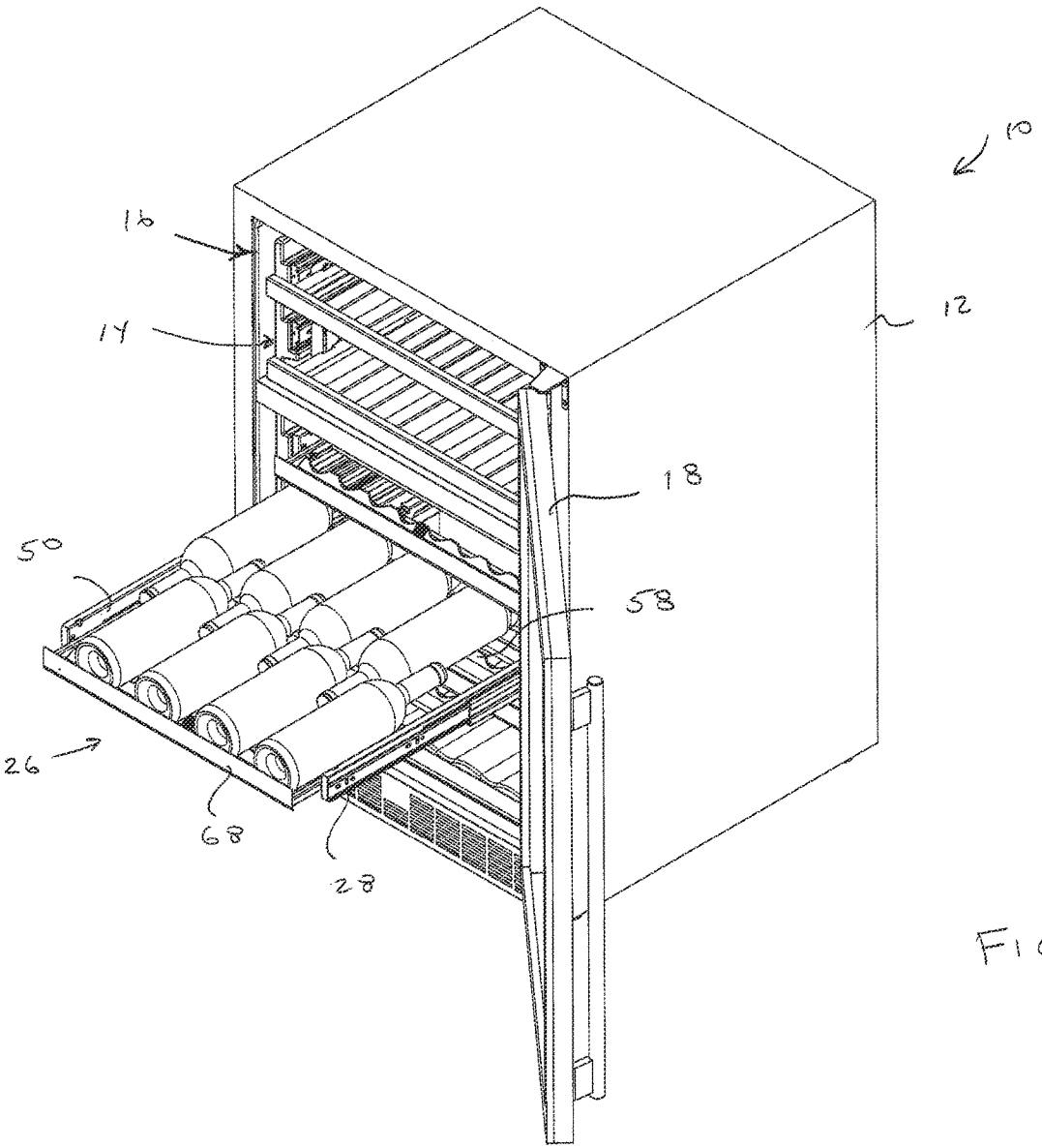
FIG. 17 is a front top right perspective view of the exemplary cooler shown with a configurable shelf with the front portion in a flat shelf position and extended outward from the opening of the enclosure.

As a result in the exemplary arrangement the horizontally extending projections may be extended through the first apertures 80 and the side walls 32 and selectively held in fixed engagement therewith. In this arrangement the front portion 50 is in fixed co-planar relation with the back portion such that the front portion is in the flat shelf position as represented in FIGS. 7 and 8. As shown in FIG. 17 for example, with the front portion in the flat shelf position containers may be positioned in operative supported connection with the exemplary configurable shelf in a manner like that shown in FIG. 17.

Figure 18:
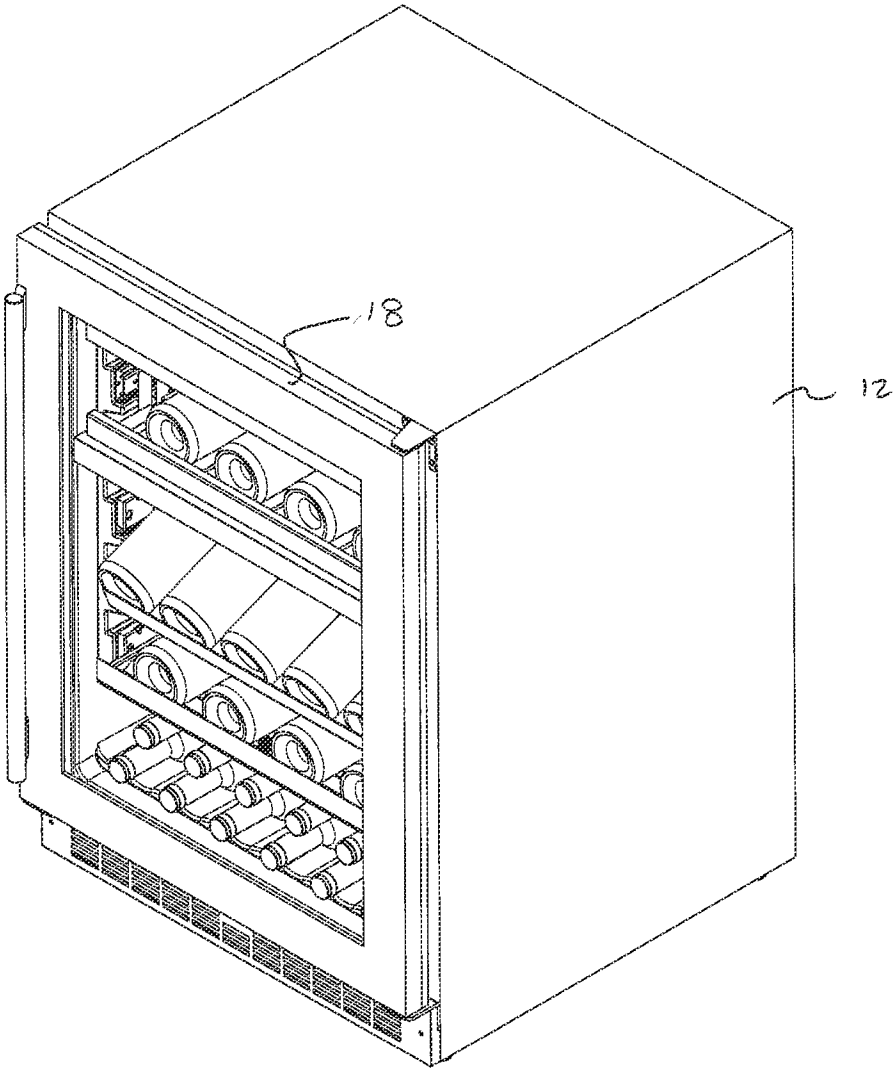
FIG. 18 is a further front top right perspective view of the exemplary cooler shown with a different shelf configuration including a configurable shelf with the front portion in the tilted position.
Figure 19:
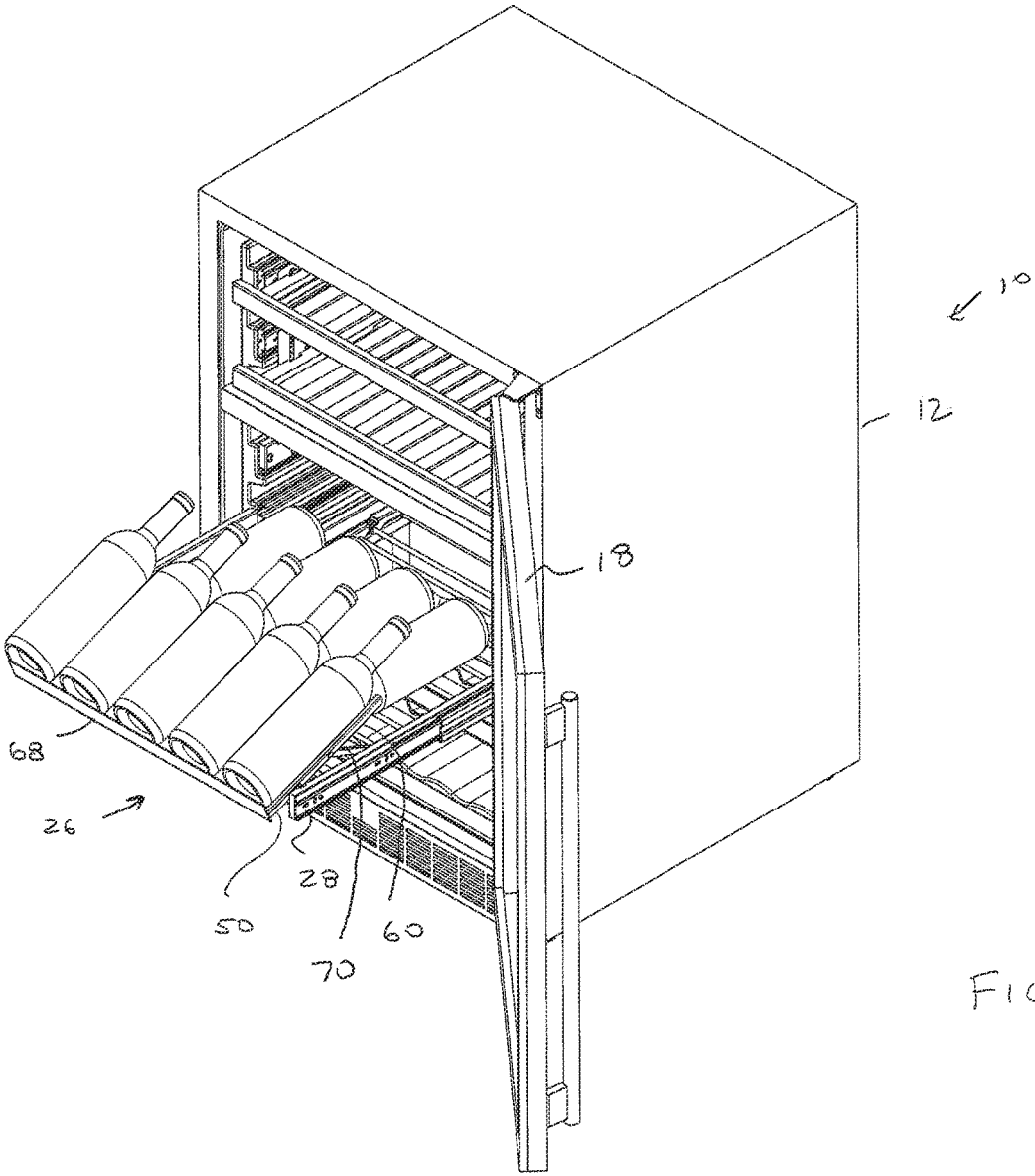
FIG. 19 is a top front right perspective view of the cooler as shown in FIG. 18 but with a configurable shelf with the front portion in the tilted position extended outward from the opening on the pair of slides.
Figure 20:
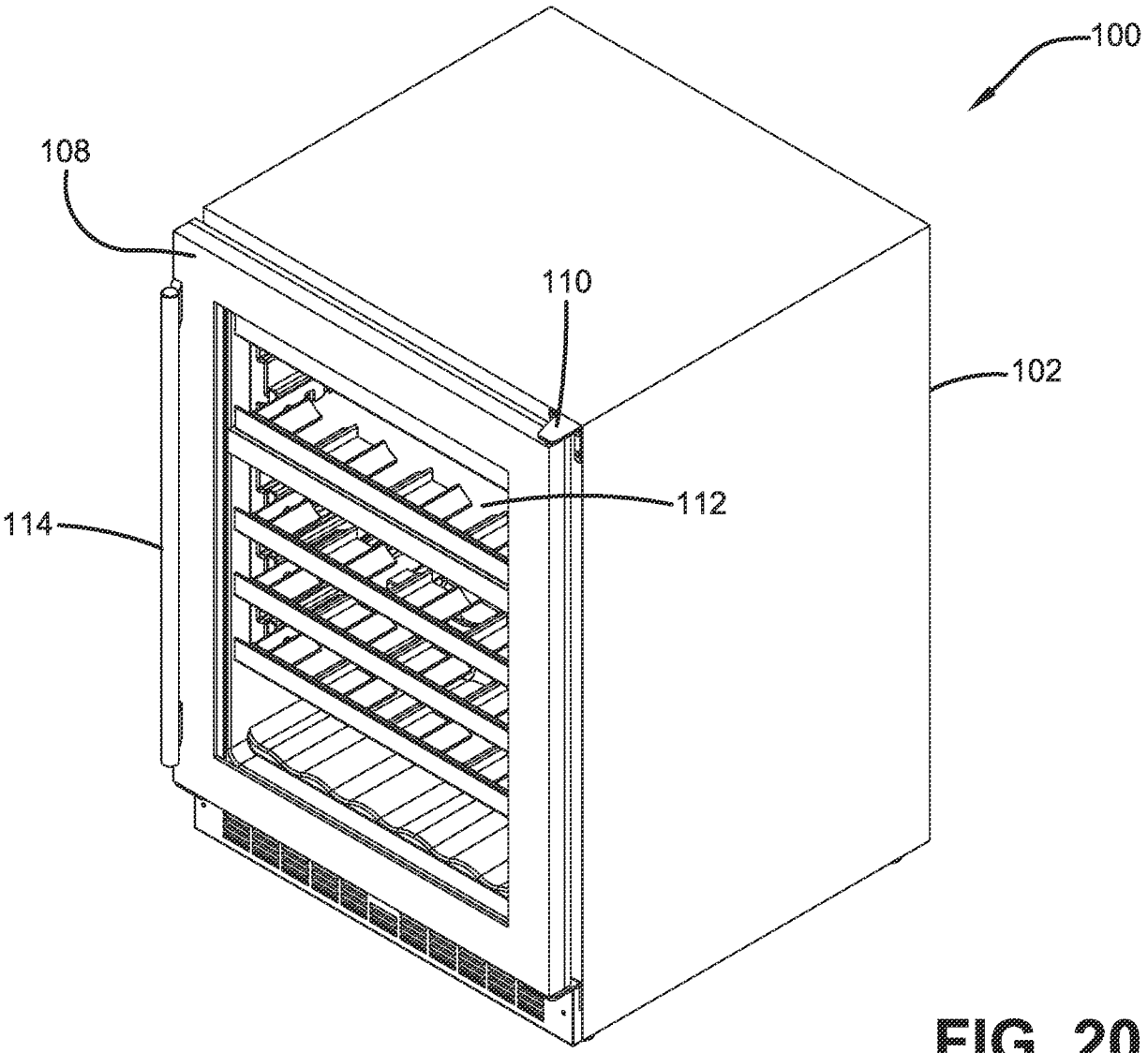
FIG. 20 is a perspective view of an alternative exemplary beverage cooler apparatus shown with the door in the door closed position.
Figure 21:
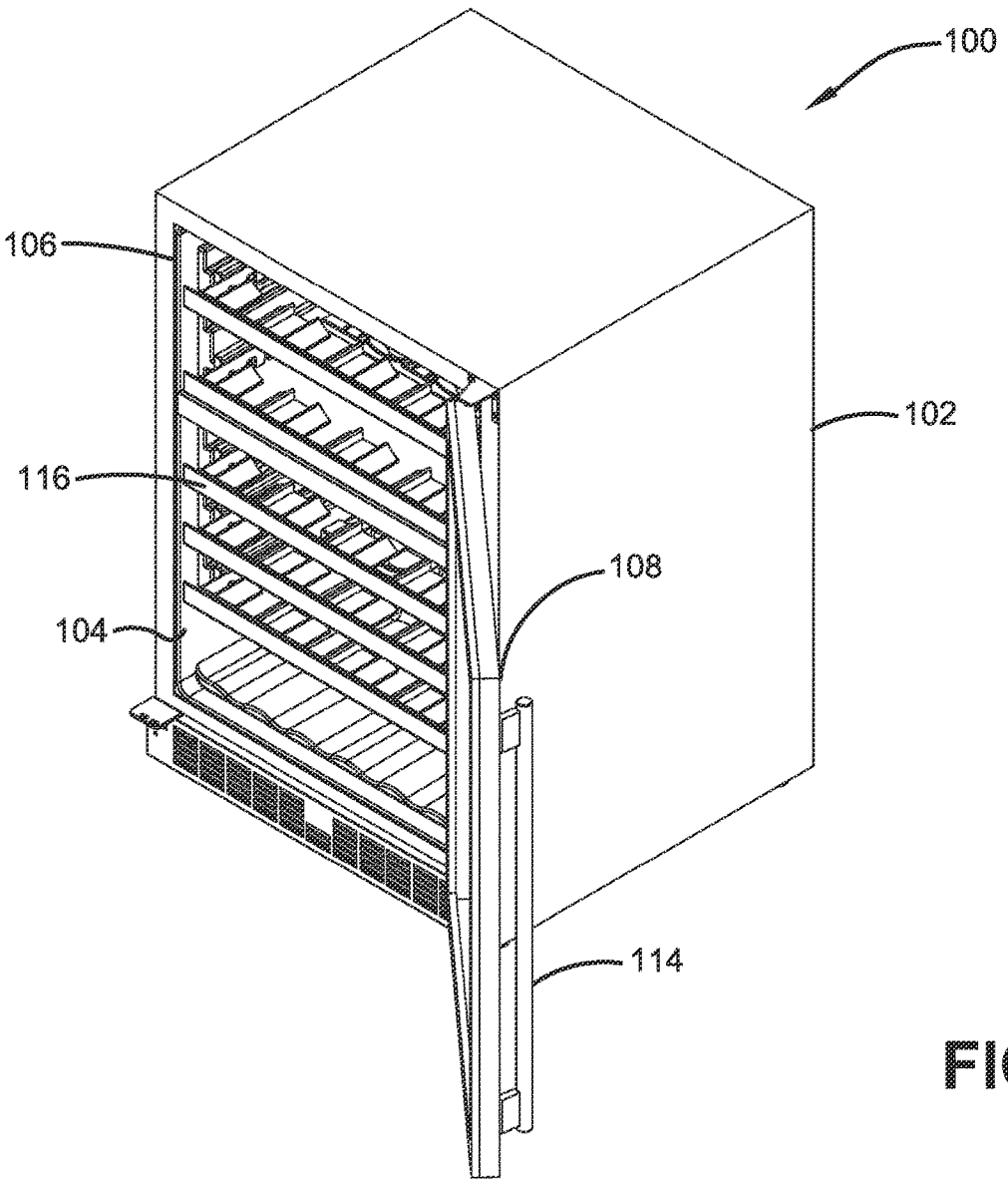
FIG. 21 is a perspective view of the beverage cooler of FIG. 20 shown with the door in a door open position.
Figure 22:
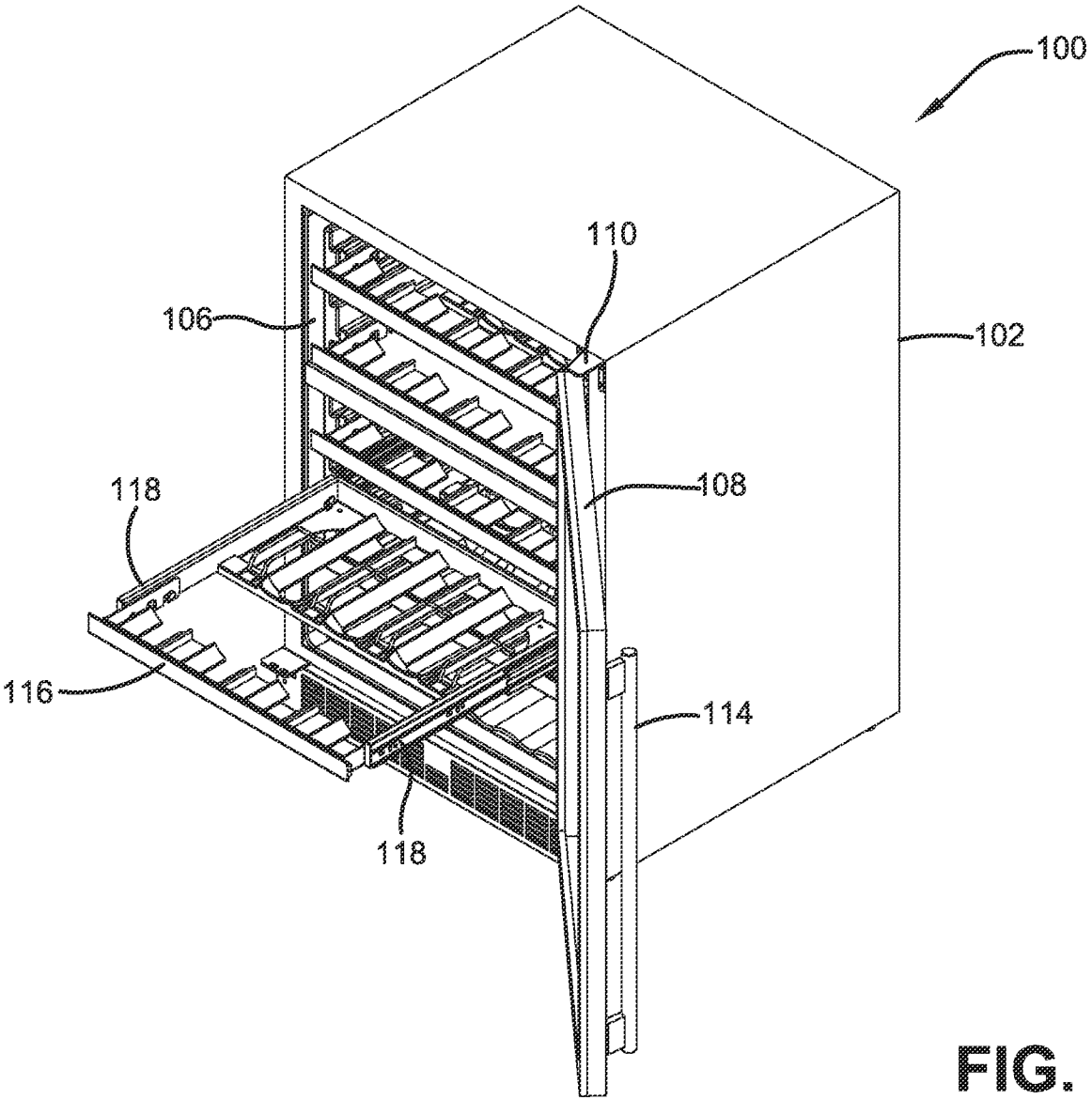
FIG. 22 is a view similar to FIG. 21 but with a shelf shown extending outward from the interior area of the cooler.

When desired the user is enabled to configure the front portion 50 in a tilted position. This is accomplished by disengaging the horizontally extending projections 84 from the first apertures 80 and engaging the horizontally extending projections in fixed engagement with the second apertures 82. As the front portion moves between the flat shelf position and the tilted position the front side links and the back side links move in opposed rotational directions. In this arrangement as shown in FIGS. 10 and 11, in the tilted position the front portion 50 extends at an acute angle relative to the back portion 52. Further in the tilted position of the front portion, the back front side link ends 62 and the front rod 64 which are immediately adjacent to the back portion, extend vertically above the back portion. As shown in FIGS. 18 and 19, in the tilted position of the front portion 50 the shelf 32 is enabled to hold beverage containers engaged with the front portion in a tilted position. In this position bottles of the type shown may be positioned to have the necks thereof extending upward from the base of the bottles which may be engaged with the inside of the front wall 68 and held in spaced apart relation by the projections 86 that extend between the recesses 88 on the horizontal edges of the inserts 58. As shown, in this tilted configuration additional bottles may be positioned in supported relation with the back portion 52 of the respective shelf.

In some exemplary arrangements the enclosure may be configured to include more vertically disposed pairs of slides than shelves. In such arrangements the user may selectively vertically space the shelves away from one another by engaging shelves with the different pairs of slides. Thus for example in some exemplary arrangements when the user chooses to position the front portion of the shelf in the tilted position such as is shown in FIGS. 10 and 11, the shelf immediately above can be positioned sufficiently vertically away from the shelf below so that the top ends of the bottles do not contact or interfere with horizontal movement of the shelf vertically above.

Alternatively in exemplary arrangements the configurable shelf 26 may have a front portion 50 movable to a retracted position in which the front portion vertically overlies or underlies the back portion 52 of the shelf. This is carried out in exemplary arrangements by rotating the back side links 70 about the rear pivots 74 to a retracted position in which the front portion extends in underlying relation of the rear portion 52. However, in other arrangements the front portion may be configured to overlie the back portion in the retracted position.

Figure 12:
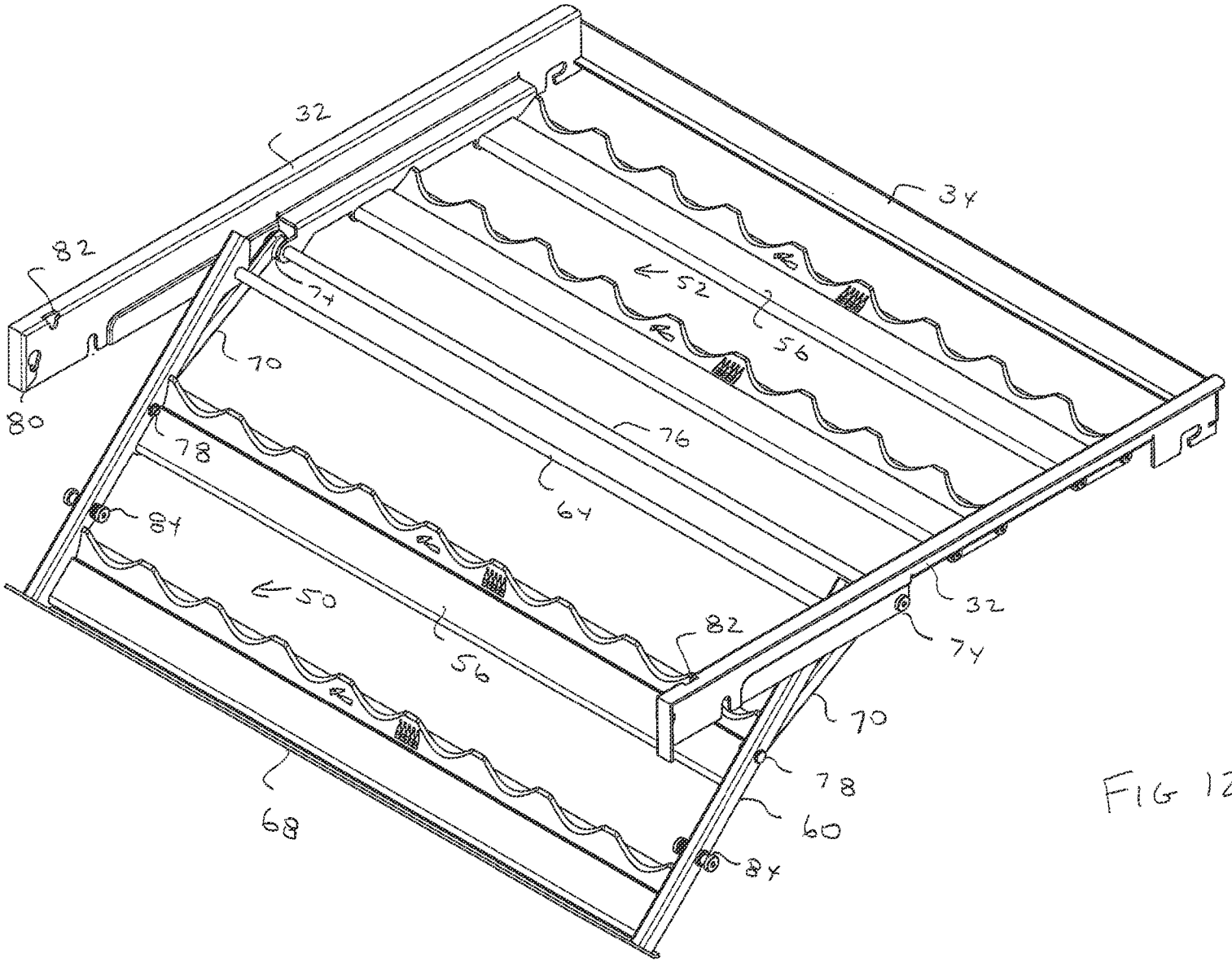
FIG. 12 is a top front right perspective view of the exemplary shelf shown with the front portion being moved toward the retracted position.
Figure 13:
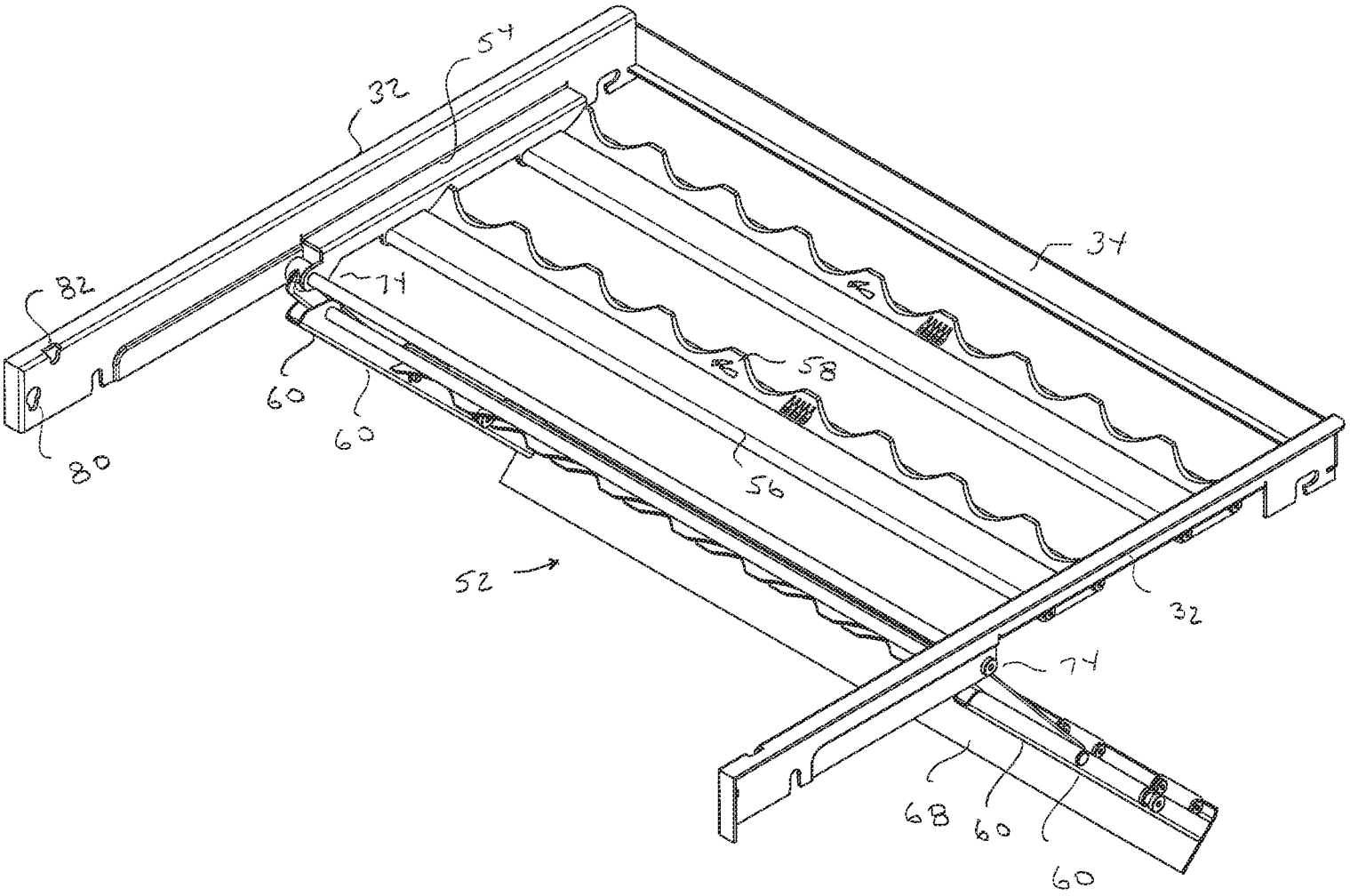
FIG. 13 is a back top left perspective view of the shelf as shown in FIG. 12.
Figure 14:
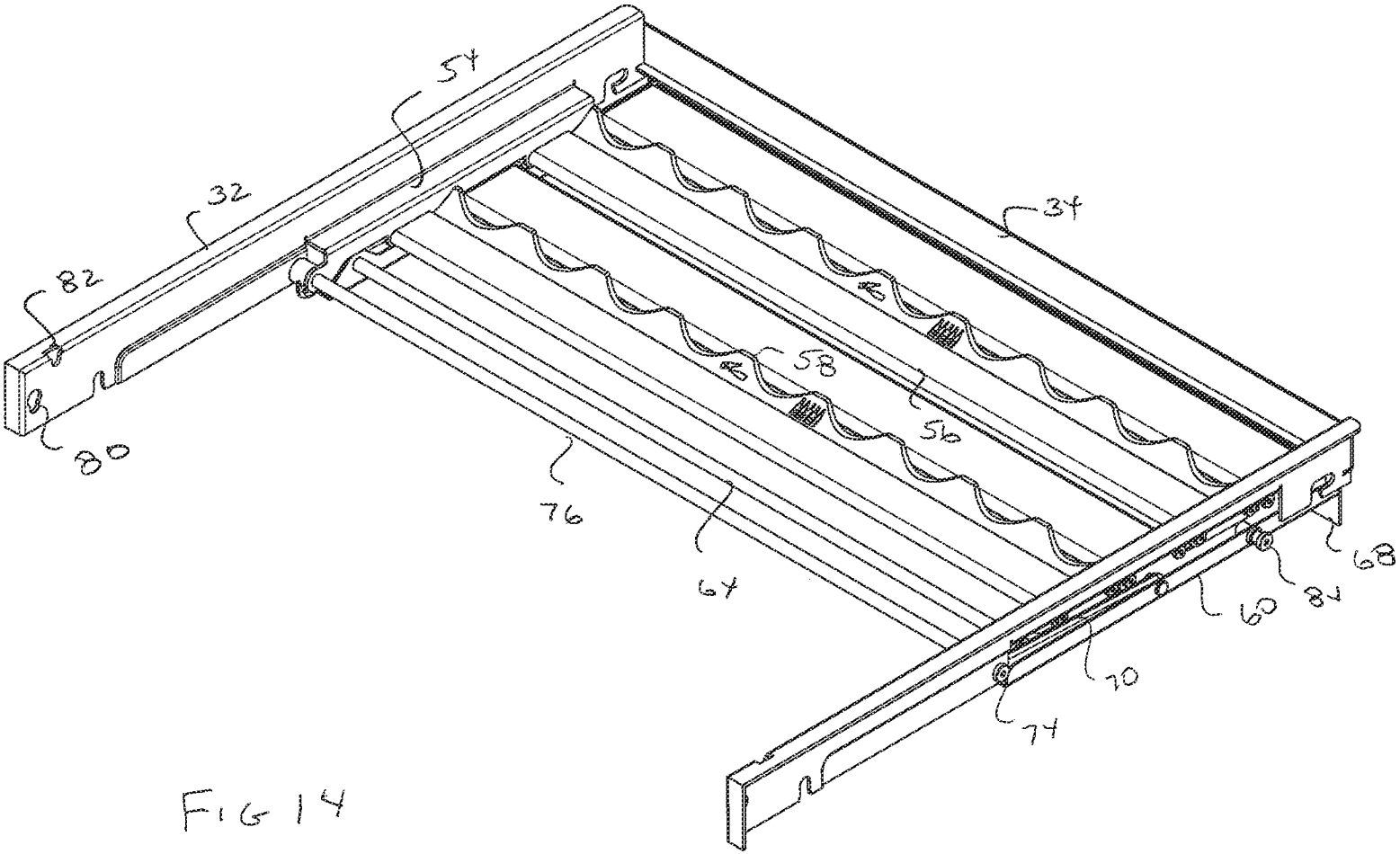
FIG. 14 is a top front right perspective view of the exemplary configurable shelf with the front portion shown in the retracted position.
Figure 15:
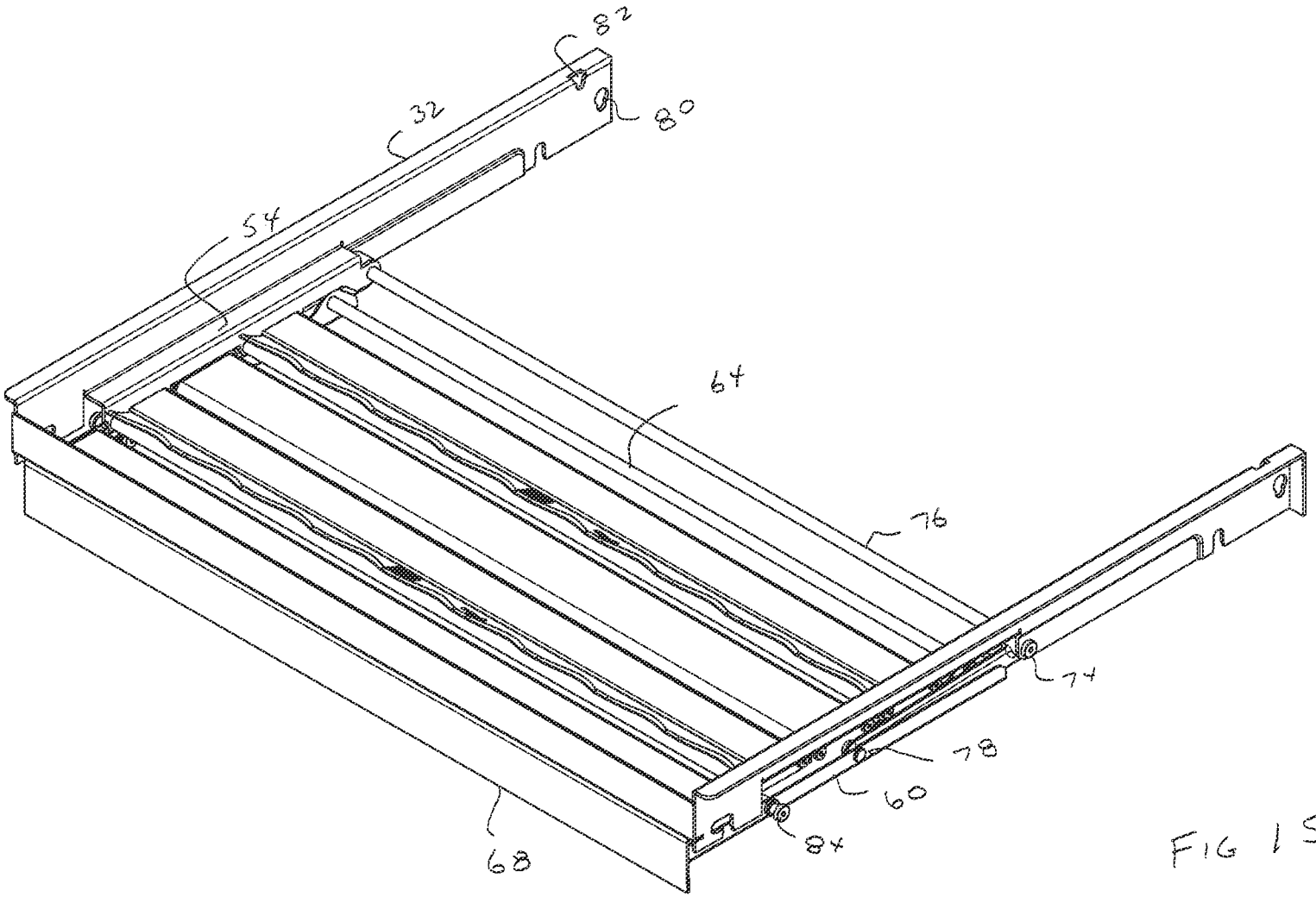
FIG. 15 is a back top left perspective view of the configurable shelf with the front portion in the retracted position as shown in FIG. 14.
Figure 16:
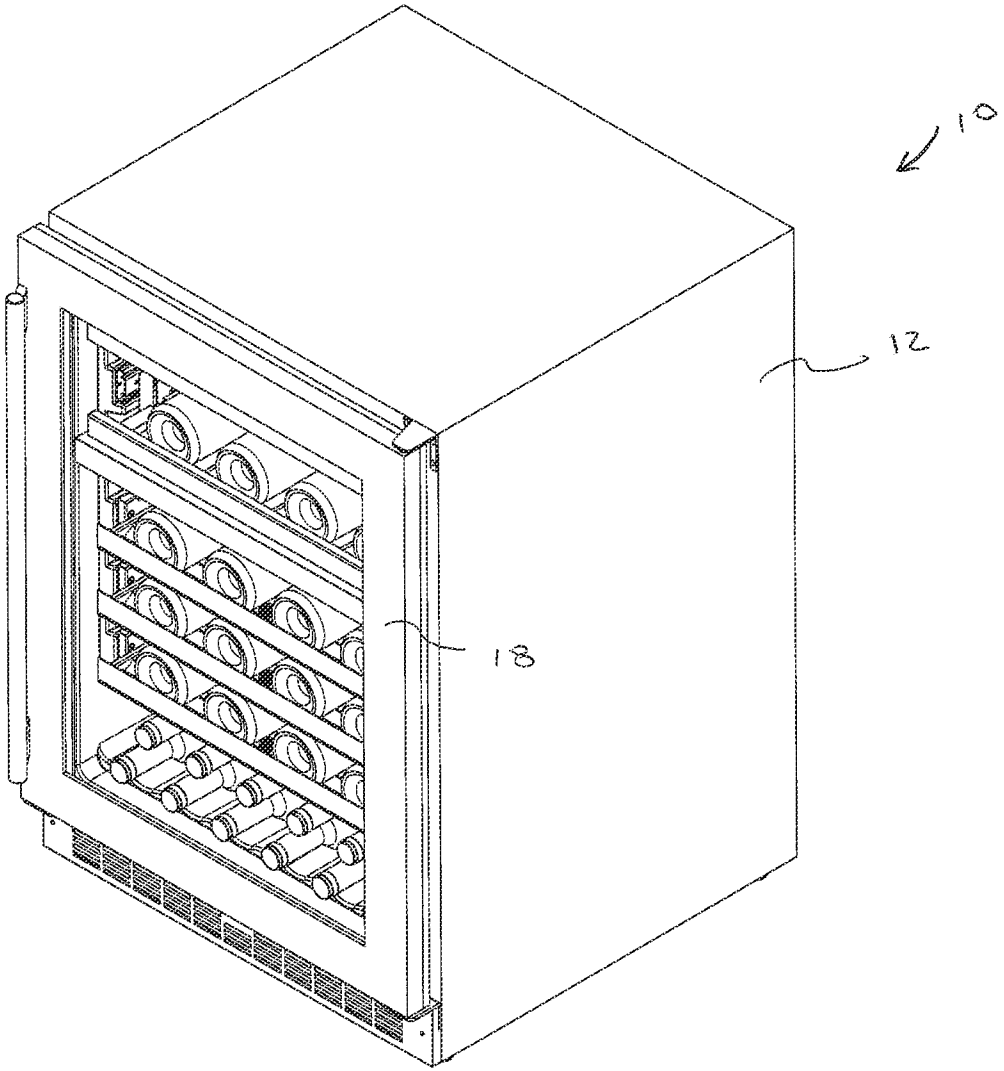
FIG. 16 is a top front right perspective view of the exemplary cooler showing an exemplary arrangement of the internal shelves supporting beverage containing bottles.

The movement of the exemplary front portion about the rear pivots 74 toward the retracted position is represented in FIGS. 12 and 13. This can be accomplished when the outward extending projections 84 have been disengage from apertures 80 and 82. In the retracted position of the front portion as shown in FIGS. 14 and 15 the back side links 70 and the front side links 60 extend rearward from the rear pivots 74. The front portion may be held in the retracted position by magnets, fasteners, apertures that engage the projecting members or other suitable engaging structures. With the front portion moved to this retracted position, the forward area of the shelf is open. This enables the necks of bottles or other containers that may be tilted upward on the shelf immediately below to extend vertically upward to at least the level of the shelf above and into the open space at the front portion of the upper shelf. In the retracted position of the front portion, the back portion and the inserts thereon remain suitable for holding beverage containers in supported connection with the back portion. As can be appreciated these exemplary arrangements facilitate holding the beverage containers in the desired locations in supported connection with the shelves.

Of course as can be appreciated in exemplary arrangements the front portion may be returned to the flat shelf position or to the tilted position as may be desired by the user. Thus exemplary arrangements enable the user to readily reconfigure the shelf arrangement within the cooler. Further in exemplary arrangements the ability to releasably engage the shelves 26 and the slides 28 may also enable the shelves to be configured such that in the retracted position of the front portion of the shelf, the location of the open area is reversed so that space for bottles or containers extending upward from the shelf immediately below is at the inward side of the shelf. Thus for example in exemplary arrangements with the shelf having the retracted front portion positioned between the slides with open space at the back, the user may position tall bottles so they extend vertically upward from the shelf below into the open space at the back of the shelf immediately above. Of course it should be understood that these approaches are exemplary and in other arrangements other approaches to be used.

Figure 6:
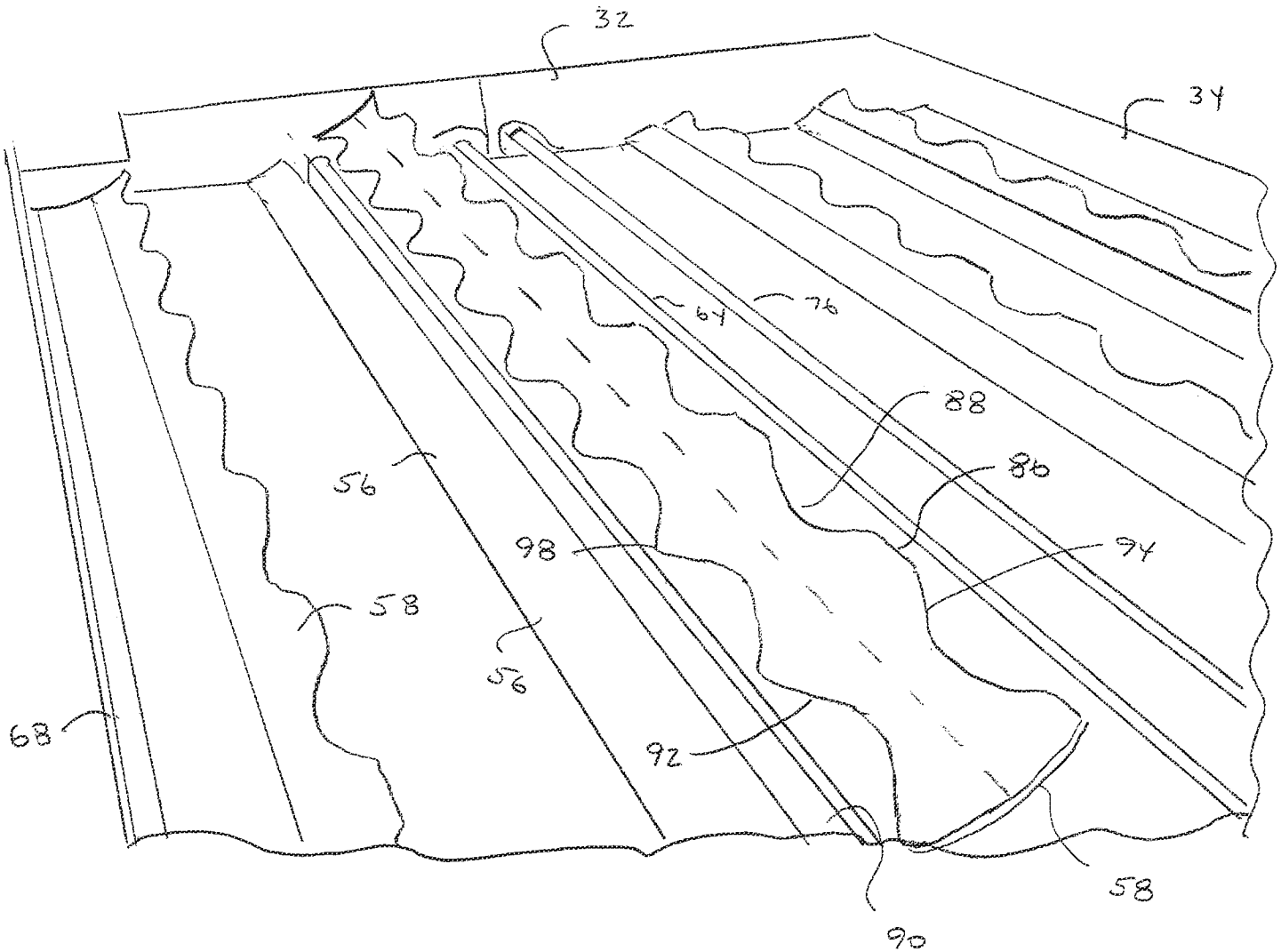
FIG. 6 is a perspective exploded view of an exemplary configurable shelf and a reversible insert that is configured to engage a slot of a shelf support plate.

As previously discussed, in exemplary arrangements the front portions 50 and the back portions 52 of the shelves each include horizontally extending shelf support plates 56 that have horizontally elongated slots that are configured to releasably receive inserts 58 therein. As represented in FIG. 6 in exemplary arrangements the slots 90 extend horizontally between the side walls 32. The slots are configured to receive a horizontal edge 92 of an insert therein. When the horizontal edge 92 is positioned within the slot an opposed horizontal edge 94 which includes horizontally spaced projections 86 and recesses 88 extends vertically above and outside of the slot.

In exemplary arrangements the recesses and projections conform with the configuration of outside walls of bottles or other containers of a given size. The exemplary projections 86 have a spaced configuration such that the projections extend intermediate of the containers and maintain the containers in the desired spaced relation. This helps to assure that containers in engaged relation with the shelf inserts maintain the desired positions and do not move under normal circumstances when the shelves are extended and retracted from the enclosure.

Further in exemplary arrangements each opposed horizontal edge of an insert includes projections and recesses that have a different configuration and/or spaced relationship. As a result the user may change the spaced relationship and/or configuration of the projections that are exposed outside and above the slot by reversing the exemplary insert and extending the currently exposed horizontal edge and the projections thereon so they extend within the slot. In exemplary arrangements the inserts may include visible indicia 96 thereon that indicate the particular spaced relationship of the projections that extend on each horizontal edge. Thus a user is enabled to assure that each of the inserts are configured in the same manner and with the projections having the same spaced configurations extending upward outside the slot.

In exemplary arrangements the inserts 58 are curved in transverse cross-section. As a result the projections 86 along one horizontal edge 94 extend at an obtuse angle relative to projections 98 that extend on the opposed transverse edge 92. Further in exemplary arrangements the inserts are comprised of resilient material. This enables the inserts to be extended in a respective slot 90 and held therein by the biasing force against the sides of the slot that is produced by the compression of the resilient material. Of course it should be understood that these approaches are exemplary and in other arrangements other approaches may be used. For example multiple inserts may be positioned within a respective slot and/or multiple separate slots may be utilized instead of a continuous slot.

FIGS. 20-47 show a further alternative exemplary arrangement of a cooler apparatus 100. Cooler apparatus 100 is similar to cooler apparatus 10 except as specifically indicated.

Similar to the previously described cooler, cooler 100 includes an enclosure 102 that bounds an interior area 104. The enclosure 102 includes an opening 106 to the interior area. A door 108 is movably mounted in supported connection with the enclosure 112 through hinges 110. The door includes a transparent panel 112 that enables viewing the interior area 104 of the enclosure when the door is in the door closed position. The door further includes a handle 114 that facilitates moving the door between the door closed position shown in FIG. 20 and the door open position shown in FIG. 21.

A plurality of shelves 116 are movably mounted in operatively supported connection with the enclosure in the interior area 104. The shelves are movably mounted on slides 118. The slides 118 enable the shelves 116 to be moved along a movement direction between a back position and an outward position. In the back position the shelves are positioned within the interior area 104 of enclosure 102 such as is shown for all the shelves shown in FIG. 21. When all the shelves 116 are in the back position the door 108 is enabled to be moved to the closed position. With the door in the open position each of the shelves 116 is enabled to be moved along the shelf movement direction to an outward position in which the shelf extends in the opening 106. One of the shelves 116 is shown in the outward position in FIG. 22. Of course it should be understood that in the exemplary arrangement a plurality of the shelves 116 are movable in this manner.

Figure 23:
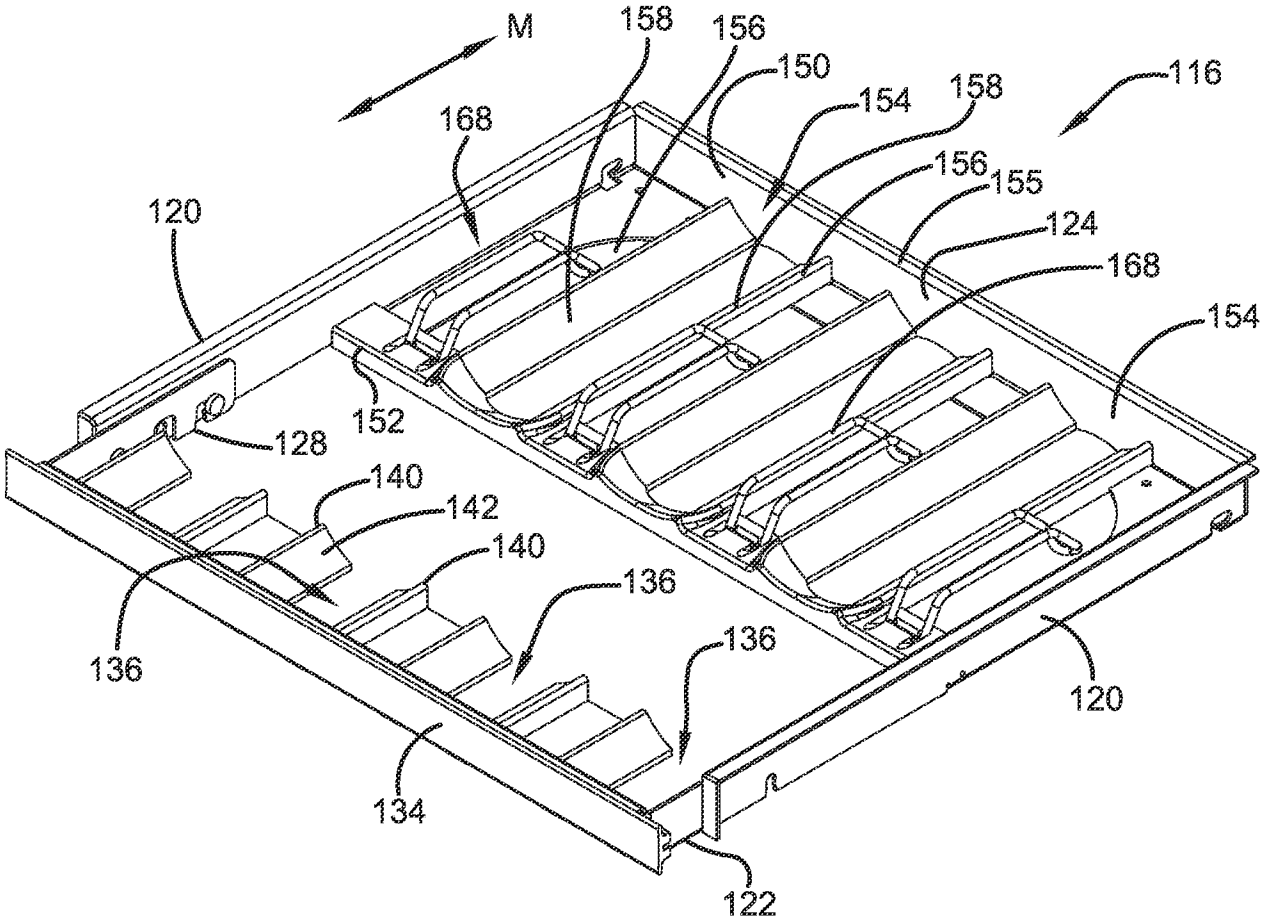
FIG. 23 is a top front left perspective view of an exemplary shelf of the beverage cooler of FIG. 20.

An exemplary shelf 116 is shown in FIG. 23. The exemplary shelf includes a pair of side walls 120. Side walls 120 are engageable with respective slides 118 and extend parallel to the shelf movement direction which is indicated M in FIG. 23. In the operative position the side walls 120 are disposed horizontally from one another and are movable between the outward position and the back position in generally the horizontal direction. As used herein generally horizontal will be interpreted to mean in alignment with a horizontal direction plus or minus 20°.

Figure 26:
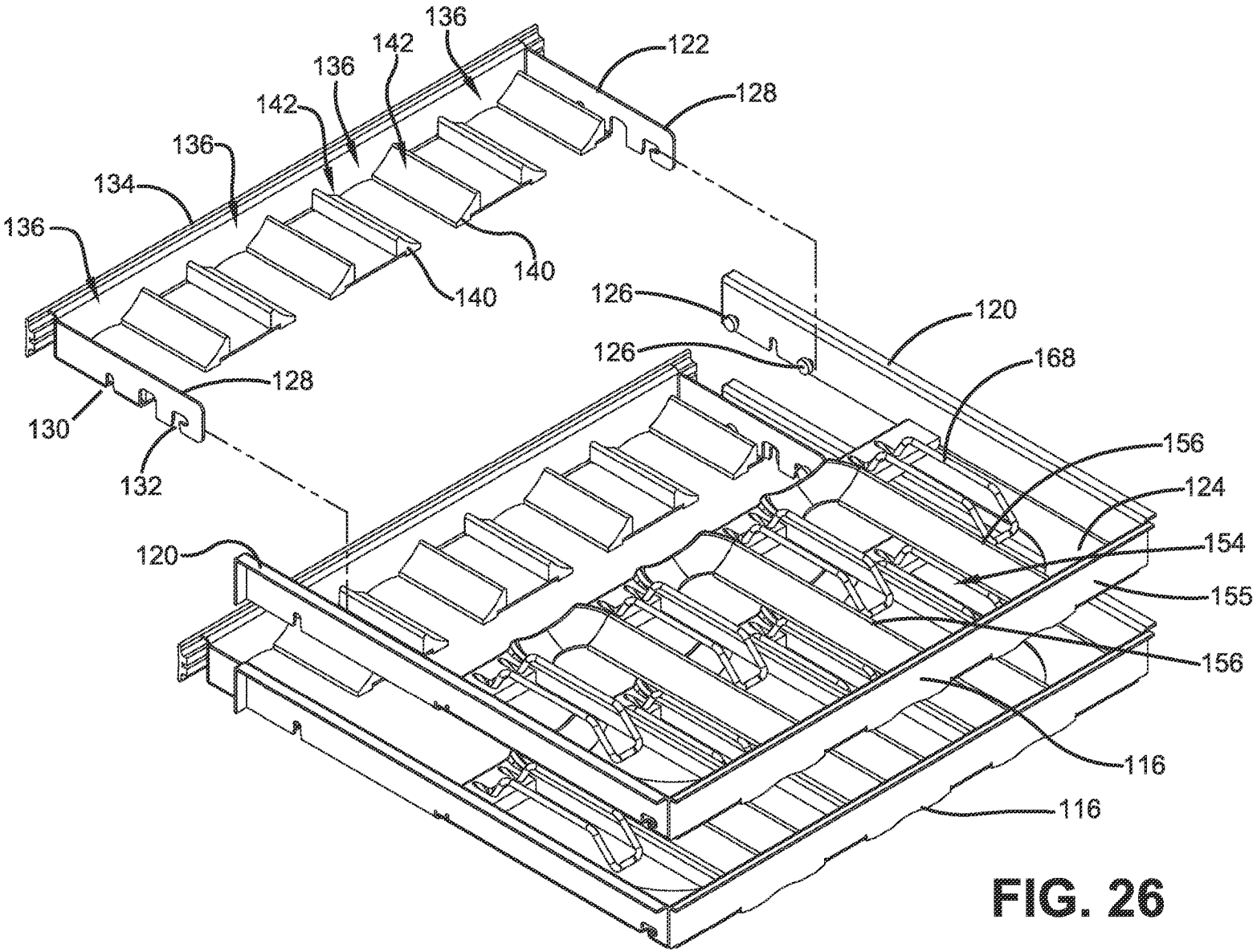
FIG. 26 is a top back right perspective view of the shelves shown in FIG. 25 with the front portion of the upper shelf shown removed therefrom.

The exemplary shelf 116 includes a front portion 122 and a back portion 124. The front portion extends intermediate of and between the side walls 120 and is manually removably engageable with the side walls through interengaging projections and recesses. As shown in FIG. 26 for example, each of the exemplary side walls 120 include inward extending projections 126. The exemplary projections include a cylindrical body portion and an enlarged head portion. Rearward extending panels 128 of the front portion 122 include recesses 130 and 132. The exemplary recesses 132 each comprise an L-shaped slot. In the exemplary arrangement the respective body of each rearmost projection 126 is enabled to be received in a respective slot 132 while the head extends inwardly outside the slot. Once the bodies of the rear projections 126 have reached the tops of the L-shaped slots 132, movement of the front portion relative to the back portion 124 causes the bodies of the projections 126 to move into the horizontally extending portions of the L-shaped slots 132. Once the bodies of the rear projections 126 are in this portion of the L-shaped slots, the forward slots 130 are in alignment with the forward projections 126. This enables the panels 128 to be moved so that each of the front projections are engaged in one of the respective recesses 130 of the panels 128.

This exemplary arrangement further enables the front portion to be removed from engagement with the side walls by manually moving the panels 128 so that the forward projections 126 are no longer in engagement with the recesses 130. The front portion that may be moved relative to the back portion 124 and the side walls 120 so that the front portion may be disengaged from the shelf. In exemplary arrangements the front portion may be engaged and disengaged from the shelf without tools and only through relative movement of the front portion and the back portion. In other arrangements one or more releasable fasteners may be used to hold the front portion in releasable fixed engagement with the shelf. Of course these approaches are exemplary and in other arrangements other approaches may be used.

The exemplary front portion 122 includes a front plate 134. The exemplary front plate extends transversely between the panels 128 and is in facing relation with the opening 106 when the shelf is in the back position. The exemplary front plate 134 is configured for manual engagement to facilitate moving the shelf 116 along the shelf movement direction between the outward position and the back position.

Figure 24:
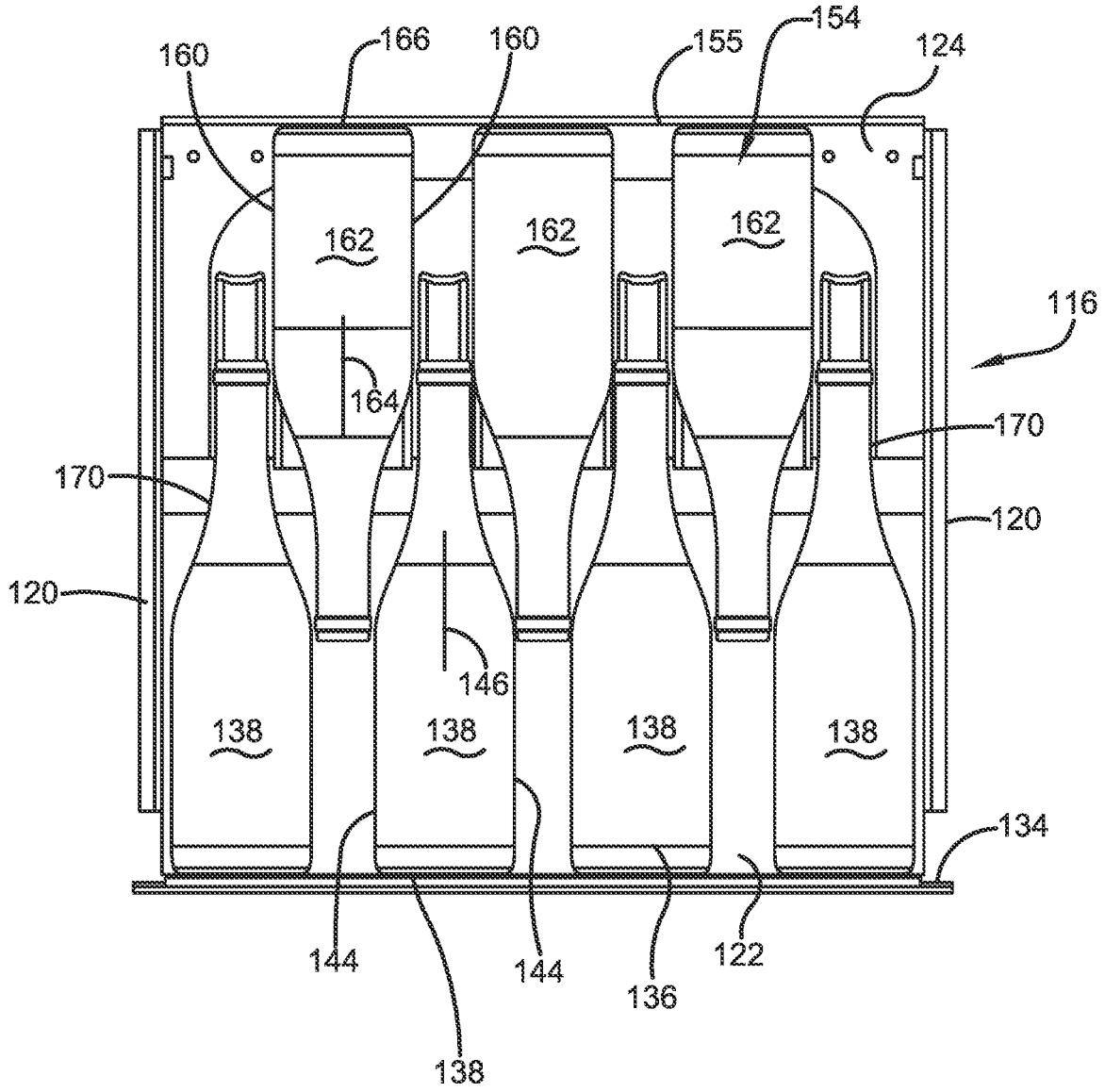
FIG. 24 is a top view of the exemplary shelf shown in FIG. 23 with bottles shown positioned in the bottle engaging recesses of the shelf.
Figure 25:
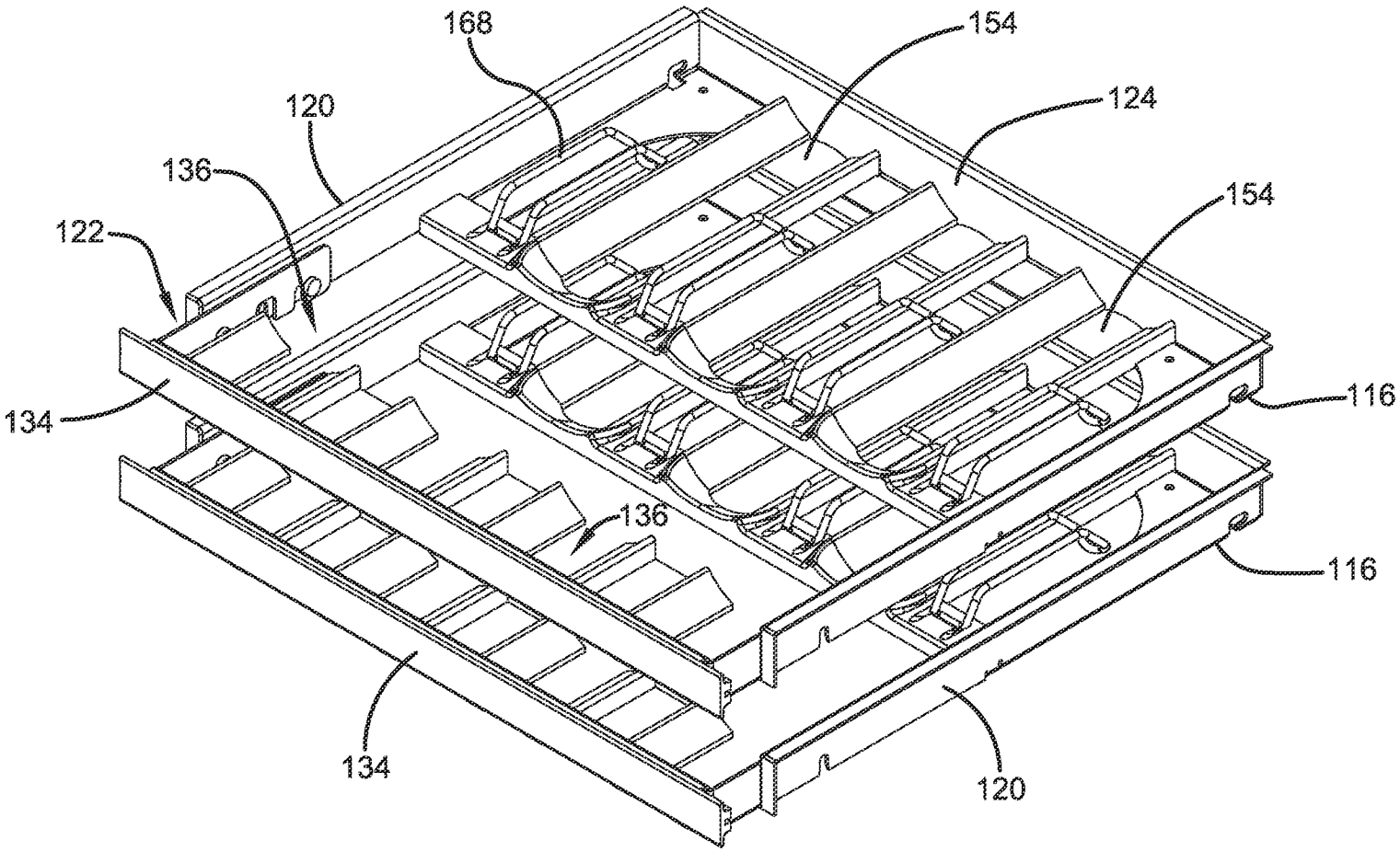
FIG. 25 is a top front left perspective view of a pair of shelves of the type shown in FIG. 23 arranged in the orientation that corresponds to a back position of the shelves within the interior area of the cooler.

The front portion 122 of the exemplary shelf 116 further includes a plurality of transversely spaced first bottle engaging recesses 136. Each bottle engaging recess is configured to engage a portion of a first cylindrical side wall 144 of a bottle such as bottles 138 as shown in FIG. 24. Each exemplary bottle engaging recess is bounded by a pair of bottle engaging struts 140. Each of the exemplary bottle engaging struts of the pair are disposed from the other strut of the pair in a direction perpendicular to the direction of shelf movement. Each exemplary bottle engaging strut 140 is elongated along a direction parallel to the shelf movement direction. In the exemplary arrangement each of the bottle engaging struts includes a curved inner face 142. Each curved inner face 142 is configured to be in supporting connection with a portion of the cylindrical side wall 144 of the respective bottle 138 that is positioned in the bottle engaging recess. Each curved inner face is configured to be in facing relation of the central axis 146 of the bottle 138 that is positioned in the respective bottle engaging recess 136. Of course it should be understood that this bottle wall engaging configuration is exemplary and in other arrangements other approaches may be used.

Further as shown in FIG. 24 the inner side of the exemplary front plate 134 is configured to be engaged with the bottom 148 of the bottle 138 that is engaged in the bottle engaging recess. As a result the inner side of the front plate 134 limits the travel of the bottles 138 positioned in the bottle engaging recesses 136 along the shelf movement direction. Of course it should be understood that this configuration is exemplary and in other arrangements other configurations of bottle engaging recesses may be used.

The back portion 124 of the exemplary shelf 116 extends horizontally intermediate of and between the side walls 120. The exemplary back portion 124 is bounded rearwardly by a back plate 150 that extends intermediate of and between the side walls 120. The exemplary back portion is bounded in a forward direction by a crossmember 152. Crossmember 152 also extends horizontally intermediate of and between the side walls 120.

The exemplary back portion also includes a plurality of transversely spaced bottle engaging recesses 154. Each exemplary bottle engaging recess 154 is bounded by a pair of bottle engaging struts 156. Similar to bottle engaging struts 140, exemplary bottle engaging struts 156 are each elongated in a direction parallel to the shelf movement direction. The bottle engaging struts 156 of the pair are disposed from one another in a direction that is perpendicular to the shelf movement direction. Further each exemplary strut 156 includes a curved inner face 158. Each curved inner face is configured to be in engagement with a portion of the cylindrical side wall 160 of a bottle 162 that is positioned within the respective bottle engaging recess 154. Of course it should be understood that this strut configuration is exemplary and other bottle wall engaging strut configurations may be used. As represented in FIG. 24 each of the bottle engaging recesses 154 is configured to hold the respective bottle 162 with a respective bottle axis 164 thereof extending generally horizontal.

As shown in FIG. 24 the exemplary back portion is configured such that the bottoms 166 of the bottles 162 are in engaged relation with the forward facing face of the back plate 155. Further as shown in FIGS. 23 and 24 for example, the exemplary bottle engaging recesses 154 of the back portion 124 are horizontally disposed in a direction perpendicular to the shelf movement direction, away from the center line of each of the bottle engaging recesses 140 of the front portion 122. As a result the bottle engaging recesses 154 are configured to be spaced horizontally intermediate of the bottle engaging recesses 136 of the front portion. This enables the bottles 162 engaged with the bottle engaging recesses 154 of the back portion to be positioned so that at least a portion thereof extends in horizontally adjacent side by side relation with a portion of bottles 138 engaged in respective bottle engaging recesses 136 of the front portion. This exemplary arrangement enables bottles to be stored in a compact arrangement on the exemplary shelf 116. Of course it should be understood that this arrangement is exemplary and in other arrangements other approaches and configurations of bottle engaging recesses may be used.

The exemplary shelves 116 each include a plurality of bottle neck props 168. Each of the exemplary bottle neck props is movably mounted in operatively supported connection with the crossmember 152. Each bottle neck prop is disposed from each of the other bottle neck props in the direction perpendicular to the shelf movement direction. Each exemplary bottle neck prop 168 is configured to engage a neck 170 of a bottle 138 that is engaged with a bottle engaging recess 136 of the respective shelf 116. In the exemplary arrangement each respective bottle neck prop 168 is linearly aligned with a center line of a respective bottle engaging recess 136. Further as represented in FIGS. 26 and 27 for example, each exemplary bottle neck prop 168 is in vertically aligned relation with at least one bottle neck prop on an immediately adjacent shelf that extends above or below the shelf to which the bottom neck prop is movably mounted.

In the exemplary arrangement each bottle neck prop 168 is movable between a lowered position such as is shown for the bottle neck props 168 in FIG. 23, and a raised position. The bottle neck props 168 shown on the lower shelf 116 in FIG. 27 are shown in the raised position. In the exemplary arrangement to move the bottle neck props to the raised position and engage the elevated necks of bottles therewith, the front portion 122 of the shelf immediately above and in overlying relation of the shelf on which the props are to be raised, is removed.

Figure 27:
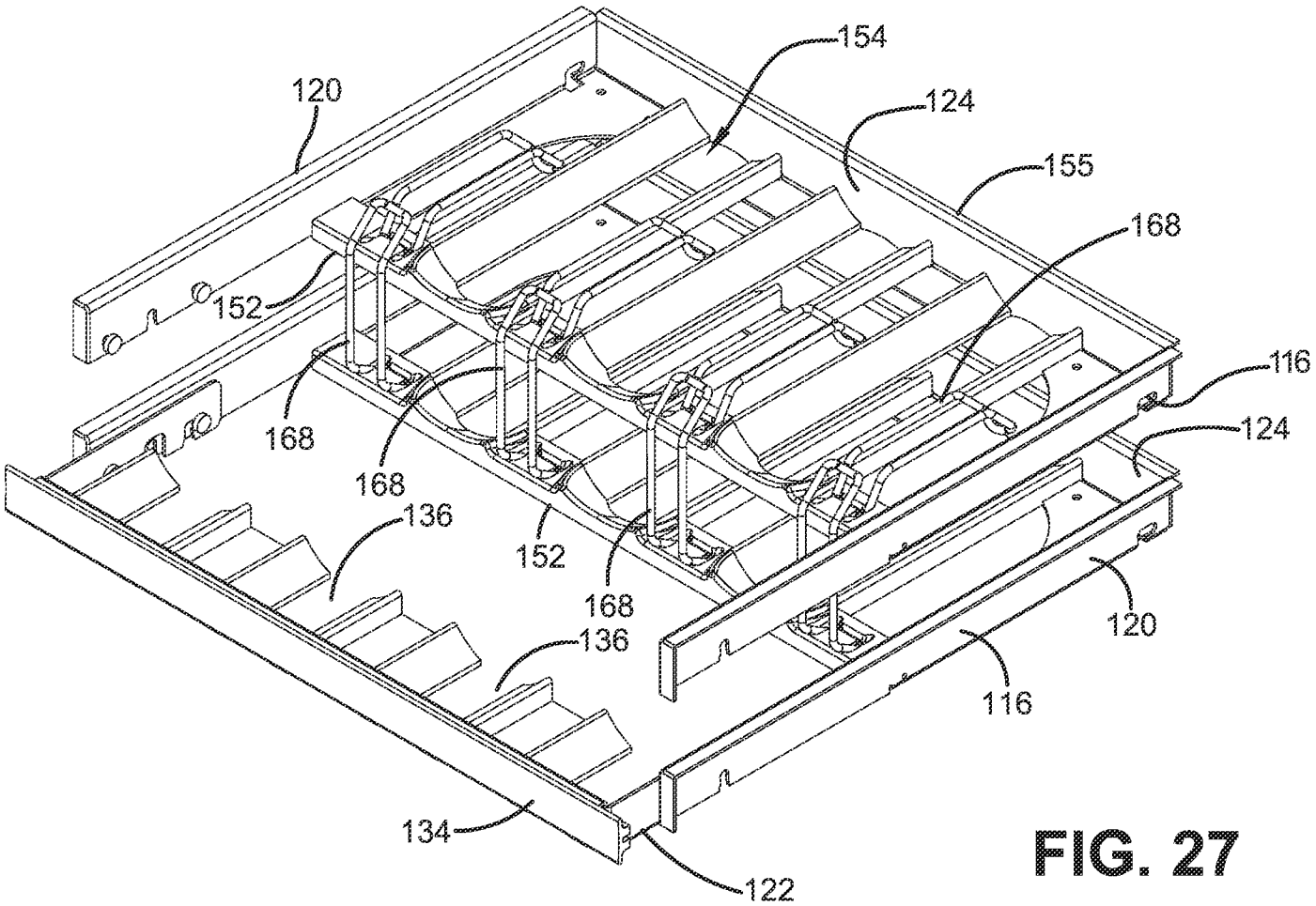
FIG. 27 is a top front left perspective view of the shelves shown in FIG. 26 with the bottle neck props of the lower shelf shown in a prop raised condition.
Figure 28:
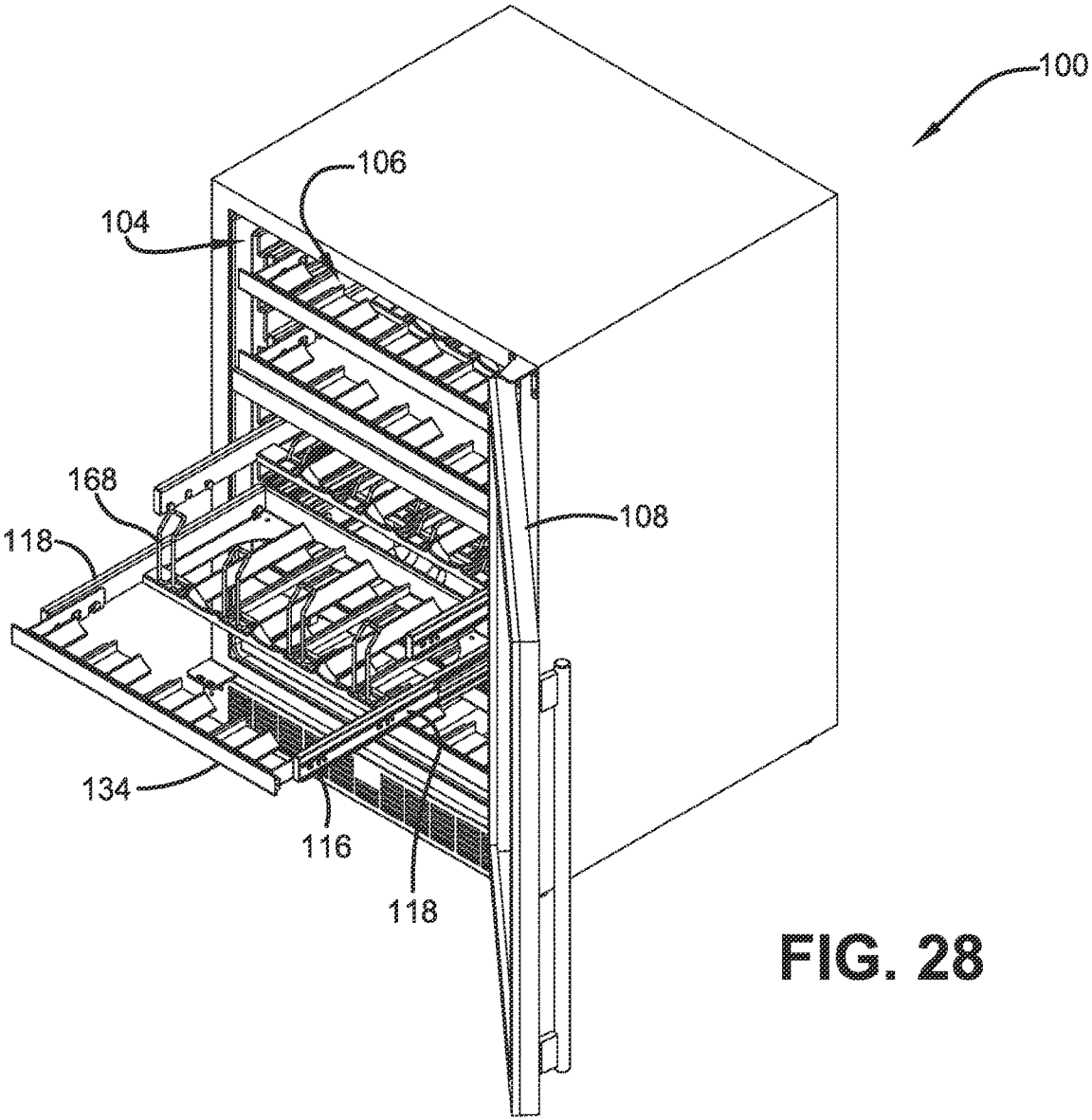
FIG. 28 is a top front right perspective view of the cooler of FIG. 20 with the shelves shown in FIG. 27 extending through the opening of the enclosure.
Figure 29:
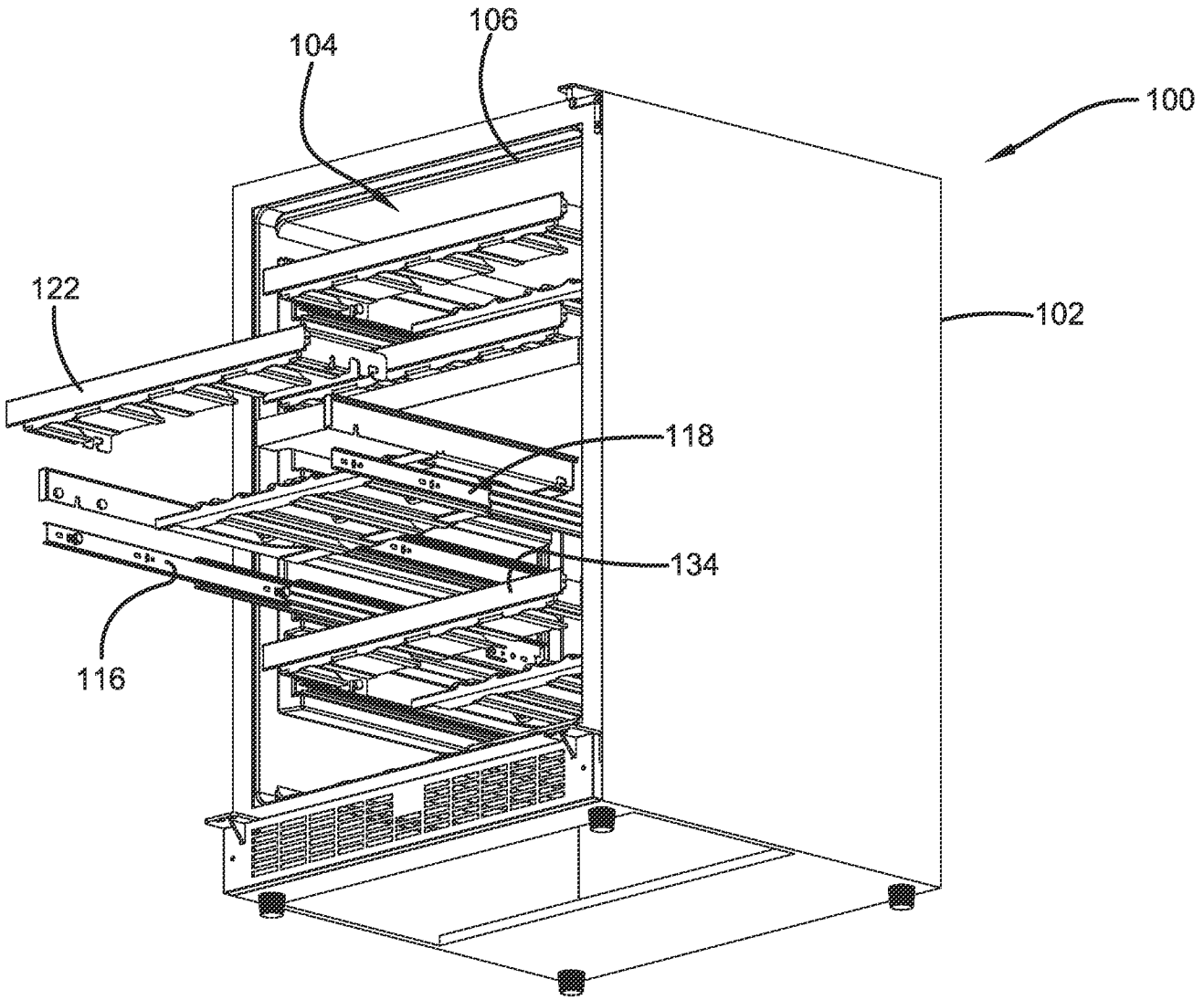
FIG. 29 is a front bottom right perspective view of the enclosure without the door and showing the front portion of the upper shelf removed in a manner similar to that shown in FIG. 26.

Further as shown in FIG. 27, in the exemplary arrangement when the bottle neck props on an immediately underlying shelf are moved to the raised positions the bottle neck props extend upward from the underlying shelf to a vertical level of the shelf above. Also in the exemplary arrangement in the raised position of the bottle neck props, the props are positioned forward of the back portion 124 of the immediately overlying shelf. In exemplary arrangements the bottle neck props 168 extend forward of the crossmember 152 of the back portion of the overlying shelf. However it should be understood that this approach is exemplary and in other arrangements there may be greater vertical spacing between immediately adjacent shelves, and in such arrangements the front portion 122 of an immediately overlying shelf need not be removed in order to move the bottle neck props on the shelf below to the raised position so that the necks of bottles may be engaged therewith.

Figure 30:
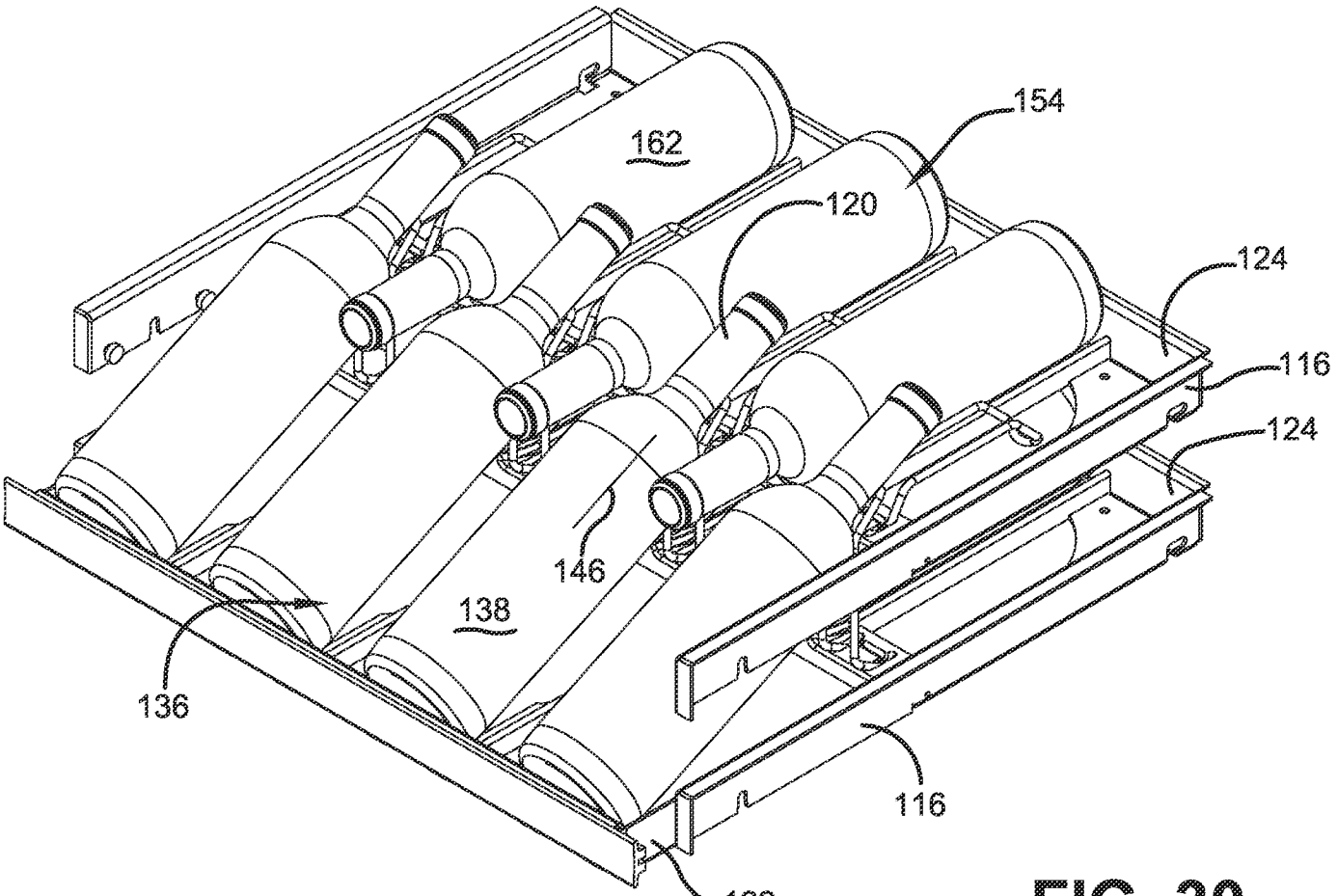
FIG. 30 is a top front right perspective view of the shelves shown in the configuration corresponding to FIG. 27 and with bottles positioned in the bottle engaging recesses of both shelves.
Figure 31:
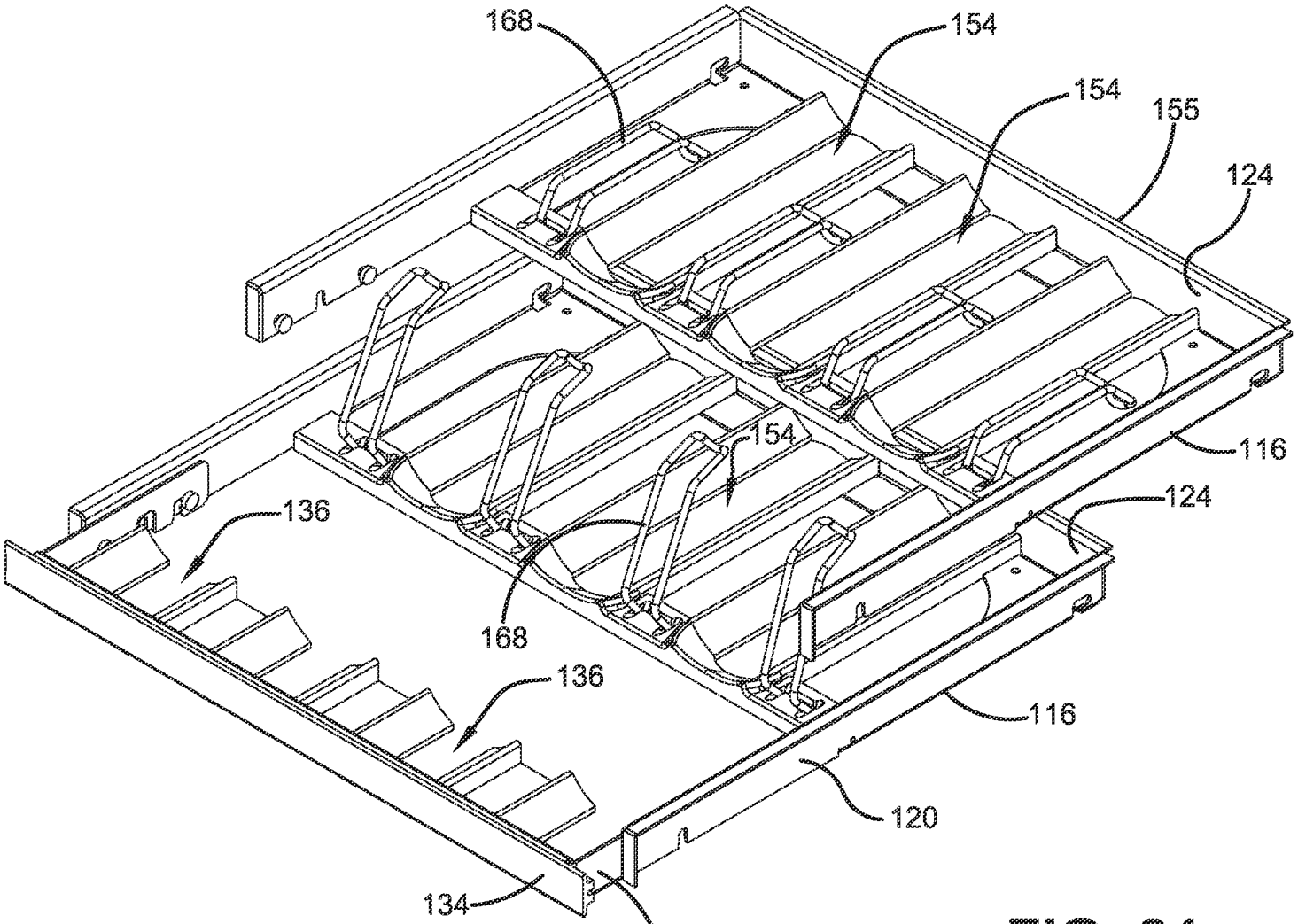
FIG. 31 shows the shelves of FIG. 30 without the bottles and with the lower shelf shown extended outward in a position in which it will extend through the opening of the cooler.

As represented in FIG. 30 for example, in an exemplary arrangement with the bottle neck props 168 of a lower shelf moved to the raised position, bottles 138 that are engaged in the bottle engaging recesses 136 of the lower shelf 116 extend with the neck 120 of the respective bottle 138 extending vertically at least to the vertical level of the upper shelf 160. In this exemplary arrangement the axis 146 of each bottle 138 extends upward and at an acute angle relative to horizontal. Thus as can be appreciated the ability to position the bottles 138 with the axes at an acute angle relative to horizontal, facilitates displaying the bottles so that they can be seen through the transparent panel 112 of the door 108 when the door is in the closed position.

Figure 32:
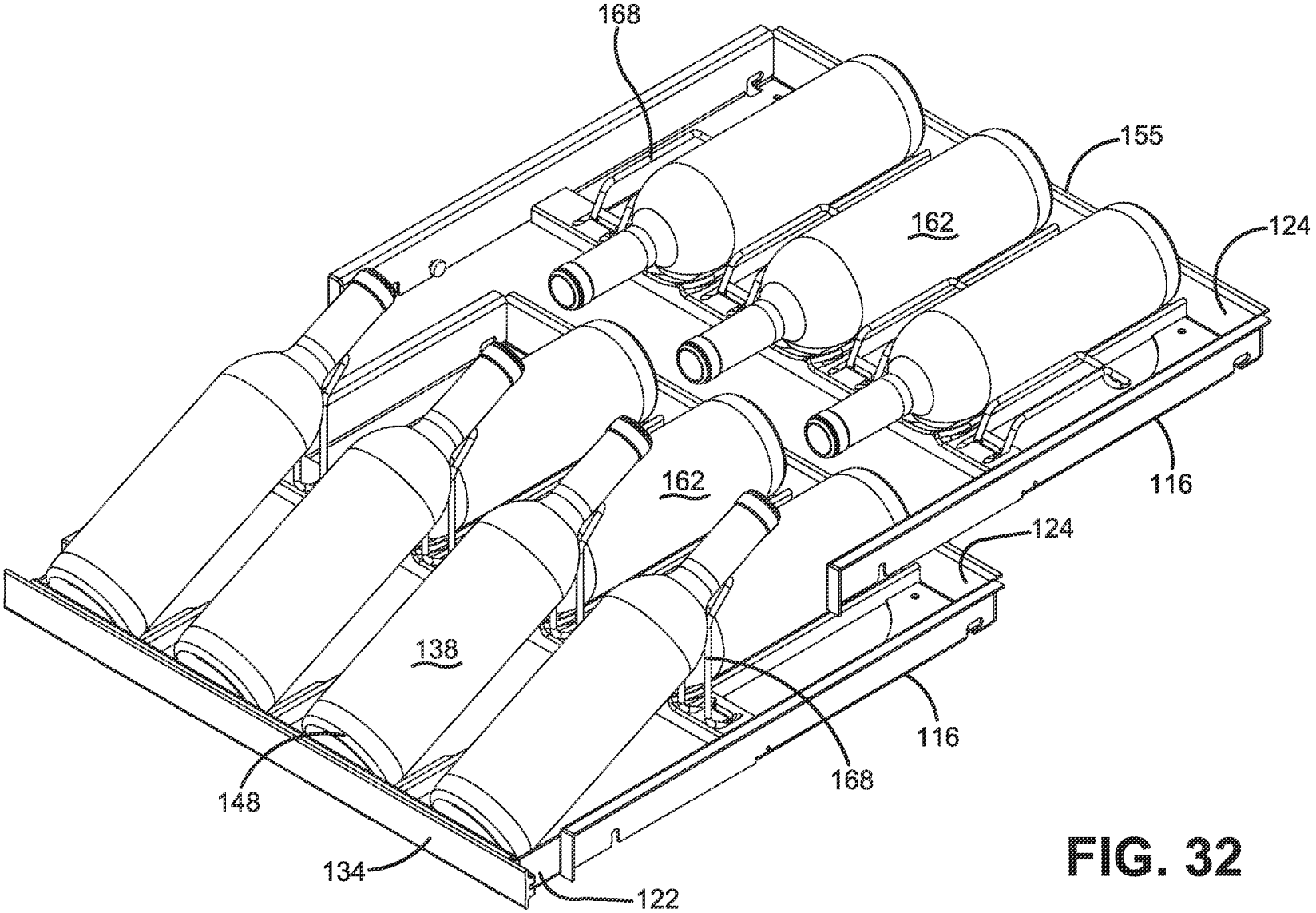
FIG. 32 is a view similar to FIG. 31 but with bottles shown positioned in the bottle engaging recesses of the shelves.
Figure 33:
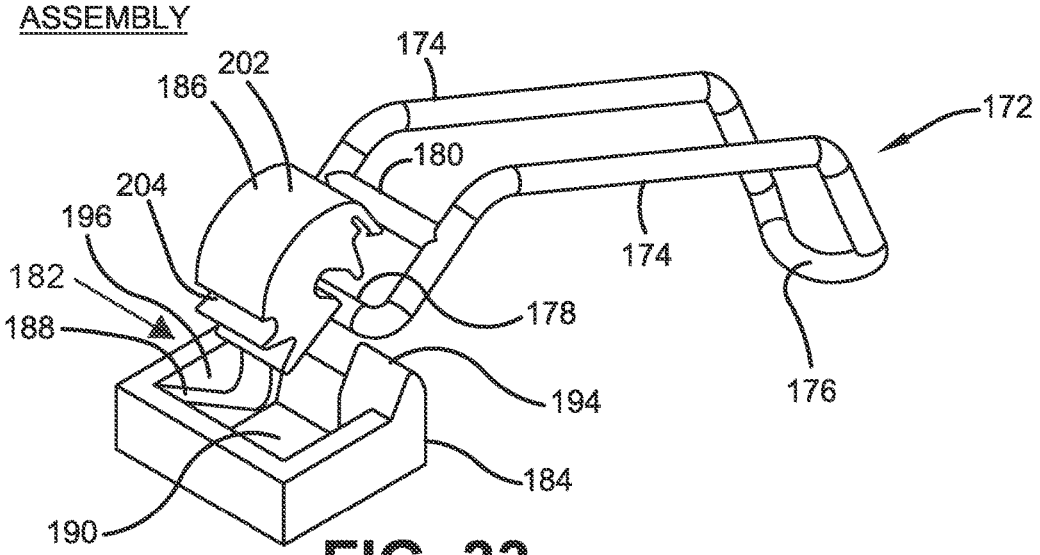
FIG. 33 is an exploded perspective view of an exemplary bottle neck prop.
Figure 34:
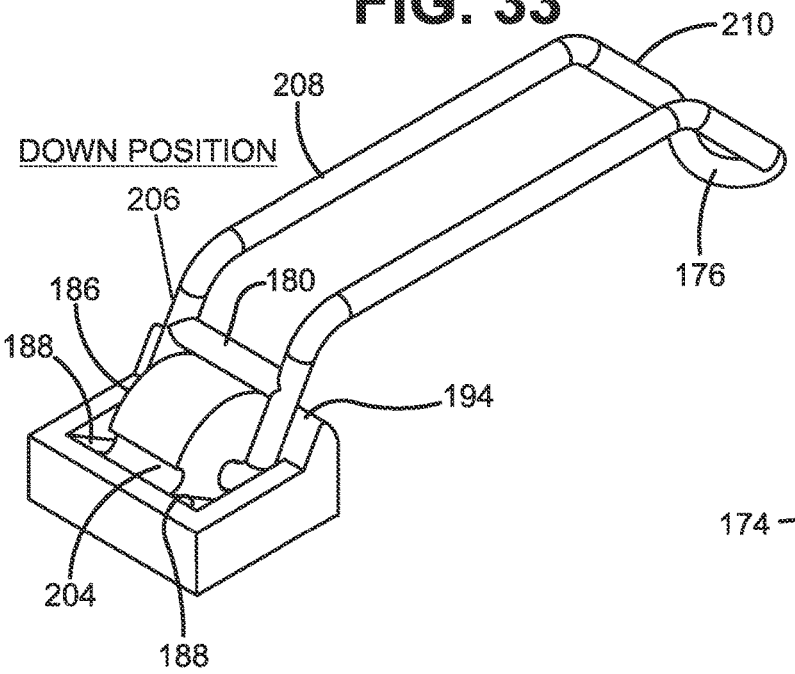
FIG. 34 is a perspective view of the bottle neck prop of FIG. 33 in a prop lowered position.
Figure 35:
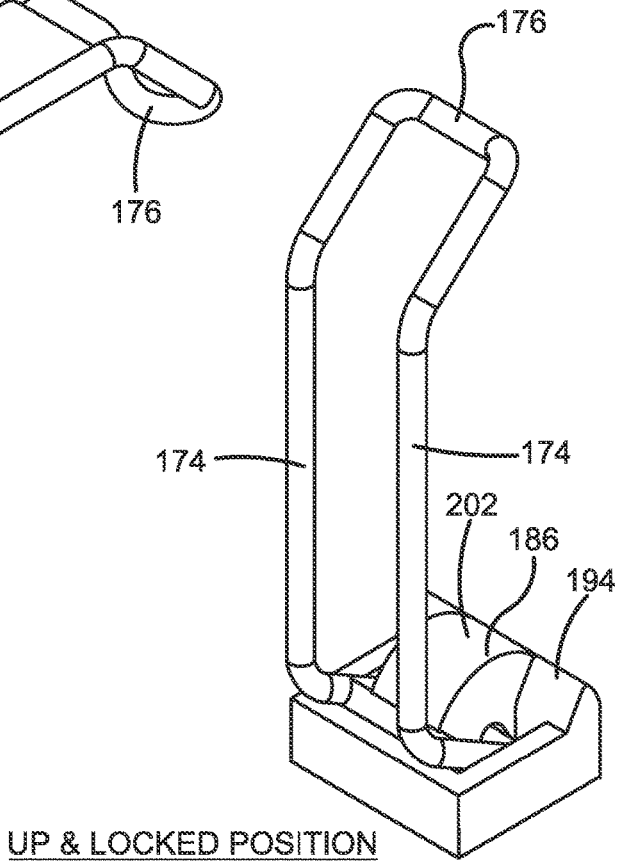
FIG. 35 is a perspective view of the bottle neck prop of FIG. 33 in a prop raised position.

Further as shown in FIGS. 30 and 32 when each of the exemplary upper and lower shelves 116 are in the respective back positions, bottles 138 engaged with the bottle engaging recesses 136 on the lower shelf have the necks 120 thereof extending intermediate of the necks of bottles 162 that are positioned in the bottle engaging recesses 154 of the upper shelf. In addition moving the lower shelf 116 from the back position to the outward position as shown in FIG. 32 facilitates accessing the bottles 162 located in the bottle engaging recesses 154 of the lower shelf as well as the bottles 162 located in the bottle engaging recesses 154 of the upper shelf. Of course it should be understood that these approaches are exemplary and in other arrangements other configurations and approaches may be used.

In exemplary arrangements the bottle neck props may have different configurations. An exemplary configuration of a bottle neck prop is shown in FIGS. 33-38. This exemplary bottle neck prop 172 comprises a pair of prop members 174. The prop members 174 in the operative position are disposed from each other in a direction perpendicular to the shelf movement direction. The exemplary prop members 174 are disposed from one another a distance such that they are configured to engage the cylindrical surface bounding the neck of a bottle such that the neck extends intermediate of the members. The exemplary prop members are configured such that the neck of the bottle extends intermediate of the members when the bottle neck prop is in both a lowered position and in the raised position.

In the exemplary arrangement the prop members 174 are connected by a cross bar 176. The exemplary prop members 174 are further connected by a pivot bar 178 and a stop bar 180 that are positioned at an opposed end of the members from the cross bar 176. In the exemplary arrangement the exemplary prop members 174 may be comprised of a generally continuous pair of bars or wires. However it should be understood that this particular configuration is exemplary and in other arrangements other structures and configurations may be used.

The exemplary bottle neck prop 172 further includes a mount generally indicated 182. The exemplary mount includes a base 184. In exemplary arrangements the base may be molded into the adjacent crossmember of a shelf, or alternatively may be an insert that is installed within the crossmember or other portion of a shelf. The mount 182 further includes a guide 186. The exemplary guide 186 may be comprised of resilient material that is configured to be engaged with and be removable from the base.

The exemplary base includes a pair of horizontally disposed ramp surfaces 188. Each of the ramp surfaces extends on opposed sides of a central pocket 190. The central pocket 190 is configured to receive a bottom portion 192 of the guide 186 which is held in engagement therewith. The base 184 further includes a pair of horizontally disposed stop surfaces 194. The exemplary stop surfaces 194 extend outward away from the pocket 190. As later discussed, in the exemplary arrangement the ramp surfaces 188 each respectively engage with a prop member 174 and limit the travel of the prop members in a first rotational direction to the prop raised position. The stop surfaces 194 are configured to engage a respective prop surface and limit travel of the prop members in a second rotational direction opposed of the first direction to the prop lowered position.

The exemplary base 184 further includes a curved yoke 196. The yoke 196 is configured to engage the pivot bar 178. In the exemplary arrangement the yoke comprises a pair of curved surfaces that each extend within the base and at the lower end of a respective ramp surface 188. Of course it should be understood that this configuration is exemplary and in other arrangements other rotational guiding structures may be used.

Figure 36:
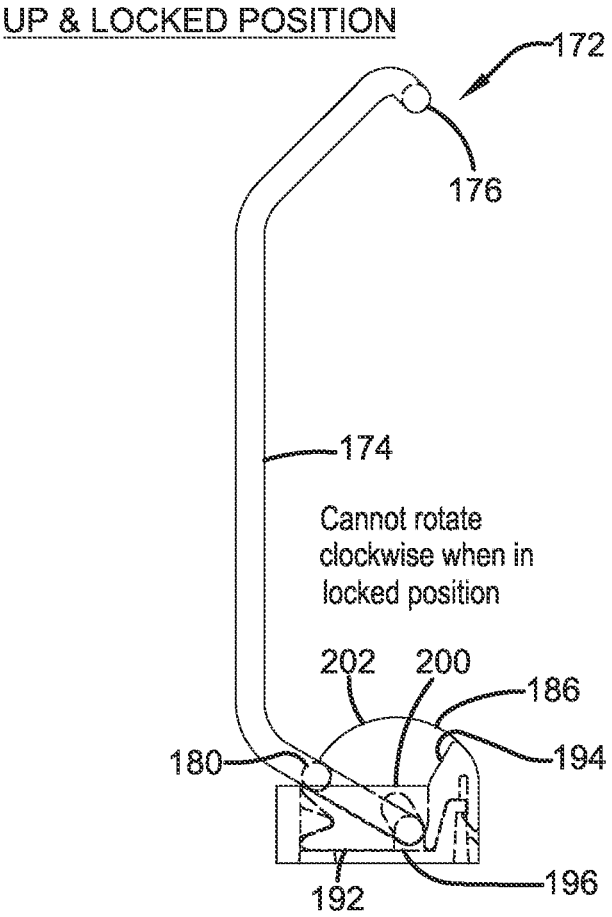
FIG. 36 is a side view of the bottle neck prop of FIG. 33 shown in a prop raised and locked position.
Figure 37:
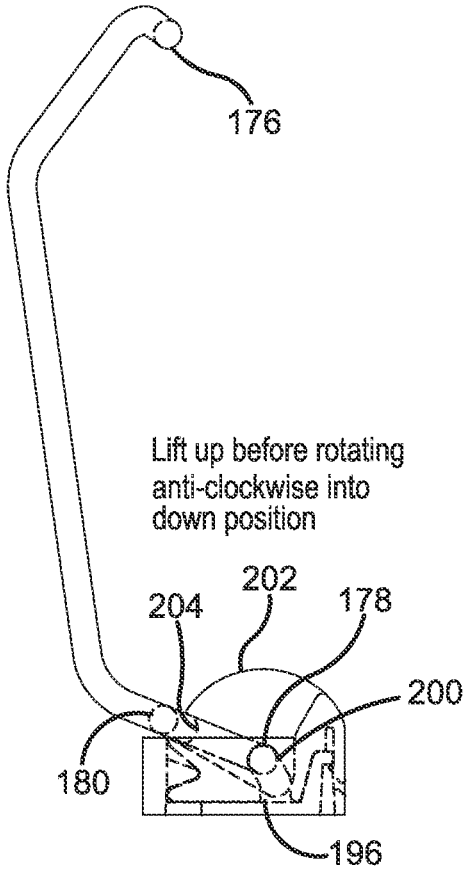
FIG. 37 is a side view similar to FIG. 36 but with the prop members moved to an unlocked position.
Figure 38:
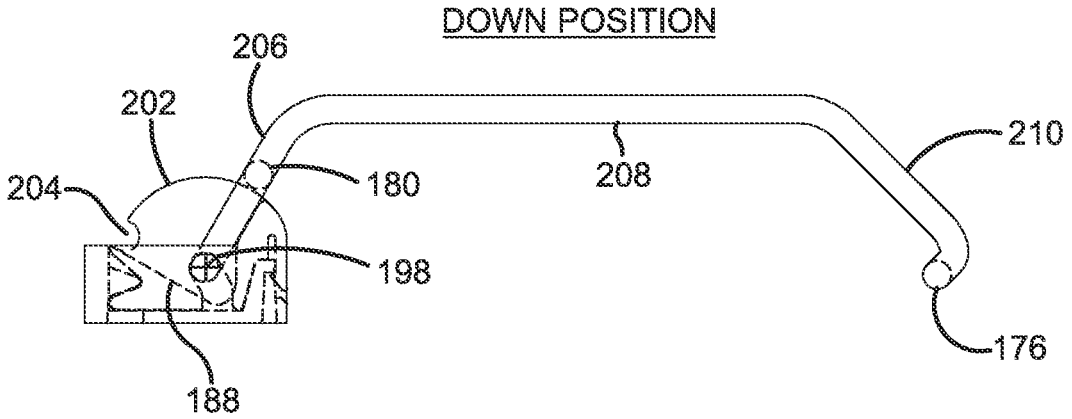
FIG. 38 is a side view similar to FIG. 37 but with the prop members moved to a prop lowered position.

The exemplary guide 186 includes a slot 200. As shown for example in FIG. 36 in the operative position of the guide 186, the slot 200 extends upward from the yoke 196. The slot 200 is configured such that the pivot bar 178 is movable therein. The insert 186 further includes a curved outer surface 202. The curved outer surface 202 includes a holding recess 204 that extends therein. The holding recess 204 is configured to releasably engage the stop bar 180. As shown in FIGS. 36 and 37 the holding recess 204 is configured to receive the stop bar 180 therein when the pivot bar 178 is engaged with the yoke 196 by being at the bottom of the slot 200 and when the prop members 174 are in the raised position. With the stop bar 180 engaged with the holding recess 204 the bottle neck prop is securely held in the prop raised position. As a result in this configuration the guide, the holding recess and stop bar serve as a catch that in an engaged condition serves to hold the prop in the raised position in which it resists applied forces that would otherwise cause the prop to move toward the lowered position.

Moving the pivot bar 178 upward in the slot 200 from the position shown in FIG. 36 causes the stop bar 180 to be moved outward from the stop recess 204. This can be done manually to release the catch from the engaged condition to a disengaged condition. In this position which is represented in FIG. 37, the prop members are enabled to rotationally move about a pivot axis 198 with the stop bar 180 moving along the curved outer surface 202 of the guide 186. This enables the prop members 174 to move to the lowered position shown in FIGS. 34 and 38. Travel of the prop members is limited to the lowered position by the engagement of the stop surfaces 194 and the prop members 174.

The exemplary bottle neck prop 172 is configured such that each prop member 174 includes a first portion 206 that in the prop lowered position extends upward from the pivot axis 198 and the slot 200 of the guide 186. In this exemplary arrangement the first portion includes the pivot bar 178 and the stop bar 180. Each prop member 174 further includes in the prop lowered position, a second portion 208. In the lowered position the second portion 208 extends generally horizontally from the first portion. A third portion 210 extends downward from the second portion 208 and terminates at the cross bar 176. This exemplary arrangement of the bottle neck prop 172 facilitates the ability of the prop members 174 to engage with the cylindrical surfaces of a neck of an adjacent bottle when the bottle neck prop is in the lowered position as well as in the raised position. Of course it should be understood that this configuration is exemplary and in other arrangements other approaches may be used.

Figure 42:
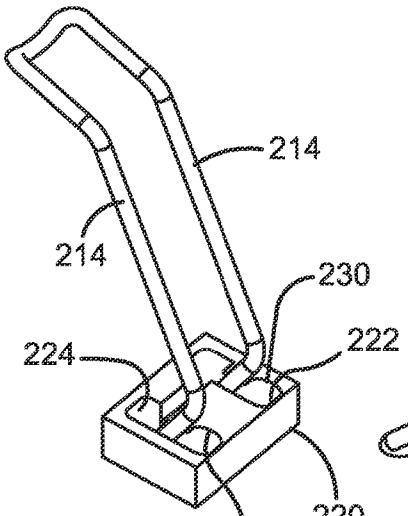
FIG. 42 is a view similar to FIG. 41 but with the prop members moving toward the prop lowered position.
Figure 43:
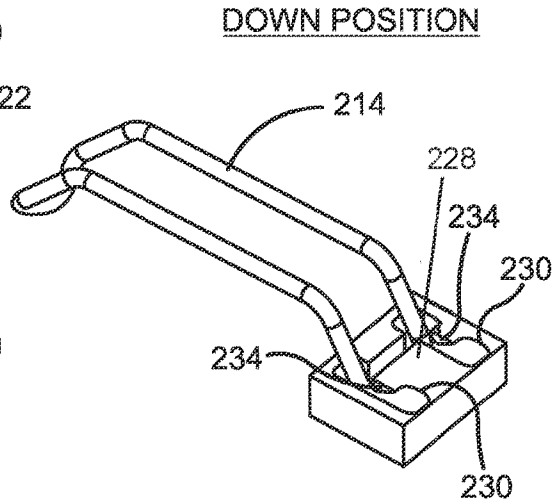
FIG. 43 is a view similar to FIG. 42 and with the prop members in a prop lowered position.
Figure 39:
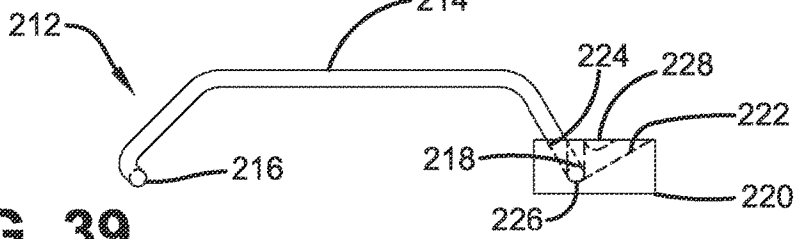
FIG. 39 is a side view of an alternative bottle neck prop with the prop shown in a prop lowered position.
Figure 44:
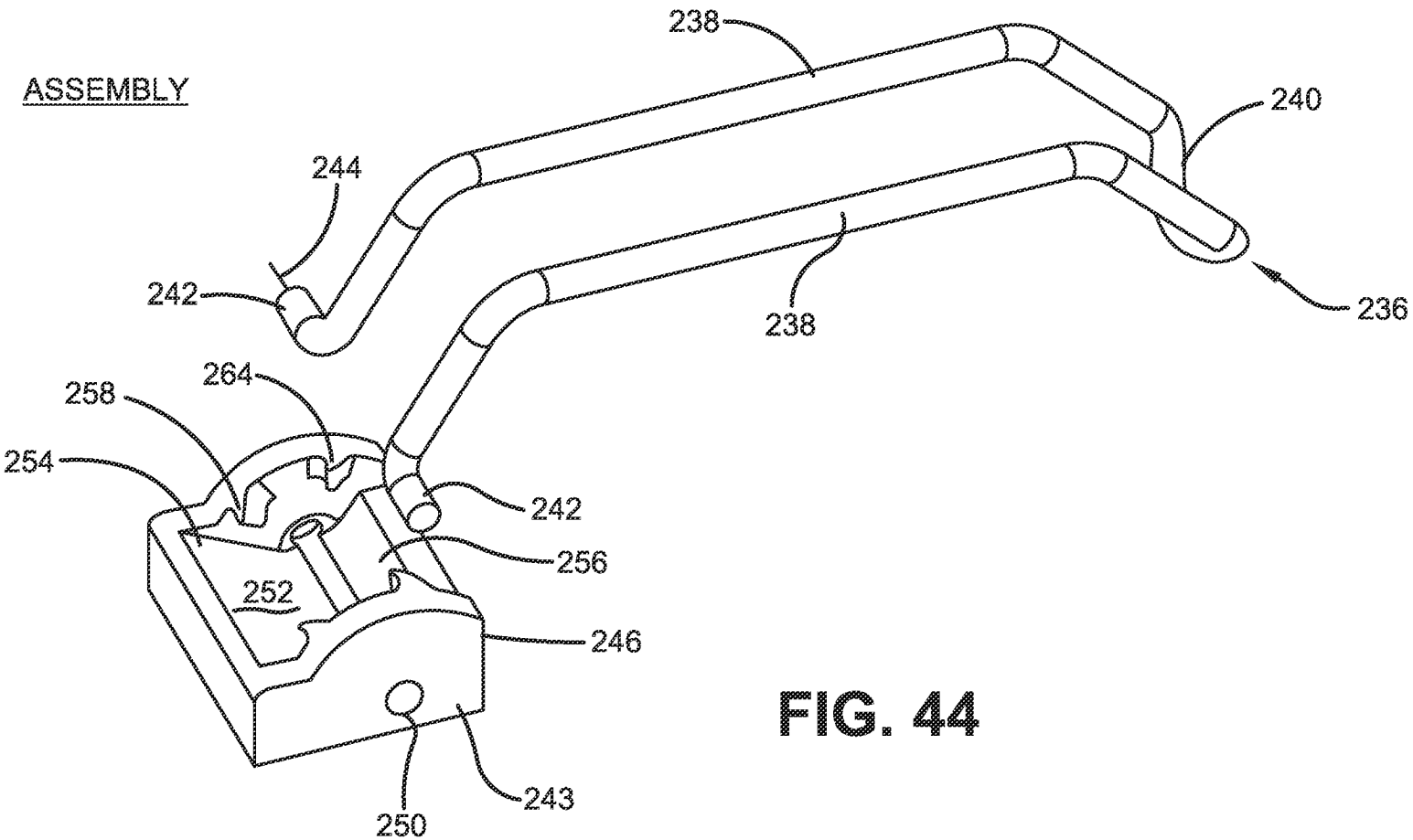
FIG. 44 is a top front right perspective exploded view of an alternative bottle neck prop.

FIGS. 39-43 show an alternative bottle neck prop 212. This exemplary bottle neck prop 212 includes a pair of prop members 214. Similar to the previously described bottle neck prop 172 the prop members comprise circular rod members that are disposed from one another in a direction perpendicular to the shelf movement direction. Each of the prop members 214 have a configuration that includes a first portion, a second portion and a third portion with contour configurations similar to those of prop 172 when the bottle neck prop 212 is in a lowered position such as is shown in FIGS. 39 and 43.

The exemplary prop members are connected by a cross bar 216 at an outward end and by a pivot bar 218 at an opposed end. The prop members 214 are movable in operative supported connection with a base 220. In some exemplary arrangements the base 220 may be integrally formed with a crossmember of the shelf or alternatively may comprise an insert that is installed in a recess on the crossmember or other portion of the shelf. The exemplary base 220 includes in cross section a pair of disposed ramp surfaces 222. The ramp surfaces 222 are each engageable with the respective prop member 214 and serve as a stop for rotational movement of the prop members in a first rotational direction when the bottle neck prop is in the raised position. The base further includes a pair of disposed stop surfaces 224. Each of the stop surfaces 224 are configured to engage a respective prop member 214 and serve as a stop for rotational movement of the prop in a second opposed rotational direction when the prop is in a lowered position.

In the exemplary arrangement the base 220 further includes a yoke 226. In the exemplary arrangement the yoke comprises a semicircular surface within the base 220 that is configured to engage the pivot bar 218 and enable rotation thereof about an axis. The exemplary base 220 further includes in cross section, an overlying lip 228. In the exemplary arrangement the lip 228 is configured to extend in overlying relation of the pivot bar 218. The overlying lip 218 helps to maintain the pivot bar within the base 220 and in engagement with the surface of the yoke. In some exemplary arrangements the lip 228 may be integrally formed with the base, and may be deformable so as to enable the installation and removal of the pivot bar 218 from engagement with the base. Of course it should be understood that this configuration is exemplary and in other arrangements other approaches may be used.

The exemplary base 220 of the bottle neck prop 212 further includes offset recesses 230. In the exemplary arrangement the offset recesses extend in a direction perpendicular to the shelf movement direction and are in horizontally aligned relation with the ramp surfaces 222. Each of the offset recesses 230 is bounded by a transverse projection 234. In an exemplary arrangement each transverse projection 234 is integrally formed with the inward extending lip 228. The exemplary recesses, transverse projections and ramp surfaces serve as parts of a catch. Each transverse projection 234 is configured to hold a respective prop member 214 engaged in a respective offset recess 230 when the pivot member 214 is positioned therein. This exemplary configuration causes the catch to be engaged and the prop members to be held in the prop raised position by engagement of the prop members in the offset recesses 230.

Figure 40:
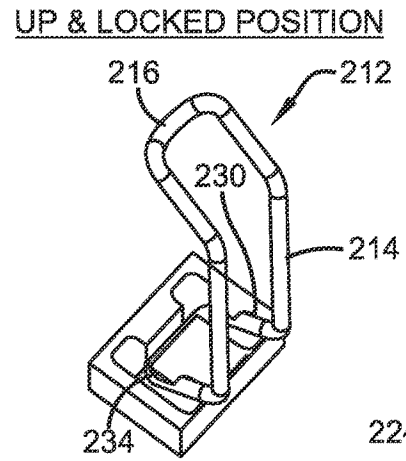
FIG. 40 is a front top left perspective view of the alternative bottle neck prop of FIG. 39 in a prop raised and locked position.
Figure 41:
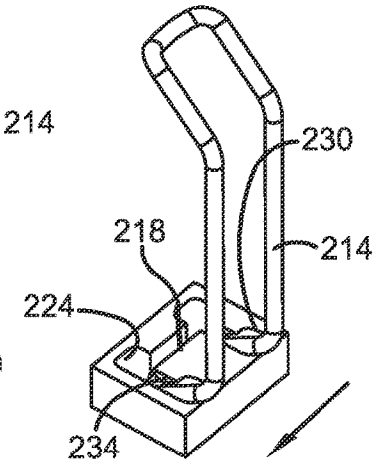
FIG. 41 is a view similar to FIG. 40 but with the prop members moved to an unlocked position.

This aspect of the exemplary bottle neck prop 212 is shown in FIGS. 40-43. In FIG. 40 the prop members 214 each extend in a respective offset recess 230. The associated transverse projection 234 prevents each respective prop member from rotating and moving downward from the raised position responsive to applied downward forces as shown in FIG. 40. Moving the prop members 214 manually in a transverse direction as represented by Arrow T in FIG. 41 causes the prop members to move sideways out of the offset recesses 230. Such movement serves to change the catch to a disengaged condition. With the prop members moved out of the offset recesses rotational movement of each prop member is no longer prevented by the transverse projections 234. This enables the prop members to rotate about an axis defined by the position of the surface of the yoke 226 toward the lowered position as shown in FIG. 42. With the prop members 214 disposed outside the offset recesses the prop members 214 are enabled to move to the lowered position as shown in FIGS. 43 and 39. Of course as can be appreciated each of the prop members may again be raised and held in a locked condition once they are raised and moved in a direction so that they are engaged in the offset recesses.

Of course it should be understood that this configuration of the bottle neck prop 212 and catch arrangement is exemplary and in other arrangements other approaches may be used.

FIGS. 44-47 show yet a further exemplary arrangement of a bottle neck prop 236. In this exemplary arrangement the bottle neck prop 236 includes a pair of prop members 238. The bottle neck prop members are disposed from one another in a direction that is perpendicular to the shelf movement direction similar to the prop members previously described. The exemplary bottle neck prop members 238 further each include in the lowered position a first portion, a second portion and a third portion that extend with contours similar to the bottle neck prop 172 previously described.

In this exemplary arrangement the prop members 238 are connected outwardly by a cross bar 240. At an end opposed of the cross bar 240 each prop member 238 includes an outward extending shaft portion 242. Each shaft portion extends outward and along a common axis 244. The exemplary prop members are resiliently movable to be closer to one another in the area disposed away from the cross bar.

The exemplary bottle neck prop 236 includes a base 246. The exemplary base 246 is configured to be either molded into a crossmember of an adjacent shelf or alternatively to be positioned within a pocket of a crossmember or other portion of the shelf structure. The exemplary base 246 includes a pair of side walls 248 each of which includes a respective aperture 250. Each respective aperture is configured for engaging a respective shaft portion 242 in rotatable engagement therewith.

The exemplary base includes an interior pocket 252. The prop members 238 are movable with the pocket 252. The pocket is bounded on a first side by a tapered ramp surface 254. The exemplary ramp surface extends horizontally across the pocket 252 and is configured to engage each of the prop members 238 and limit the rotational travel thereof in a first rotational direction. The ramp surface 254 is configured to engage the prop members when the prop is in a raised position. The exemplary base further includes a stop surface 256. The stop surface is configured to engage the prop members 238 and prevent further rotation thereof in an opposed rotational direction when the prop members are rotated so that the prop is in the lowered position.

Each of the side walls 248 of the exemplary base 246 include a first pair of inward extending tapered teeth 258. The exemplary base configuration and teeth 258 serve as a catch. The exemplary tapered teeth 258 are radially aligned and extend inwardly into the pocket 252. Each of the tapered teeth 258 are configured to engage a respective prop member 238. Each of the tapered teeth include an engaging surface 260. Each engaging surface 260 extends perpendicular to the direction of rotational travel of the respective adjacent prop member. As a result each engaging surface is configured in an engaged condition of the catch to prevent rotational movement of the prop member away from the raised position in which the prop members are engaged with the ramp surface 254.

In the exemplary arrangement each of the tapered teeth 258 includes a tapered surface 262. Each tapered surface 262 is positioned on an opposed side from the engaging surface 260 of the respective tapered tooth 258. The respective tapered surface 262 is configured to gradually displace a respective prop member 238 inwardly toward the other prop member, as the prop member is rotated in the pocket toward the raised position. Thus in the exemplary arrangement moving the prop members toward the raised position gradually moves each prop member inwardly toward the other prop member until the respective prop member moves beyond the inward edge of the tapered surface, at which point the respective prop member is in the raised position and moves outwardly. This results in the catch automatically being in the engaged condition. In this position downward movement of each prop member toward the lowered position is prevented by engagement with the respective engaging surface of each tapered tooth 258.

In this exemplary arrangement the exemplary base 246 further includes a further pair of tapered teeth 264. Each of the tapered teeth 264 has a configuration similar to the tapered teeth 258. The tapered teeth 264 are positioned to correspond to an angular position of the prop members that is intermediate of the prop raised position and the prop lowered position. As a result the tapered teeth 264 provide for the exemplary catch to enable the bottle neck prop 236 to be positioned and held locked in an engaged condition in an intermediate position that is between the raised position and the lowered position. This may be useful in some arrangements in which the shelf is utilized to hold bottles that are longer than standard bottles and which must be held at a smaller acute angle relative to horizontal. Further in the exemplary arrangement in the lowered position of the prop the tapered surfaces of each of the tapered teeth 264 serve to hold the prop members 238 in biased relation toward engagement with the stop surface 256 of the base.

Figures 45, 46, 47:
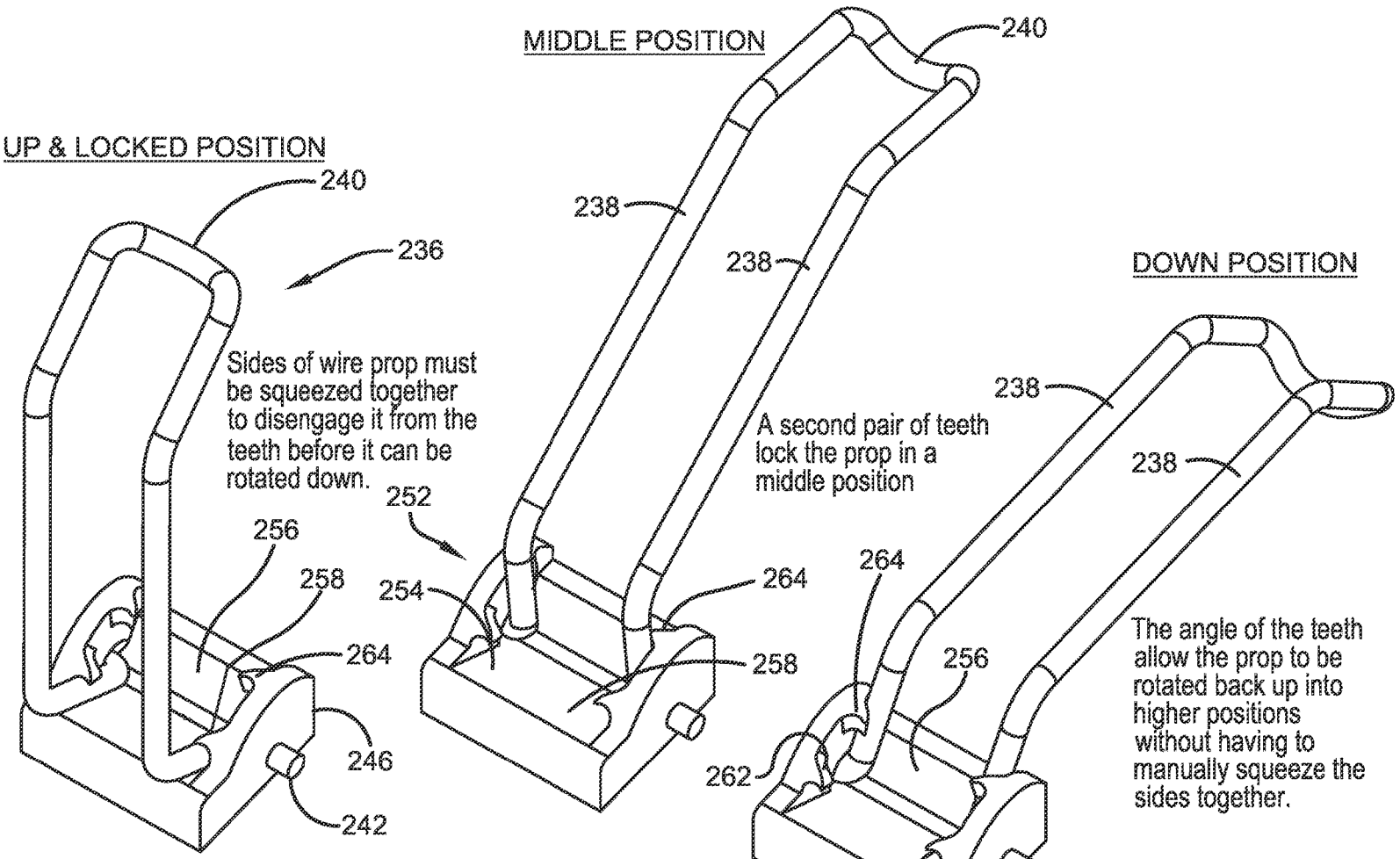
FIG. 45 is a top front right perspective view of the bottle neck prop of FIG. 44 in a prop raised position.
FIG. 46 is a top front right perspective view similar to FIG. 45 but with the prop members in a middle position intermediate of the prop raised position in the prop lowered position.
FIG. 47 is a top front right perspective view similar to FIG. 46 but with the prop shown in the prop lowered position.

Thus in the operation of the bottle neck prop 236, starting with the prop members in the lowered position shown in FIG. 47, the prop members 238 may be manually raised upwardly. As the shaft portions 242 rotate about the axis 244, the prop members adjacent to the base are biased inwardly by engagement with the tapered surfaces of the tapered teeth 264. Once the prop members move past the teeth 264, the prop may be left with the catch engaged in this position and the prop is prevented from moving downwardly toward the lowered position by the engaging surfaces of the tapered teeth 264. This might be done for example when the bottle neck prop is to be used in an intermediate position such as to engage with a particularly long bottle.

To move the bottle neck prop 236 to the fully raised position, rotation of the prop members 238 is continued so that the prop members engage the tapered surfaces 262 of tapered teeth 258. The prop members are biased inwardly toward one another until they move past the tapered teeth 258 at which point they move outwardly into engagement with the engaging surfaces 260. In this position the prop members are automatically held by the catch in the raised position between the engaging surfaces 260 of the tapered teeth 258 and the ramp surface 254.

To move the prop from the raised position to the lowered position, the prop members 238 are manually moved together a sufficient distance so that the rotational movement of the prop members is no longer prevented by the engaging surfaces 260 of the teeth 258. This manually changes the catch to a disengaged condition. This enables the prop members to be rotated toward the lowered position. With the prop members held more closely adjacent, the prop members may also be moved past the tapered teeth 264 to the lowered position in which they engage the stop surface 256. Of course it should be understood that this arrangement is exemplary in other arrangements other approaches and configurations may be used.

Thus the exemplary arrangements achieve improved operation, eliminate difficulties encountered in the use of prior devices, and attain the useful results that are described herein.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples, and the new and useful features are not limited to the exact features and configurations that have been shown and described.

It should be understood that the features and/or relationships associated with one exemplary arrangement can be combined with features and/or relationships from another exemplary arrangement to form other arrangements. That is, various features and/or relationships from various arrangements can be combined in further arrangements. The new and useful scope of the disclosure herein is not limited only to the exemplary arrangements that have been shown and described.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes and relationships are set forth in the appended claims.

I claim:

1. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a shelf, wherein the shelf is movably mounted in operative connection with the enclosure, positioned in vertically disposed parallel relation with a further shelf, and movable with the door in the door open position along a horizontal shelf movement direction between an outward position in which the shelf extends outward from the interior area through the opening, and a back position in which the shelf is fully within the interior area, wherein the shelf is selectively configurable and in an operative position includes a pair of horizontally disposed side walls, wherein each of the side walls extends parallel to the shelf movement direction, a front portion and a back portion, wherein the front portion is closer to the opening than the back portion when the shelf is in the back position, wherein the front portion extends intermediate of the side walls, is removably engageable with each of the side walls, includes a first bottle engaging recess, wherein the first bottle engaging recess is configured to releasably engage a portion of a first cylindrical side wall of a first bottle when a first bottle axis of the first bottle extends generally parallel to the side walls, wherein the back portion is in fixed immovable relation with the shelf, extends intermediate of the side walls, includes a second bottle engaging recess, wherein the second bottle engaging recess is configured to releasably engage a portion of a second cylindrical side wall of a second bottle when a second bottle axis of the second bottle extends generally horizontal and parallel to the side walls, wherein the second bottle engaging recess is horizontally disposed in a direction perpendicular to the shelf movement direction from the first bottle engaging recess, a bottle neck prop, wherein the bottle neck prop is movably mounted in operative connection with the back portion, wherein the bottle neck prop is movable through direct manual engagement with the prop between a prop lowered position and a prop raised position, wherein in the prop lowered position the prop is configured to engage a neck of the first bottle while the portion of the first cylindrical side wall is engaged in the first bottle engaging recess such that the first bottle axis extends generally horizontal, and wherein in the prop raised position the prop is configured to engage the neck of the first bottle while the portion of the first cylindrical side wall is engaged in the first bottle engaging recess such that the first bottle axis extends further upwardly with closer proximity to the back portion and at an acute angle relative to horizontal.

2. The apparatus according to claim 1 the further shelf, wherein the further shelf is disposed vertically above the shelf and includes a further pair of further horizontally disposed side walls, a further front portion, and a further back portion, wherein the further front portion extends intermediate of the further side walls, and is removably engageable with each of the further side walls, wherein the further front portion is removable from engagement with each of the further side walls through manual movement of the further front portion relative to each of the further side walls, wherein with the further front portion removed from engagement with the further side walls, the shelf and the further shelf each in the back position, and the bottle neck prop in the prop raised position, the prop is configured such that the first bottle is enabled to extend upwardly to at least the level of the further back portion.

3. The apparatus according to claim 1 wherein the shelf further includes a manually releasable catch, wherein the manually releasable catch is operative to engage and hold the prop in the prop raised position responsive at least in part to movement of the prop to the prop raised position, wherein with the catch engaged, the catch is operative to cause the prop to remain in the prop raised position and not move downward toward the prop lowered position responsive to an applied downward force, and responsive at least in part to direct manual engagement of the prop, release the catch, wherein with the catch released the prop is enabled to move from the prop raised position to the prop lowered position.

4. Apparatus comprising:

a cooler configured for holding beverage containers including:

an enclosure, wherein the enclosure bounds an interior area, wherein the enclosure includes an opening to the interior area, a door, wherein the door is movably mounted in operative connection with the enclosure, wherein the door is movable between a closed door position in which the door closes the opening, and an open door position in which the interior area is accessible from outside the enclosure through the opening, a shelf, wherein the shelf is movably mounted in operatively supported connection with the enclosure along a shelf movement direction between an outward position in which the shelf is enabled to extend outward from the interior area through the opening, and a back position in which the shelf is fully within the interior area, includes a front portion and a back portion, wherein the front portion is closer to the opening than the back portion when the shelf is in the back position, includes a first bottle engaging recess, wherein the first bottle engaging recess is configured to engage a first cylindrical side wall of a first bottle when a first bottle axis of the first bottle extends generally parallel to the shelf movement direction, wherein the back portion includes a second bottle engaging recess, wherein the second bottle engaging recess is configured to engage a second cylindrical side wall of a second bottle when a second bottle axis of the second bottle extends generally horizontal and generally parallel to the shelf movement direction, wherein the second bottle engaging recess is horizontally disposed in a direction perpendicular to the shelf movement direction from the first bottle engaging recess, a bottle neck prop, wherein the bottle neck prop is movably mounted in operative connection with the back portion, is selectively movable through direct manual engagement with the prop between a prop lowered position and a prop raised position wherein in the prop lowered position the prop is configured to engage a neck of the first bottle when the first cylindrical side wall is engaged with the first bottle engaging recess such that the first bottle axis extends generally horizontal, and wherein in the prop raised position the prop is configured to engage the neck of the first bottle when the first cylindrical side wall is engaged with the first bottle engaging recess such that the first bottle axis extends further upwardly with closer proximity to the back portion and at an acute angle relative to horizontal.

5. The apparatus according to claim 4 wherein the front portion is manually removable from the shelf.

6. The apparatus according to claim 5 wherein the shelf further includes a pair of horizontally disposed side walls, wherein each of the side walls extends parallel to the shelf movement direction, wherein the front portion extends between the side walls, and is removably engageable with each of the side walls.

7. The apparatus according to claim 5 and further comprising:

a further shelf, wherein the further shelf extends in parallel relation with and below the shelf, is movably mounted in operative supported connection with the enclosure and is movable along a further movement direction parallel to the movement direction, includes a further front portion and a further back portion, wherein the further front portion includes a further first bottle engaging recess, wherein the further first bottle engaging recess is configured to releasably engage a further first cylindrical side wall of a further first bottle when a further first bottle axis of the further first bottle extends generally parallel to the further movement direction, a further bottle neck prop, wherein the further bottle neck prop is movably mounted in operative connection with the further shelf, wherein the further bottle neck prop is movable between a further prop lowered position and a further prop raised position, wherein in the further prop lowered position the further prop is configured to engage a further neck of the further first bottle when the further first cylindrical side wall is engaged in the further first bottle engaging recess such that the further first bottle axis extends generally horizontal, wherein in the further prop raised position the further prop is configured to engage the further neck of the further first bottle when the further first cylindrical side wall is engaged in the further first bottle engaging recess such that the further first bottle axis extends further upwardly with closer proximity to the further back portion, wherein with the front portion of the shelf removed the further first bottle is enabled to extend above the back portion of the shelf.

8. The apparatus according to claim 7 wherein the further prop is movably mounted in operative connection with the further back portion.

9. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein at least one of the shelves is movably mounted in operative connection with the enclosure, positioned in vertically disposed parallel relation with at least one of the other shelves, and movable along a horizontal shelf movement direction between an outward position in which the shelf extends outward from the interior area through the opening, and a back position in which the shelf is fully within the interior area, wherein the at least one shelf is selectively configurable and in an operative position includes a pair of horizontally disposed side walls, wherein each of the side walls extends parallel to the shelf movement direction, a front portion and a back portion, wherein the front portion is closer to the opening than the back portion when the shelf is in the back position, wherein the front portion extends intermediate of the side walls, is removably engageable with each of the side walls, includes a plurality of first bottle engaging recessg, wherein the first bottle engaging recesses are spaced apart from one another in a direction perpendicular to the shelf movement direction, wherein each first bottle engaging recess is configured to releasably engage a portion of a respective first cylindrical side wall of a respective first bottle while a respective first bottle axis of the respective first bottle extends generally parallel to the side walls, wherein the back portion extends intermediate of the side walls, includes a second bottle engaging recess, wherein the second bottle engaging recess is configured to releasably engage a portion of a second cylindrical side wall of a second bottle while a second bottle axis of the second bottle extends generally horizontal and parallel to the side walls, wherein the second bottle engaging recess is horizontally disposed in the direction perpendicular to the shelf movement direction from the first bottle engaging recess, includes a plurality of bottle neck props, wherein each bottle neck prop is in centered alignment along a respective direction parallel to the shelf movement direction with one respective first bottle engaging recess, is movably mounted in operative connection with the back portion, wherein each bottle neck prop is movable between a prop lowered position and a prop raised position, wherein in the prop lowered position the prop is configured to engage a respective neck of a respective first bottle while the portion of the first cylindrical side wall of the respective first bottle is engaged in the respective first bottle engaging recess in centered alignment with the respective prop such that the respective first bottle axis extends generally horizontally, and wherein in the prop raised position the prop is configured to engage the respective neck of the respective first bottle while the portion of the first cylindrical side wall of the respective first bottle is engaged in the respective first bottle engaging recess in centered alignment with the respective prop such that the respective first bottle axis extends further upwardly with closer proximity to the back portion and at an acute angle relative to horizontal.

10. The apparatus according to claim 9 wherein the back portion includes a plurality of second bottle engaging recesses, wherein each respective second bottle engaging recess is disposed along a respective direction perpendicular to the shelf movement direction, intermediate of an immediately adjacent pair of first bottle engaging recesses.

11. The apparatus according to claim 9 wherein the back portion includes a plurality of second bottle engaging recesses, wherein each respective second bottle engaging recess is disposed along a respective direction perpendicular to the shelf movement direction, intermediate of an immediately adjacent pair of first bottle engaging recesses, wherein with each of the bottle neck props in the lowered position, the at least one shelf is configured such that each respective first bottle engaged with a respective first bottle engaging recess has its respective first bottle axis extending generally horizontally, and each respective second bottle engaged with a respective second bottle engaging recess has its respective second bottle axis extending generally horizontally.

12. The apparatus according to claim 9 wherein the back portion includes a plurality of second bottle engaging recesses, wherein each respective second bottle engaging recess is disposed along a respective direction perpendicular to the shelf movement direction, intermediate of an immediately adjacent pair of first bottle engaging recesses, wherein with each bottle neck prop in the raised position the at least one shelf is configured such that the respective first bottle axis of each respective first bottle engaged with a respective first bottle engaging recess extends at the acute angle to horizontal and the respective second bottle axis of each respective second bottle engaged with a respective second bottle engaging recess extends generally horizontal.

13. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein at least one of the shelves is movably mounted in operative connection with the enclosure, positioned in vertically disposed parallel relation with at least one of the other shelves, and movable along a horizontal shelf movement direction between an outward position in which the shelf extends outward from the interior area through the opening, and a back position in which the shelf is fully within the interior area, wherein the at least one shelf is selectively configurable and in an operative position includes a pair of horizontally disposed side walls, wherein each of the side walls extends parallel to the shelf movement direction, a front portion and a back portion, wherein the front portion is closer to the opening than the back portion when the shelf is in the back position, wherein the front portion extends intermediate of the side walls, is removably engageable with each of the side walls, includes a first bottle engaging recess, wherein the first bottle engaging recess is configured to releasably engage a portion of a first cylindrical side wall of a first bottle while a first bottle axis of the first bottle extends generally parallel to the side walls, wherein the back portion extends intermediate of the side walls, includes a second bottle engaging recess, wherein the second bottle engaging recess is configured to releasably engage a portion of a second cylindrical side wall of a second bottle while a second bottle axis of the second bottle extends generally horizontal and parallel to the side walls, wherein the second bottle engaging recess is horizontally disposed in a direction perpendicular to the shelf movement direction from the first bottle engaging recess, a bottle neck prop, wherein the bottle neck prop comprises a pair of disposed prop members, wherein the prop members are disposed from one another in the direction perpendicular to the shelf movement direction, wherein each of the prop members is rotatably movably mounted about a common pivot axis in operative connection with the back portion, wherein the prop members are connected by a cross bar, wherein the cross bar is disposed away from the pivot axis, wherein the bottle neck prop is movable between a prop lowered position and a prop raised position, wherein in the prop lowered position the prop is configured to engage a neck of the first bottle that extends intermediate of the pair of prop members while the portion of the first cylindrical side wall is engaged in the first bottle engaging recess such that the first bottle axis extends generally horizontally, and wherein in the prop raised position the prop is configured to engage the neck of the first bottle that extends intermediate of the pair of prop members while the portion of the first cylindrical side wall is engaged in the first bottle engaging recess such that the first bottle axis extends further upwardly with closer proximity to the back portion and at an acute angle relative to horizontal.

14. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein at least one of the shelves is movably mounted in operative connection with the enclosure, positioned in vertically disposed parallel relation with at least one of the other shelves, and movable along a horizontal shelf movement direction between an outward position in which the shelf extends outward from the interior area through the opening, and a back position in which the shelf is fully within the interior area, wherein the at least one shelf is selectively configurable and in an operative position includes a pair of horizontally disposed side walls, wherein each of the side walls extends parallel to the shelf movement direction, a front portion and a back portion, wherein the front portion is closer to the opening than the back portion when the shelf is in the back position, wherein the front portion extends intermediate of the side walls, is removably engageable with each of the side walls, includes a first bottle engaging recess, wherein the first bottle engaging recess
is configured to releasably engage a portion of a first cylindrical side wall of a first bottle while a first bottle axis of the first bottle extends generally parallel to the side walls,
wherein the back portion
extends intermediate of the side walls,
includes a second bottle engaging recess,
wherein the second bottle engaging recess
is configured to releasably engage a portion of a second cylindrical side wall of a second bottle while a second bottle axis of the second bottle extends generally horizontal and parallel to the side walls,
wherein the second bottle engaging recess is horizontally disposed in a direction perpendicular to the shelf movement direction from the first bottle engaging recess,
a bottle neck prop,
wherein the bottle neck prop
comprises a pair of disposed prop members, wherein the prop members are disposed from one another in the direction perpendicular to the shelf movement direction,
wherein each prop member is rotatably movably mounted in operative connection with the back portion about a common axis,
wherein the bottle neck prop is movable between
a prop lowered position and a prop raised position,
wherein in the prop lowered position each prop member includes a first portion that extends upward from the axis, and a second portion that extends from the first portion directly horizontally, and an end portion that extends downward from the second portion to a respective member end, and wherein a cross bar connects the prop members at the respective member ends,
wherein in the prop lowered position the prop is configured to engage a neck of the first bottle that extends intermediate of the prop members of the pair while the portion of the first cylindrical side wall is engaged in the first bottle engaging recess such that the first bottle axis extends generally horizontally, and
wherein in the prop raised position the prop is configured to engage the neck of the first bottle while the portion of the first cylindrical side wall is engaged in the first bottle engaging recess such that the first bottle axis extends further upwardly with closer proximity to the back portion and at an acute angle relative to horizontal.

15. Apparatus comprising:
a cooler configured for holding beverage containers including:
an enclosure, wherein the enclosure bounds an interior area,
wherein the enclosure includes an opening therethrough to the interior area,
a door, wherein the door is movably mounted in operative connection with the enclosure,
wherein the door is movable between a closed door position in which the door closes the opening, and an open door position in which the interior area is accessible from outside the enclosure through the opening,
a plurality of shelves,
wherein at least one of the shelves is
movably mounted in operative connection with the enclosure,
positioned in vertically disposed parallel relation with at least one of the other shelves, and
movable along a horizontal shelf movement direction between an outward position in which the shelf extends outward from the interior area through the opening, and a back position in which the shelf is fully within the interior area,
wherein the at least one shelf is selectively configurable and in an operative position includes
a pair of horizontally disposed side walls,
wherein each of the side walls extends parallel to the shelf movement direction,
a front portion and a back portion, wherein the front portion is closer to the opening than the back portion when the shelf is in the back position,
wherein the front portion
extends intermediate of the side walls,
is removably engageable with each of the side walls,
includes a first bottle engaging recess,
wherein the first bottle engaging recess
is configured to releasably engage a portion of a first cylindrical side wall of a first bottle while a first bottle axis of the first bottle extends generally parallel to the side walls,
is bounded by a pair of first bottle engaging struts,
wherein each first bottle engaging strut
is elongated in a direction parallel to the shelf movement direction,
is disposed from the other first bottle engaging strut of the pair in the direction perpendicular to the shelf movement direction,
includes a curved inner face, wherein the curved inner face is configured to be in facing relation with the first bottle axis while the portion of first cylindrical side wall of the first bottle is in engagement with the first bottle engaging recess,
wherein the back portion
extends intermediate of the side walls, includes a second bottle engaging recess,
wherein the second bottle engaging recess
is configured to releasably engage a portion of a second cylindrical side wall of a second bottle while a second bottle axis of the second bottle extends generally horizontal and parallel to the side walls,
wherein the second bottle engaging recess is horizontally disposed in a direction perpendicular to the shelf movement direction from the first bottle engaging recess,
a bottle neck prop,
wherein the bottle neck prop
is movably mounted in operative connection with the back portion,
wherein the bottle neck prop is movable between
a prop lowered position and a prop raised position,
wherein in the prop lowered position the prop is configured to engage a neck of the first bottle while the portion of the first cylindrical side wall is engaged in the first bottle engaging recess such that the first bottle axis extends generally horizontally, and
wherein in the prop raised position the prop is configured to engage the neck of the first bottle while the portion of the first cylindrical side wall is engaged in the first bottle engaging recess such that the first bottle axis extends further upwardly with closer proximity to the back portion and at an acute angle relative to horizontal.

16. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein at least one of the shelves is movably mounted in operative connection with the enclosure, positioned in vertically disposed parallel relation with at least one of the other shelves, and movable along a horizontal shelf movement direction between an outward position in which the shelf extends outward from the interior area through the opening, and a back position in which the shelf is fully within the interior area, wherein the at least one shelf is selectively configurable and in an operative position includes a pair of horizontally disposed side walls, wherein each of the side walls extends parallel to the shelf movement direction, a front portion and a back portion, wherein the front portion is closer to the opening than the back portion when the shelf is in the back position, wherein the front portion extends intermediate of the side walls, is removably engageable with each of the side walls, includes a first bottle engaging recess, wherein the first bottle engaging recess is configured to releasably engage a portion of a first cylindrical side wall of a first bottle while a first bottle axis of the first bottle extends generally parallel to the side walls, wherein the back portion extends intermediate of the side walls, includes a second bottle engaging recess, wherein the second bottle engaging recess is configured to releasably engage a portion of a second cylindrical side wall of a second bottle while a second bottle axis of the second bottle extends generally horizontal and parallel to the side walls, is bounded by a pair of second bottle engaging struts, wherein each second bottle engaging strut is elongated in a direction parallel to the shelf movement direction, is disposed from the other second bottle engaging strut of the pair in the direction perpendicular to the shelf movement direction, includes a curved inner face, wherein the curved inner face is configured to be in facing relation with the second bottle axis while the portion of the second cylindrical side wall of the second bottle is in engagement with the second bottle engaging recess, wherein the second bottle engaging recess is horizontally disposed in a direction perpendicular to the shelf movement direction from the first bottle engaging recess, a bottle neck prop, wherein the bottle neck prop is movably mounted in operative connection with the back portion, wherein the bottle neck prop is movable between a prop lowered position and a prop raised position, wherein in the prop lowered position the prop is configured to engage a neck of the first bottle while the portion of the first cylindrical side wall is engaged in the first bottle engaging recess such that the first bottle axis extends generally horizontally, and wherein in the prop raised position the prop is configured to engage the neck of the first bottle while the portion of the first cylindrical side wall is engaged in the first bottle engaging recess such that the first bottle axis extends further upwardly with closer proximity to the back portion and at an acute angle relative to horizontal.

17. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein at least one of the shelves is movably mounted in operative connection with the enclosure, positioned in vertically disposed parallel relation with at least one of the other shelves, and movable along a horizontal shelf movement direction between an outward position in which the shelf extends outward from the interior area through the opening, and a back position in which the shelf is fully within the interior area, wherein the at least one shelf is selectively configurable and in an operative position includes a pair of horizontally disposed side walls, wherein each of the side walls extends parallel to the shelf movement direction, a front portion and a back portion, wherein the front portion is closer to the opening than the back portion when the shelf is in the back position, wherein the front portion extends intermediate of the side walls, is removably engageable with each of the side walls, includes a first bottle engaging recess, wherein the first bottle engaging recess is configured to releasably engage a portion of a first cylindrical side wall of a first bottle while a first bottle axis of the first bottle extends generally parallel to the side walls, wherein the back portion extends intermediate of the side walls, is in fixed immovable operative connection with the side walls, includes a second bottle engaging recess, wherein the second bottle engaging recess is configured to releasably engage a portion of a second cylindrical side wall of a second bottle while a second bottle axis of the second bottle extends generally horizontal and parallel to the side walls, wherein the second bottle engaging recess is horizontally disposed in a direction perpendicular to the shelf movement direction from the first bottle engaging recess, a bottle neck prop, wherein the bottle neck prop is movably mounted in operative connection with the back portion, wherein the bottle neck prop is movable between a prop lowered position and a prop raised position, wherein in the prop lowered position the prop is configured to engage a neck of the first bottle while the portion of the first cylindrical side wall is engaged in the first bottle engaging recess such that the first bottle axis extends generally horizontally, and wherein in the prop raised position the prop is configured to engage the neck of the first bottle while the portion of the first cylindrical side wall is engaged in the first bottle engaging recess such that the first bottle axis extends further upwardly with closer proximity to the back portion and at an acute angle relative to horizontal.

18. The apparatus according to claim 17 wherein the front portion is releasably engageable with the side walls through engagement of disengageable interengaging projections and recesses, wherein the interengaging projections and recesses are configured such that engagement and disengagement of the projections and recesses are accomplished without tools and through only movement of the front portion relative to the side walls.

19. The apparatus according to claim 17 wherein with the bottle neck prop in the lowered position, the at least one shelf is configured such that at least a portion of the first bottle and at least a portion of the second bottle extend in horizontally side-by-side relation.

20. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein at least one of the shelves is movably mounted in operative connection with the enclosure, positioned in vertically disposed parallel relation with at least one of the other shelves, and movable along a horizontal shelf movement direction between an outward position in which the shelf extends outward from the interior area through the opening, and a back position in which the shelf is fully within the interior area, wherein the at least one shelf is selectively configurable and in an operative position includes a pair of horizontally disposed side walls, wherein each of the side walls extends parallel to the shelf movement direction, a front portion and a back portion, wherein the front portion is closer to the opening than the back portion when the shelf is in the back position, wherein the front portion extends intermediate of the side walls, is removably engageable with each of the side walls, includes a plurality of first bottle engaging recesses, wherein each first bottle engaging recess is spaced apart from each of the other first bottle engaging recesses in the direction perpendicular to the shelf movement direction, and is configured to releasably engage a portion of a first cylindrical side wall of a first bottle while a first bottle axis of the first bottle extends generally parallel to the side walls, wherein the back portion extends intermediate of the side walls, includes a second bottle engaging recess, wherein the second bottle engaging recess is configured to releasably engage a portion of a second cylindrical side wall of a second bottle while a second bottle axis of the second bottle extends generally horizontal and parallel to the side walls, wherein the second bottle engaging recess is horizontally disposed in a direction perpendicular to the shelf movement direction from the first bottle engaging recess, a plurality of bottle neck props, wherein each respective bottle neck prop is movably mounted in operative connection with the back portion, is manually movable independently of each of the other props between a prop lowered position and a prop raised position, is in centered alignment along a respective direction parallel to the shelf movement direction with one respective first bottle engaging recess, comprises a respective pair of disposed prop members, wherein the prop members of the pair are disposed from one another in the direction perpendicular to the shelf movement direction, wherein in the prop lowered position the respective bottle neck prop is configured to engage a respective neck of a respective first bottle such that the respective neck extends intermediate of the respective pair of disposed prop members, while the portion of the first cylindrical side wall is engaged in the first bottle engaging recess such that the first bottle axis extends generally horizontally, and wherein in the prop raised position the prop is configured to engage the respective neck of the first bottle while the portion of the first cylindrical side wall is engaged in the first bottle engaging recess such that the first bottle axis extends further upwardly with closer proximity to the back portion and at an acute angle relative to horizontal.

21. The apparatus according to claim 10 wherein each respective bottle neck prop is configured such that in both the prop lowered position and in the prop raised position the respective neck of the respective first bottle extends intermediate of the prop members of the respective pair of disposed prop members of the respective prop.

22. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein at least one of the shelves is movably mounted in operative connection with the enclosure, positioned in vertically disposed parallel relation with at least one of the other shelves, and movable along a horizontal shelf movement direction between an outward position in which the shelf extends outward from the interior area through the opening, and a back position in which the shelf is fully within the interior area, wherein the at least one shelf is selectively configurable and in an operative position includes a pair of horizontally disposed side walls, wherein each of the side walls extends parallel to the shelf movement direction, a front portion and a back portion, wherein the front portion is closer to the opening than the back portion when the shelf is in the back position, wherein the front portion extends intermediate of the side walls, is removably engageable with each of the side walls, includes a first bottle engaging recess, wherein the first bottle engaging recess is configured to releasably engage a portion of a first cylindrical side wall of a first bottle while a first bottle axis of the first bottle extends generally parallel to the side walls, wherein the back portion extends intermediate of the side walls, includes a second bottle engaging recess, wherein the second bottle engaging recess is configured to releasably engage a portion of a second cylindrical side wall of a second bottle while a second bottle axis of the second bottle extends generally horizontal and parallel to the side walls, wherein the second bottle engaging recess is horizontally disposed in a direction perpendicular to the shelf movement direction from the first bottle engaging recess, a bottle neck prop, wherein the bottle neck prop is movably mounted in operative connection with the back portion, comprises a pair of disposed prop members, wherein the prop members are disposed from one another in the direction perpendicular to the horizontal shelf movement direction and are rotatable about a common pivot axis, wherein the bottle neck prop is movable between a prop lowered position and a prop raised position, wherein in the prop lowered position the prop is configured to engage a neck of the first bottle while the portion of the first cylindrical side wall is engaged in the first bottle engaging recess such that the first bottle axis extends generally horizontally, and wherein in the prop raised position the prop is configured to engage the neck of the first bottle while the portion of the first cylindrical side wall is engaged in the first bottle engaging recess such that the first bottle axis extends further upwardly with closer proximity to the back portion and at an acute angle relative to horizontal, wherein the prop is configured such that in both the prop lowered position and the prop raised position the neck of the first bottle extends intermediate of the prop members of the pair of disposed prop members.

23. The apparatus according to claim 22 wherein in both the prop lowered position and in the prop raised position the bottle neck prop is configured such that the neck of the first bottle extends in engagement with each prop member of the pair of disposed prop members.

24. The apparatus according to claim 22 and further comprising:

a manually releasable catch, wherein the manually releasable catch is operable to selectively hold the bottle neck prop in the raised position.

25. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein at least one of the shelves is movably mounted in operative connection with the enclosure, positioned in vertically disposed parallel relation with at least one of the other shelves, and movable along a horizontal shelf movement direction between an outward position in which the shelf extends outward from the interior area through the opening, and a back position in which the shelf is fully within the interior area, wherein the at least one shelf is selectively configurable and in an operative position includes a pair of horizontally disposed side walls, wherein each of the side walls extends parallel to the shelf movement direction, a front portion and a back portion, wherein the front portion is closer to the opening than the back portion when the shelf is in the back position, wherein the front portion extends intermediate of the side walls, is removably engageable with each of the side walls, includes a first bottle engaging recess, wherein the first bottle engaging recess is configured to releasably engage a portion of a first cylindrical side wall of a first bottle while a first bottle axis of the first bottle extends generally parallel to the side walls, a front plate, wherein the front plate extends closer to the opening than the first bottle engaging recess when the shelf is in the back position, wherein the back portion extends intermediate of the side walls, includes a second bottle engaging recess, wherein the second bottle engaging recess is configured to releasably engage a portion of a second cylindrical side wall of a second bottle while a second bottle axis of the second bottle extends generally horizontal and parallel to the side walls, wherein the second bottle engaging recess is horizontally disposed in a direction perpendicular to the shelf movement direction from the first bottle engaging recess, a bottle neck prop, wherein the bottle neck prop is movably mounted in operative connection with the back portion, wherein the bottle neck prop is movable between a prop lowered position and a prop raised position, wherein in the prop lowered position the prop is configured to engage a neck of the first bottle while the portion of the first cylindrical side wall is engaged in the first bottle engaging recess such that the first bottle axis extends generally horizontally, and wherein in the prop raised position the prop is configured to engage the neck of the first bottle while the portion of the first cylindrical side wall is engaged in the first bottle engaging recess and a bottom of the first bottle is engaged with the front plate such that the first bottle axis extends further upwardly with closer proximity to the back portion and at an acute angle relative to horizontal.

26. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein at least one of the shelves is movably mounted in operative connection with the enclosure, positioned in vertically disposed parallel relation with at least one of the other shelves, and movable along a horizontal shelf movement direction between an outward position in which the shelf extends outward from the interior area through the opening, and a back position in which the shelf is fully within the interior area, wherein the at least one shelf is selectively configurable and in an operative position includes a pair of horizontally disposed side walls, wherein each of the side walls extends parallel to the shelf movement direction, a front portion and a back portion, wherein the front portion is closer to the opening than the back portion when the shelf is in the back position, wherein the front portion extends intermediate of the side walls, is removably engageable with each of the side walls, includes a first bottle engaging recess, wherein the first bottle engaging recess is configured to releasably engage a portion of a first cylindrical side wall of a first bottle while a first bottle axis of the first bottle extends generally parallel to the side walls, wherein the back portion extends intermediate of the side walls, includes a cross member that extends horizontally between and is in operative connection with the side walls, includes a second bottle engaging recess, wherein the second bottle engaging recess is configured to releasably engage a portion of a second cylindrical side wall of a second bottle while a second bottle axis of the second bottle extends generally horizontal and parallel to the side walls, wherein the second bottle engaging recess is horizontally disposed in a direction perpendicular to the shelf movement direction from the first bottle engaging recess, a bottle neck prop, wherein the bottle neck prop is movably mounted in operative supported connection with the cross member, wherein the bottle neck prop is movable between a prop lowered position and a prop raised position, wherein in the prop lowered position the prop is configured to engage a neck of the first bottle while the portion of the first cylindrical side wall is engaged in the first bottle engaging recess such that the first bottle axis extends generally horizontally, and wherein in the prop raised position the prop is configured to engage the neck of the first bottle while the portion of the first cylindrical side wall is engaged in the first bottle engaging recess such that the first bottle axis extends further upwardly with closer proximity to the back portion and at an acute angle relative to horizontal.

27. Apparatus comprising:

a cooler configured for holding beverage containers including:

an enclosure, wherein the enclosure bounds an interior area, wherein the enclosure includes an opening therethrough to the interior area, a door, wherein the door is movably mounted in operative connection with the enclosure, wherein the door is movable between a closed door position in which the door closes the opening, and an open door position in which the interior area is accessible from outside the enclosure through the opening, a plurality of shelves, wherein the shelves include a first shelf and a further shelf, wherein each of the first shelf and the further shelf is movably mounted in operative connection with the enclosure, positioned in vertically disposed parallel relation with the other of the first shelf or the further shelf, and movable along a horizontal shelf movement direction between an outward position in which the respective shelf extends outward from the interior area through the opening, and a back position in which the respective shelf is fully within the interior area, wherein each of the first shelf and the further shelf is selectively configurable and in an operative position includes a respective pair of horizontally disposed side walls, wherein each of the side walls extends parallel to the shelf movement direction, a respective front portion and a respective back portion, wherein the front portion is closer to the opening than the back portion when the shelf is in the back position, wherein the front portion extends intermediate of the side walls, is removably engageable with each of the side walls, includes a respective first bottle engaging recess, wherein the respective first bottle engaging recess is configured to releasably engage a respective portion of a respective first cylindrical side wall of a respective first bottle while a first bottle axis of the first bottle extends generally parallel to the side walls, wherein the back portion extends intermediate of the side walls, includes a respective second bottle engaging recess, wherein the respective second bottle engaging recess is configured to releasably engage a respective portion of a respective second cylindrical side wall of a respective second bottle while a second bottle axis of the second bottle extends generally horizontal and parallel to the side walls, wherein the respective second bottle engaging recess is horizontally disposed in a direction perpendicular to the shelf movement direction from the respective first bottle engaging recess, a respective bottle neck prop, wherein the respective bottle neck prop is movably mounted in operative connection with the respective back portion, wherein the bottle neck prop is movable between a prop lowered position and a prop raised position, wherein in the prop lowered position the prop is configured to engage a neck of the respective first bottle while the respective portion of the respective first cylindrical side wall is engaged in the respective first bottle engaging recess such that the first bottle axis extends generally horizontally, and wherein in the prop raised position the prop is configured to engage the neck of the first bottle while the portion of the first cylindrical side wall is engaged in the first bottle engaging recess such that the first bottle axis extends further upwardly with closer proximity to the back portion and at an acute angle relative to horizontal, wherein with the first shelf and the further shelf each respectively in the back position, the further shelf is positioned in the interior area immediately above and in overlying relation of the first shelf, wherein the first shelf and the further shelf are configured such that with the respective front portion of the further shelf removed and the bottle neck prop of the first shelf in the prop raised position, the bottle neck prop extends upward from the first shelf to at least a vertical level of the respective back portion of the further shelf.

28. The apparatus according to claim 27 wherein the first shelf and the further shelf are configured such that with the respective front portion of the further shelf removed and the bottle neck prop of the first shelf in the prop raised position, the bottle neck of the respective first bottle that has the respective portion of the first cylindrical side wall thereof engaged in the first bottle engaging recess of the first shelf, extends upward from the first shelf to at least a vertical level of the respective back portion of the further shelf.

* * * * *